US006708682B2

(12) United States Patent
Osanai

(10) Patent No.: US 6,708,682 B2
(45) Date of Patent: Mar. 23, 2004

(54) EVAPORATED FUEL PROCESSING APPARATUS FOR INTERNAL COMBUSTION ENGINE

(75) Inventor: Akinori Osanai, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 78 days.

(21) Appl. No.: 10/157,086

(22) Filed: May 30, 2002

(65) Prior Publication Data

US 2003/0005916 A1 Jan. 9, 2003

(30) Foreign Application Priority Data

Jun. 28, 2001 (JP) ..... 2001-197269
Feb. 13, 2002 (JP) ..... 2002-034769

(51) Int. Cl.[7] ..... F02M 33/02
(52) U.S. Cl. ..... 123/698; 123/520
(58) Field of Search ..... 123/698, 520

(56) References Cited

U.S. PATENT DOCUMENTS 5,474,049 A * 12/1995 Nagaishi et al. ..... 123/520
5,682,862 A * 11/1997 Sato et al. ..... 123/520
6,173,703 B1 * 1/2001 Matsumoto ..... 123/674

FOREIGN PATENT DOCUMENTS

| | | |
|---|---|---|
| JP | A 6-264832 | 9/1994 |
| JP | A 7-54719 | 2/1995 |
| JP | A 7-301157 | 11/1995 |
| JP | A 7-301158 | 11/1995 |
| JP | A 8-177652 | 7/1996 |
| JP | A 8-284765 | 10/1996 |

* cited by examiner

*Primary Examiner*—Erick Solis
(74) *Attorney, Agent, or Firm*—Oliff & Berridge, PLC

(57) ABSTRACT

An evaporated fuel processing apparatus for an internal combustion engine is provided which includes a canister that traps fuel vapors generated in a fuel tank, and a purge control valve disposed between the canister and an intake passage of the internal combustion engine. A controller of the apparatus determines (a) a quantity of purge gas that passes through the purge control valve, (b) a fuel injection amount correction coefficient for reducing a deviation of an actual air-fuel ratio from a target air-fuel ratio due to the purge gas, (c) a fresh air ratio that represents a ratio of purge air contained in the purge gas to the purge gas, based on the fuel injection amount correction coefficient, and (d) a quantity of the purge air based on the quantity of the purge gas and the fresh air ratio. The controller then controls the internal combustion engine based on the quantity of the purge air.

45 Claims, 27 Drawing Sheets

EVAPORATED FUEL PROCESSING APPARATUS FOR INTERNAL COMBUSTION ENGINE

INCORPORATION BY REFERENCE

The disclosures of Japanese Patent Applications No. 2001-197269 filed on Jun. 28, 2001 and No. 2002-034769 filed on Feb. 13, 2002, each including the specification, drawings and abstract, are incorporated herein by reference in its entirety.

BACKGROUND OF THE INVENTION

1. Field of Invention

The invention relates to an evaporated fuel processing apparatus for an internal combustion engine, and more particularly to an evaporated fuel processing apparatus adapted to purge evaporated fuel generated in a fuel tank into an intake passage of the internal combustion engine.

2. Description of Related Art

An evaporated fuel processing apparatus, such as that as disclosed in Japanese Laid-open Patent Publication No.7-54719, is known. The evaporated fuel processing apparatus uses a canister for trapping evaporated fuel (fuel vapors) generated in a fuel tank, and releases (purges) the fuel vapors stored in the canister into an intake passage of an internal combustion engine during an operation thereof. In the internal combustion engine including the evaporated fuel processing apparatus as described above, the quantity of air contained in purge gas (i.e., purge air quantity) is a useful parameter for controlling the quantity of purge gas flowing from the canister into the intake passage of the engine, and for controlling the fuel injection amount so as to reduce a deviation of the actual air-fuel ratio from a target air-fuel ratio.

For determining the quantity of the purge air, the above-described known evaporated fuel processing apparatus includes a dedicated airflow meter for detecting the quantity of air flowing into the canister. The airflow meter enables accurate detection of the quantity of air that passes through the canister, namely, the quantity of purge air contained in the purge gas that flows from the canister into the intake passage. Thus, the known evaporated fuel processing apparatus is able to accurately control the quantity of purge gas and the fuel injection amount by using the detected purge air quantity as a control parameter.

In the known evaporated fuel processing apparatus, however, a pressure loss occurs at the airflow meter disposed in an ambient air inlet of the canister. Such a pressure loss may cause a reduction in the purge gas quantity and may cause a change in the internal pressure of the canister in accordance with the change in the purge gas quantity. If the internal pressure of the canister changes, the quantity of fuel vapors purged from the canister changes accordingly, resulting in deterioration of the accuracy of purge control (air-fuel ratio feedback control).

Furthermore, when the airflow meter is exclusively used for detecting the quantity of purge air as described above, the cost of the evaporated fuel processing apparatus increases because of the use of the airflow meter as compared with the case where such an airflow meter is not used. Thus, the known evaporated fuel processing apparatus suffers from various problems caused by the use of the dedicated airflow meter.

SUMMARY OF THE INVENTION

It is therefore one object of the invention to provide an evaporated fuel processing apparatus that is able to detect a quantity of purge air flowing from a canister into an intake passage of the engine without using a dedicated airflow meter.

To accomplish the above and/or above object(s), there is provided according to one aspect of the invention, which provides an evaporated fuel processing apparatus for an internal combustion engine, which includes: (1) a canister that traps fuel vapors generated in a fuel tank, and (2) a purge control valve disposed between the canister and an intake passage of the internal combustion engine. A controller of the evaporated fuel processing apparatus determines (a) a quantity of purge gas that passes through the purge control valve, (b) a fuel injection amount correction coefficient for reducing a deviation of an actual air-fuel ratio from a target air-fuel ratio due to the purge gas, (c) a fresh air ratio that represents a ratio of purge air contained in the purge gas to the purge gas, based on the fuel injection amount correction coefficient, and (d) a quantity of the purge air based on the quantity of the purge gas and the fresh air ratio. The controller then controls the internal combustion engine based on the quantity of the purge air.

With the evaporated fuel processing apparatus constructed as described above, the rate of the purge air to the purge gas, or the fresh air ratio, is obtained based on the fuel injection amount correction coefficient, and the purge air quantity can be calculated based on the fresh air ratio. Thus, according to the above aspect of the invention, the purge air quantity can be determined without using a dedicated airflow meter, and the thus determined purge air quantity can be utilized for controlling the internal combustion engine.

According to another aspect of the invention, there is provided an evaporated fuel processing apparatus, which includes: (1) a canister that traps fuel vapors generated in a fuel tank, and (2) a purge control valve disposed between the canister and an intake passage of the internal combustion engine. A controller of the evaporated fuel processing apparatus determines (a) a quantity of purge gas that passes through the purge control valve, (b) a fuel injection amount correction coefficient for eliminating a deviation of an actual air-fuel ratio from a target air-fuel ratio due to the purge gas, (c) a quantity of fuel vapors supplied to the internal combustion engine through the purge control valve, based on a basic fuel injection amount and the fuel injection amount correction coefficient, and (d) a quantity of purge air that passes through the purge control valve, by subtracting the quantity of the fuel vapors from the quantity of the purge gas. The controller then controls the internal combustion engine based on the quantity of the purge air.

With the evaporated fuel processing apparatus constructed as described above, an amount of correction of the fuel injection amount can be obtained based on the basic fuel injection amount and the fuel injection amount correction coefficient. The correction amount corresponds to the quantity of fuel vapors purged from the canister. Thus, according to the above aspect of the invention, the quantity of fuel vapors purged can be obtained based on the basic fuel injection amount and the fuel injection amount correction coefficient. It is thus possible to determine the quantity of purge air with high accuracy, by subtracting the quantity of fuel vapors from the quantity of the purge gas.

BRIEF DESCRIPTION OF THE DRAWINGS

The foregoing and/or further objects, features and advantages of the invention will become more apparent from the following description of preferred embodiments with reference to the accompanying drawings, in which like numerals are used to represent like elements and wherein.

DETAILED DESCRIPTION OF PREFERRED EMBODIMENTS

Figure 1:
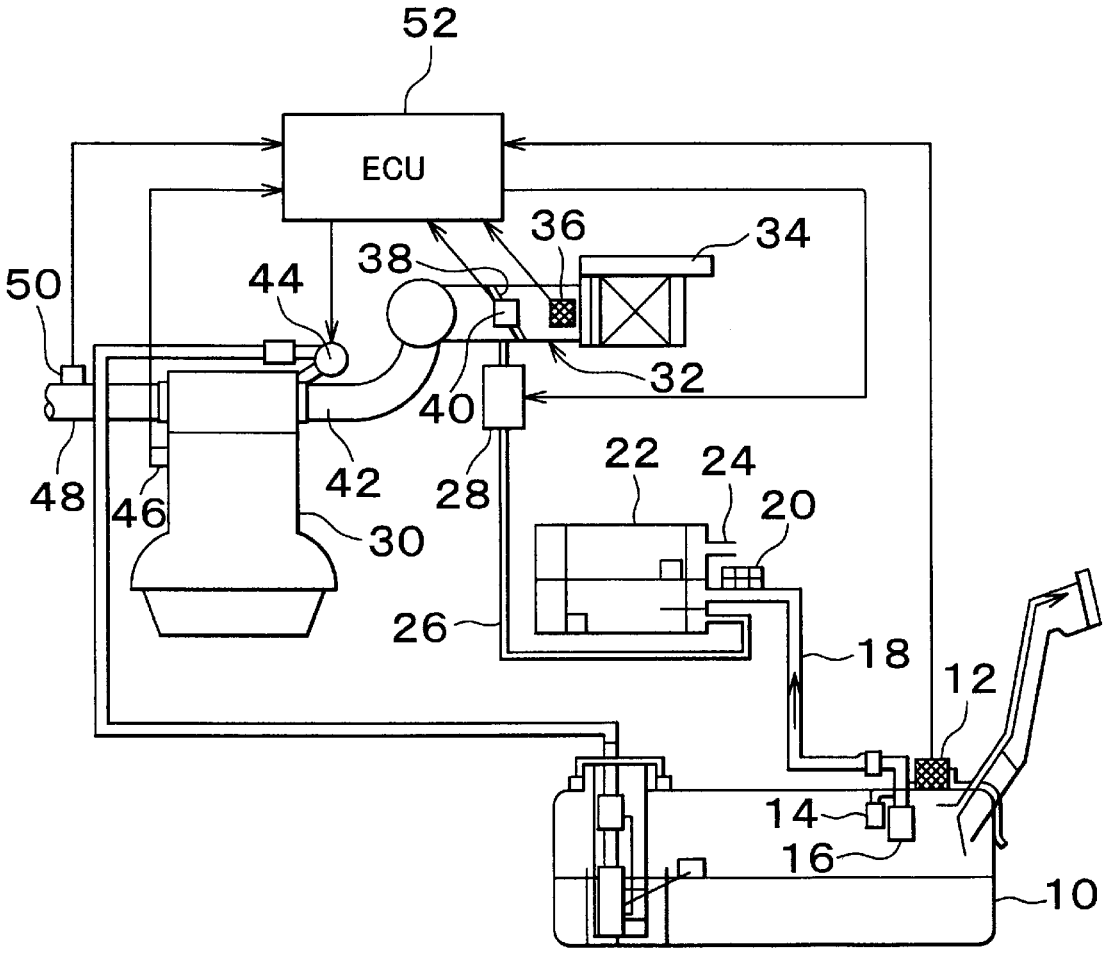
FIG. 1 is a view showing the construction of an evaporated fuel processing apparatus according to a first embodiment of the invention.

Hereinafter, a first embodiment of the invention will be described with reference to FIG. 1 through FIG. 5. FIG. 1 shows a system including an evaporated fuel processing apparatus according to the first embodiment of the invention. The evaporated fuel processing apparatus includes a fuel tank 10. Within the fuel tank 10, a tank pressure sensor 12 is provided, which detects a pressure within the fuel tank 10 as a relative pressure to the ambient pressure and generates an output signal corresponding to the detected tank pressure.

A vapor passage 18 is connected at one end thereof to the fuel tank 10 via a ROV (rollover valve) 14 and a ROV 16, and is connected at the other end to a canister 22 via a diaphragm-type fuel supply valve 20. The canister 22 is filled with active carbon for adsorbing or trapping fuel vapors. With this arrangement, fuel vapors generated in the fuel tank 10 move through the purge passage 18 and the fuel supply valve 20, and then reach the canister 22 so that the fuel vapors are trapped by and stored in the canister 22.

The canister 22 includes an ambient air inlet 24, and a purge passage 26 is connected to the canister 22. In the purge passage 26, a purge control valve 28 for controlling the quantity of gas passing through the passage 26 is provided. In operation, the purge control valve 28 is controlled at a suitable duty ratio to be opened by a desired angle.

The purge passage 26 is connected to an intake passage 32 of an internal combustion engine 30. An air cleaner 34 is provided at one end of the intake passage 32, and an airflow meter 36 for detecting an intake air quantity GA (mass flow rate) in the intake passage 32 is provided downstream of the air cleaner 34. Further, a throttle valve 38 for controlling the intake air quantity GA is provided downstream of the airflow meter 36. The throttle valve 38 includes a throttle sensor 40 that generates an output signal corresponding to the opening of the throttle valve 38. The purge passage 26 is connected to the intake passage 32 at its position downstream of the throttle valve 38.

The intake passage 32 is connected to an intake port of the internal combustion engine 30 via an intake manifold 42.

Also an injector 44 for injecting the fuel into the internal combustion engine 30 is disposed in the vicinity of the intake port. The internal combustion engine 30 includes a coolant temperature sensor 46 for detecting a coolant temperature THW. Further, an exhaust passage 48, which leads to a catalyst or the like (not shown in FIG. 1), is connected to the internal combustion engine 30. The exhaust passage 48 includes an oxygen concentration sensor 50, which generates an output signal corresponding to the oxygen concentration in the exhaust gas.

The evaporated fuel processing apparatus shown in FIG. 1 includes an ECU (Electronic Control Unit) 52. The ECU 52, as a control device of the evaporated fuel processing apparatus, receives output signals from the above-described sensors (including the tank pressure sensor 12 and the oxygen concentration sensor 50) and other sensors, and sends drive signals to the above-described actuators (including the purge control valve 28 and the injector 44) and other actuators or the like.

The evaporated fuel processing apparatus of this embodiment is characterized in that the quantity of purge air contained in the purge gas, which is purged from the canister 22 into the intake passage 32, is accurately detected without using a dedicated airflow meter, and in that a total purge air quantity is calculated by accumulating or summating the detected quantities of purge air. Prior to explanation of this feature of the apparatus, the basic processing or operation to be executed by the evaporated fuel processing apparatus of this embodiment will be hereinafter described.

Figure 2:
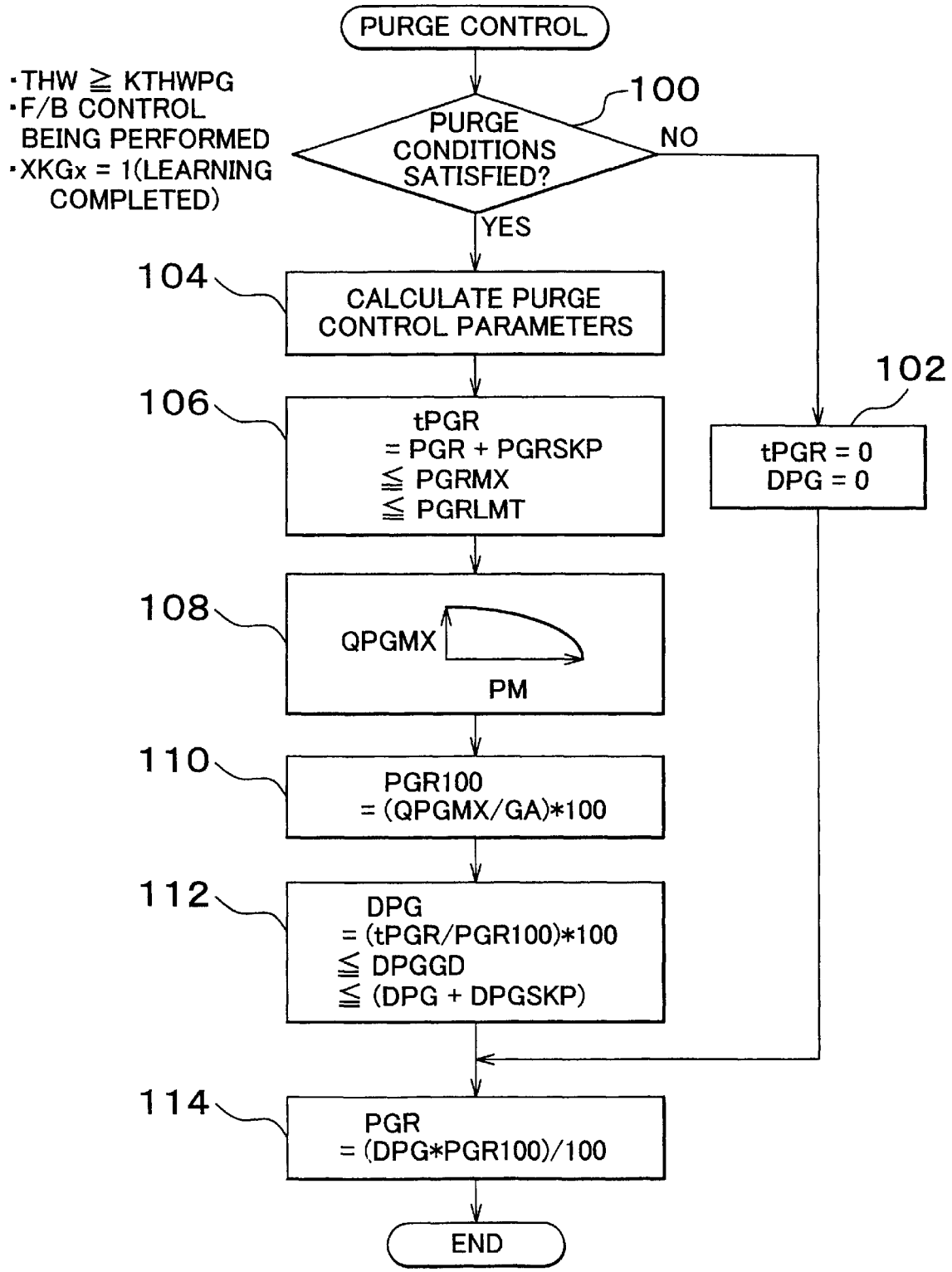
FIG. 2 is a flowchart showing a purge control routine executed in the evaporated fuel processing apparatus as shown in FIG. 1.

FIG. 2 is a flowchart showing flow of purge control performed by the evaporated fuel processing apparatus as a part of the basic operation. The routine shown in FIG. 2 is repeatedly executed at the same cycle as a duty cycle of driving the purge control valve 28.

In the routine shown in FIG. 2, it is first determined in step S100 whether purge conditions are satisfied. The following are examples of the purge conditions.

1. The coolant temperature THW is equal to or higher than a predetermined purge temperature KTHWPG.
2. An air-fuel ratio feedback control based on the detected value of the oxygen concentration sensor 50 is being performed.
3. An air-fuel ratio learning coefficient KG (which will be described later), which is a fuel injection amount correction coefficient for compensating for differences among individual internal combustion engines or chronological changes of the engines, has been learned.

If it is determined in step S100 that the purge conditions are not satisfied, a target purge rate tPGR is set to 0 and a drive duty ratio DPG for driving of the purge control valve 28 is set to 0 in step S102. The target purge rate tPGR is a target value of the purge rate PGR to be controlled. The purge rate PGR is defined as a ratio of the purge gas quantity QPG to the intake air quantity GA as represented by percentage: (QPG/GA)×100.

When step S102 is implemented, the purge control valve 28 is maintained in a closed position since the duty ratio DPG is 0. In this case, the flow of purge gas from the canister 22 to the intake passage 32 is cut off. After step S102 is implemented, the current purge rate PGR (0 in this case) is recorded in step S114 as described later, and thereafter the present routine is finished.

Conversely, if it is determined in step S100 that the purge conditions are satisfied, various parameters (hereinafter referred to as "control parameters") used for the purge control are calculated in step S104.

More specifically, parameters as indicated below are calculated in step S104.

(a) Purge rate increment PGRSKP: An amount of increase in the purge rate in the current routine from that in the previous (or last) routine.

(b) Maximum purge rate PGRMX: An upper limit value of the purge rate which is predetermined so as to prevent excessive deviation of the air-fuel ratio from its target value.

(c) Limit purge rate PGRLMT: An upper limit value of the purge rate, which is determined according to its relationship with the basic fuel injection amount.

(d) Maximum duty ratio DPGGD: An upper limit value of the duty ratio, which is determined according to its relationship with a permissible maximum value of the purge gas quantity.

(e) Limit duty ratio increment DPGSKP: An upper limit value of an amount of increase in the duty ratio, which is determined so as to prevent the air-fuel ratio from excessively deviating from its target value due to a rapid increase in the duty ratio.

After the control parameters are calculated, the target purge rate tPGR is calculated according to the following expression in step S106:

$$tPGR=PGR+PGRSKP$$

where $tPGR \leqq PGRMX$, and $$tPGR \leqq PGRLMT \quad (1)$$

In this step, the sum of the purge rate PGR calculated in the previous routine and the purge rate increment PGRSKP (a) is determined as the target purge rate tPGR, provided that the sum of PGR does not exceed both the maximum purge rate PGRMX (b) and the limit purge rate PGRLMT (c).

Next, in step S108, a full-valve-opening purge gas quantity QPGMX corresponding to the current intake pipe pressure PM, that is, a purge gas quantity obtained with the purge control valve 28 fully opened is calculated.

The ECU 52 stores a map shown in the block of step S108 in FIG. 2, which determines a relationship between the full-valve-opening purge gas quantity QPGMX and the intake pipe pressure PM. According to this map, the full-valve-opening purge gas quantity QPGMX is determined in step S108. The intake pipe pressure PM may be estimated based on the operating state of the internal combustion engine or actually measured by means of a PM sensor or the like.

In step S110, a maximum purge rate PGR100 that is a purge rate corresponding to the full-valve-opening purge gas quantity QPGMX is calculated according to the following expression:

$$PGR100=(QPGMX/GA)\times 100 \quad (2)$$

Next, in step S112, a drive duty ratio DPG for driving the purge control valve 28 is calculated according to the following expression:

$$DPG=(tPGR/PGR100)\times 100$$

where:

$$DPG \leqq DPGGD, \text{ and}$$

$$DPG \leqq DPG+DPGSKP \quad (3)$$

In step S112, the ratio of the target purge rate tPGR to the maximum purge rate PGR100 is determined as the duty ratio DPG, provided that the duty ratio DPG calculated as described above is equal to or smaller than the maximum duty ratio DPGGD (d) and an amount of increase in the duty ratio from that obtained in the previous routine is equal to or smaller than the limit duty ratio increment DPGSKP (e).

Next, in step S114, the purge rate PGR for the current routine, that is, the purge rate PGR corresponding to the duty ratio DPG determined as described above is calculated according to the following expression:

$$PGR=(DPG\times PGR100)/100 \quad (4)$$

As described above, in the purge control routine shown in FIG. 2, purging of fuel vapors is prohibited if the purge conditions are not satisfied. Conversely, if the purge control conditions are satisfied, the fuel vapors are purged from the canister 22 into the intake passage 32 such that the purge rate is controlled to within a range that does not cause excessive deviation of the air-fuel ratio from its target value.

Hereinafter, learning control as a part of the basic operation performed by the evaporated fuel processing apparatus of the present embodiment will be described with reference to FIG. 3.

In the embodiment, when predetermined conditions are satisfied, the ECU 52 performs air-fuel ratio feedback control for achieving a desired air-fuel ratio, based on an output signal from the oxygen concentration sensor 50. More specifically, the following operations are carried out in the air-fuel ratio control.

Determination of Air-Fuel Ratio of Air-Fuel Mixture:

The oxygen concentration sensor 50 generates an output signal corresponding to an oxygen concentration in exhaust gas. The oxygen concentration in the exhaust gas corresponds to an air-fuel ratio of an air-fuel mixture supplied to the engine. During the air-fuel ratio feedback control, the ECU 52 determines whether the air-fuel ratio of the air-fuel mixture supplied to the internal combustion engine is rich or lean, according to the output signal from the oxygen concentration sensor 50.

Updating of Air-Fuel Ratio Correction Coefficient FAF:

In the air-fuel ratio feedback control, a fuel injection duration TAU is corrected using an air-fuel ratio correction coefficient FAF. For calculation of the fuel injection duration TAU as described later, the basic fuel injection duration is multiplied by the air-fuel ratio correction coefficient FAF. In the air-fuel ratio feedback control, if the air-fuel ratio of the air-fuel mixture is determined as rich, FAF is updated to decrease by small steps. As a result, the fuel injection duration TAU gradually decreases so that the air-fuel ratio shifts from the rich side to the lean side after a while.

Once the air-fuel ratio shifts from the rich side to the lean side in the above-described manner, the air-fuel ratio correction coefficient FAF is skipped or increased by a large step. Thereafter, the air-fuel correction coefficient FAF continues to be increased by small steps until the air-fuel ratio becomes rich. As a result, the fuel injection duration TAU gradually increases until the air-fuel ratio shifts from the lean side to the rich side. Once the air-fuel ratio shifts from the lean side to the rich side in the above-described manner, the air-fuel ratio correction coefficient FAF is skipped or reduced by a large step. By repeatedly executing these updating processes, the air-fuel ratio of the air-fuel mixture is kept close to a desired air-fuel ratio.

Learning of Air-Fuel Ratio Learning Coefficient KG:

For accurately keeping the air-fuel ratio of the air-fuel mixture close to the desired air-fuel ratio, the air-fuel ratio correction coefficient FAF is desirably varied (increased or decreased) to be centered around a basic value (e.g. 1 or 0). This situation can be accomplished if the basic fuel injection duration substantially corresponds to the desired air-fuel ratio. However, because of differences among individual internal combustion engines and chronological changes thereof, for example, a certain degree of disagreement or deviation may exist between the basic fuel injection duration and the desired air-fuel ratio.

Accordingly, in the air-fuel ratio feedback control, the fuel injection duration TAU is corrected using an air-fuel ratio learning coefficient KG for compensating for, for example, the individual difference and chronological changes of the engine. For calculation of the fuel injection duration TAU, the basic fuel injection duration is multiplied by the air-fuel ratio learning coefficient KG, as well as FAF. As described later, the air-fuel ratio learning coefficient KG is updated so that a smoothed value FAFAV of FAF becomes close to the basic value of FAF. By using the air-fuel ratio learning coefficient KG as described above, the air-fuel ratio correction coefficient FAF can be increased or decreased around the basic value thereof, regardless of the individual differences and chronological changes of the internal combustion engines, and the like.

Learning of Vapor Concentration Learning Coefficient FGPG

When fuel vapors are purged from the canister 22 into the intake passage 32, the air-fuel ratio of the air-fuel mixture changes due to the purged fuel vapors. Accordingly, when the purge control starts, the center of the air-fuel ratio correction coefficient FAF starts shifting from the basic value towards the rich side. In the air-fuel ratio feedback control, therefore, the fuel injection amount is corrected using a vapor concentration learning coefficient FGPG, thereby preventing shift of FAF to the rich side. During the purge control, the vapor concentration learning coefficient FGPG is updated so as to bring the smoothed value FAFAV of FAF close to the basic value of FAF. By using the vapor concentration learning coefficient FGPG as described above, the air-fuel ratio correction coefficient FAF can be increased or decreased around the basic value thereof even while the purge control is being performed.

Figure 3:
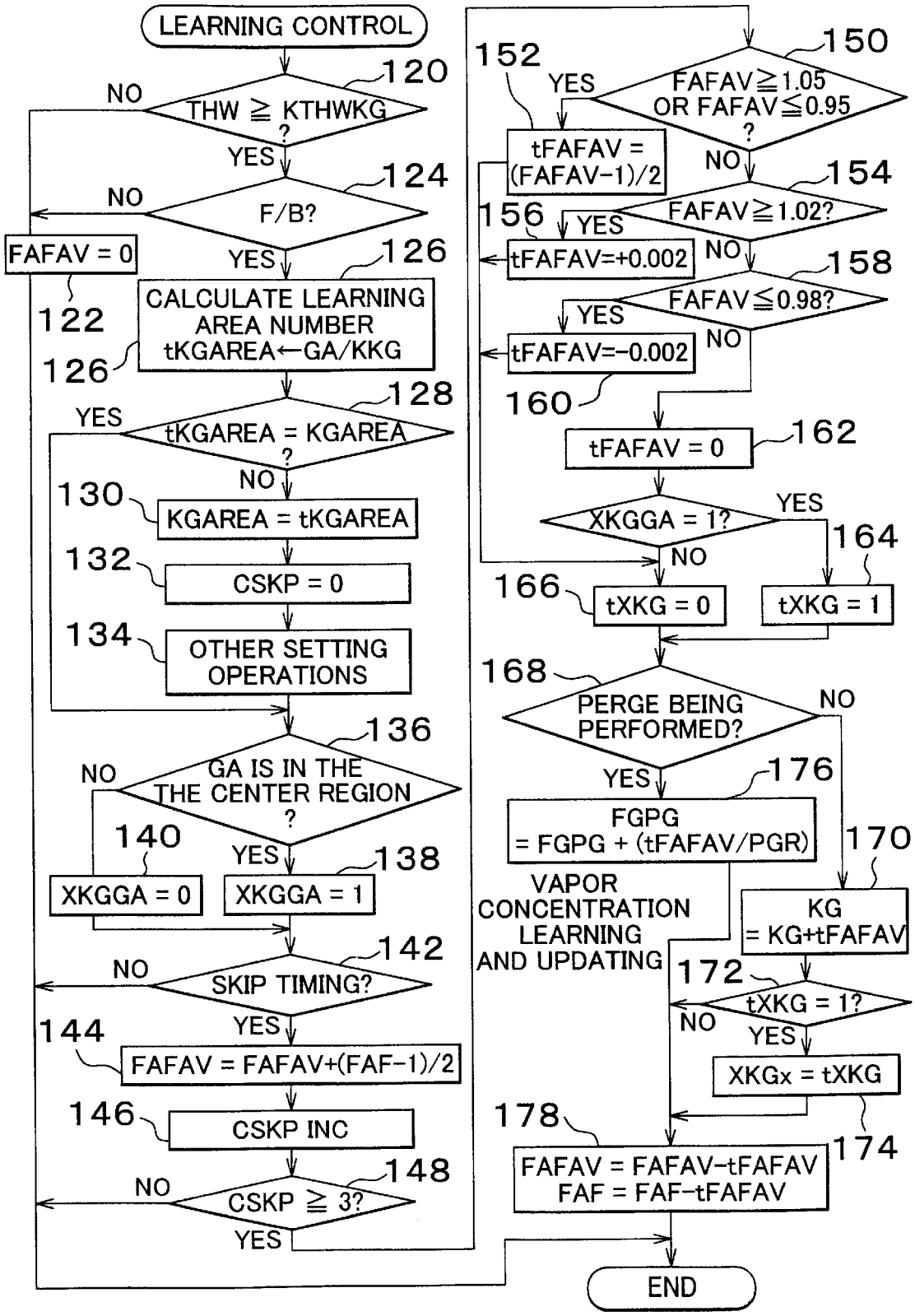
FIG. 3 is a flowchart showing a learning control routine executed in the evaporated fuel processing apparatus as shown in FIG. 1.

FIG. 3 is a flowchart showing a learning control routine to be executed by the ECU 52 for learning the air-fuel ratio learning coefficient KG and the vapor concentration learning coefficient FGPG.

In the routine shown in FIG. 3, it is first determined in step S120 whether a coolant temperature THW of the internal combustion engine 30 is equal to or higher than a predetermined learning-start temperature KTHWKG (e.g. 70° C.).

If it is determined in step S120 that "THW≧KTHWKG" is not true, namely, if the coolant temperature THW is lower than the predetermined value KTHWKG, the smoothed value FAFAV of FAF is set to 0 and then the present routine is immediately finished in step S122.

Conversely, if it is determined in step S120 that "THW≧KTHWKG" is true, it is next determined in step S124 whether the air-fuel ratio feedback control is being performed.

If it is determined in step S124 that the air-fuel ratio feedback control is not being performed, step S122 is executed and then the present routine is finished as in the case where the coolant temperature THW has not yet reached the learning-start temperature KTHWKG. Conversely, if it is determined that the air-fuel ratio feedback control is being performed, a learning area number tKGAREA corresponding to the current operation state of the engine is calculated in step S126.

In the present embodiment, the air-fuel ratio learning coefficient KG is determined for each of a plurality of learning areas (e.g., four areas) established based on the intake air quantity GA. The expression "tKGAREA←GA/KKG" shown in the block of step S126 in FIG. 3 means that the current intake air quantity GA is divided by a predetermined constant KKG, and an integer part of the quotient is determined as a learning area number tKGAREA. The constant KKG is determined such that the learning area number tKGAREA changes from 1 to the value of the number of the learning areas (e.g., 4) in the ascending order as the intake air quantity GA changes from the minimum value 0 to the maximum value. In this way, the learning area number tKGAREA of the learning area, which is selected from the plurality of learning areas as described above based on the current intake air quantity GA, is determined in step S126.

Next, it is determined in step S128 whether the learning area number tKGAREA obtained in step S126 coincides with the currently established learning area number KGAREA used in the previous routine.

If step S128 determines that "tKGAREA=KGAREA" is true, it is judged that the learning area has not changed. In this case, step S128 is followed by step S136 as described later.

Conversely, if step S128 determines that tKGAREA is not equal to KGAREA, it is judged that the learning area has changed. In this case, the learning area number tKGAREA obtained in step 126 is determined as a learning area number KGAREA for the current routine in step S130. Then, a skip counter CSKP is reset to 0 in step S132. Subsequently, other setting operations are performed in step S134, and step S136 is then executed.

The above-described skip counter CSKP counts the number of times the air-fuel ratio correction coefficient FAF skips or changes by a large step while the same learning area is maintained, namely, the number of time the air-fuel ratio of the air-fuel mixture shifts from the rich side to the lean side or from the lean side to the rich side while the intake air quantity GA remains in the same learning area. As described above, the skip counter CSKP is reset to 0 in step S132 each time the learning area changes.

If it is determined in step S128 that "tKGAREA=KGAREA" is true, or when step S134 is implemented, it is then determined in step S136 whether the current intake air quantity GA falls in the center region of the learning area determined in step S126, more specifically, whether the current intake air quantity GA is within the center third region of the learning area.

If it is determined that the intake air quantity GA is within the center third region of the learning area, a center judgment flag XKGGA is set to "1" in step S138.

Conversely, if it is determined that the intake air quantity GA is not within the center third region of the learning area, the center judgment flag XKGGA is set to "0" in step S140.

Next, it is determined in step S142 whether the air-fuel ratio correction coefficient FAF skips, i.e., increases or decreases by a large step, while the current cycle of the control routine is executed.

If it is determined that the FAF does not skip during the current cycle of the routine, the routine is finished without implementing any further process. Conversely, if it is determined that the FAF skips during the current cycle of the routine, the smoothed value FAFAV is updated according to the following expression in step S144:

$$FAFAV=FAFAV+(FAF-1)/2 \quad (5)$$

In the expression (5), "FAFAV" in the left side is an updated value and "FAFAV" in the right side is a value before updating. "FAF" in the right side is a value after skipping, namely, after it is increased or decreased by a large step. The expression (5) is used for updating FAFAV when the basic value of FAF is equal to 1.

When updating of FAFAV is completed, the skip counter CSKP is incremented in step S146, and it is determined in step S148 whether the count value of the skip counter is greater than 3.

If a negative decision (NO) is obtained in step S148, namely, if it is determined that CSKP is equal to or smaller than 3, the current routine is finished without continuing the learning process. Conversely, if an affirmative decision (YES) is obtained in step S148, namely, if CSKP is greater than 3, it is judged that the air-fuel ratio correction coefficient FAF has skipped (i.e., changed by a large step) in the same learning area at least 4 times or more. In this case, there is possibility that the value of FAF or FAFAV reflects a change that has not been incorporated in the learning coefficient KG or the vapor concentration learning coefficient FGPG, and therefore the learning process is implemented in the manner as described below.

When it is determined in step S148 that "CSKP>3" is true, it is first determined whether the deviation of the smoothed value FAFAV of the air-fuel ratio correction value FAF from the basic value 1.0 is equal to or greater than 5% in step S150 by determining whether either of the following relationships is true:

$$FAFAV \geqq 1.05 \text{ or } FAFAV \leqq 0.95 \quad (6)$$

If it is determined that either of the above relationships (6) is true, an updating value tFAFAV is calculated according to the following expression in step S152:

$$tFAFAV=(FAFAV-1)/2 \quad (7)$$

Conversely, if it is determined that neither of the above expressions is true, it is further determined whether the following relationship is true in step S154:

$$FAFAV \geqq 1.02 \quad (8)$$

If it is determined in step S154 that the above relationship is true, the updating value tFAFAV is determined to be equal to +0.002 in step S156:

$$tFAFAV=+0.002 \quad (9)$$

Conversely, if it is determined in step S154 that the relationship (8) is not true, it is further determined in step S158 whether the following relationship is true:

$$FAFAV \leqq 0.98 \quad (10)$$

If step S158 determines that the above relationship (10) is true, the updating value tFAFAV is determined to be equal to −0.002 in step S160:

$$tFAFAV=-0.002 \quad (11)$$

Conversely, if step S158 determines that the relationship (10) is not true, it is judged that no change that requires updating of the air-fuel ratio learning coefficient KG or the vapor concentration learning coefficient FGPG appears in the smoothed value FAFAV. In this case, the updating value tFAFAV is set to 0 in step S162. Thereafter, it is determined in step S163 whether the center judgment flag XKGGA is "1".

If step S163 determines that "XKGGA=1" is true, it is judged that the routine is being executed with respect to the center region of the currently selected learning area. In this case, a temporary learning completion flag tXKG is set to "1" in step S164, which indicates that learning of the air-fuel ratio learning value KG has been completed with respect to the learning area that is determined in step S126 in the current routine.

Conversely, if step S163 determines that "XKGGA=1" is not true, it is judged that the routine is being executed with respect to one of side regions of the currently selected learning area. In this case, the temporary learning completion flag tXKG is set to "0" in step S166, which indicates that learning of the air-fuel ratio learning value KG has not been completed with respect to the selected learning area.

Next, it is determined in step S168 whether purge control is being performed in the evaporated fuel processing apparatus.

If it is determined that the purge control is not being performed, the air-fuel ratio coefficient KG is updated according to the following expression, using the updating value tFAFAV obtained in the current routine:

$$KG=KG+tFAFAV \tag{12}$$

Upon completion of updating of KG, it is then determined in step S172 whether the temporary learning completion flag tXKG is "1".

If it is determined in step 172 that "tXKG=1" is true, a learning completion flag XKGx corresponding to the learning area determined in step S126 in the current routine is set to the same value as that of the temporary learning completion flag tXKG, which is 1 in this case, in step S174. The subscript "x" to "XKGx" means the number of the current learning area.

Conversely, if it is determined in step S172 that "tXKG=1" is not true, step S174 is skipped and step S178 is executed as described later.

As described above with reference to FIG. 2, the purge control is performed after learning of the air-fuel ratio learning coefficient KG is completed (refer to step S100). Therefore, when it is determined in step S168 that the purge control is being performed, it is judged that learning of the air-fuel ratio learning coefficient KG with respect to the currently selected learning area has been completed. In this case, the updating value tFAFAV is used for updating the vapor concentration correction coefficient FGPG according to the following expression:

$$FGPG=FGPG+(tFAFAV/PGR) \tag{13}$$

In the expression (13), "FGPG" in the left side represents an updated value of the vapor concentration correction coefficient FGPG, and "FGPG" in the right side represents a value before before it is updated. "tFAFAV/PGR" in the right side provides a value of tFAFAV per 1% of the purge rate PGR. In this way, the rate of correction of the fuel injection duration per 1% of the purge rate PGR is calculated as the vapor concentration correction coefficient FGPG.

After step S174 or step S176 are implemented, the updating value of tFAFAV is subtracted from each of the smoothed value FAFAV and the air-fuel ratio correction coefficient FAF, and then the current routine is finished.

According to the learning control routine as described above, a part of accumulated deviation of the smoothed value FAFAV is shifted, in the form of the updating value tFAFAV, from FAFAV to the air-fuel ratio learning coefficient KG or the vapor concentration learning coefficient FGPG. With the learning control routine as described above, therefore, it is possible to update the air-fuel ratio learning coefficient KG and the vapor concentration learning coefficient FGPG such that the air-fuel ratio correction coefficient FAF varies with respect to the basic value (1 in this case) as a center of variations.

Next, a TAU calculating operation to be performed as a part of the basic operation of the evaporated fuel processing apparatus according to the present embodiment will be hereinafter described with reference to FIG. 4.

Figure 4:
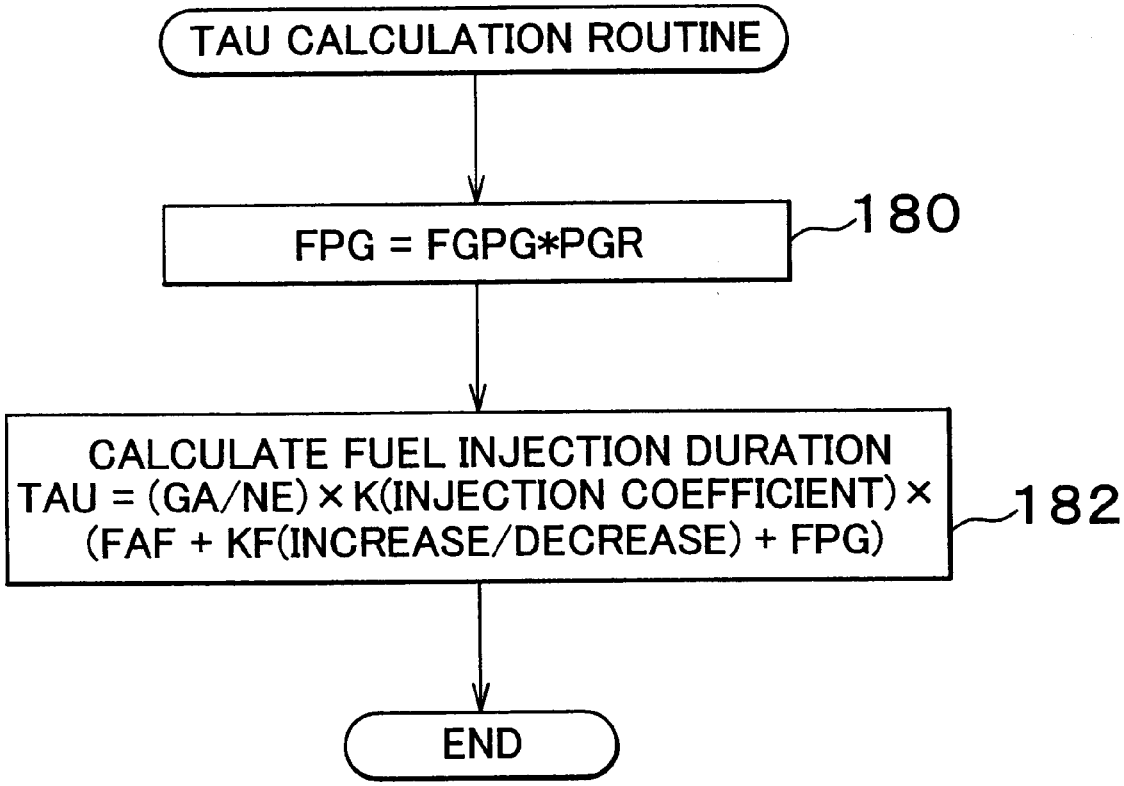
FIG. 4 is a flowchart showing a fuel injection duration calculation routine executed in the evaporated fuel processing apparatus as shown in FIG. 1.

FIG. 4 is a flowchart showing the flow of a TAU calculation routine to be executed by the ECU 52.

In this routine, a purge correction coefficient FPG is first calculated by the following expression in step S180:

$$FPG=FGPG\times PGR \tag{14}$$

As described above, the vapor concentration correction coefficient FGPG represents the rate of correction per 1% of the purge rate. In the expression (14), therefore, a correction amount to be applied to the current purge rate PGR is calculated as the purge correction coefficient FPG.

Next, the fuel injection duration TAU is calculated by the following expression in step S182:

$$TAU=(GA/NE)\times K\times(FAF+KF+FPG) \tag{15}$$

In the expression (15), "NE" represents an engine speed, "K" represents an injection coefficient, and "KF" represents an amount of increase or decrease of each parameter. The above-described air-fuel ratio learning coefficient KG is included the KF.

In the expression (15), the intake air quantity GA is divided by the engine speed NE and is multiplied by the injection coefficient K to provide a basic fuel injection duration. Then, the obtained basic fuel injection duration is corrected using the air-fuel ratio correction coefficient FAF and the purge correction coefficient FGPG so as to provide a fuel injection duration TAU for achieving a desired air-fuel ratio with high accuracy.

Figure 5:
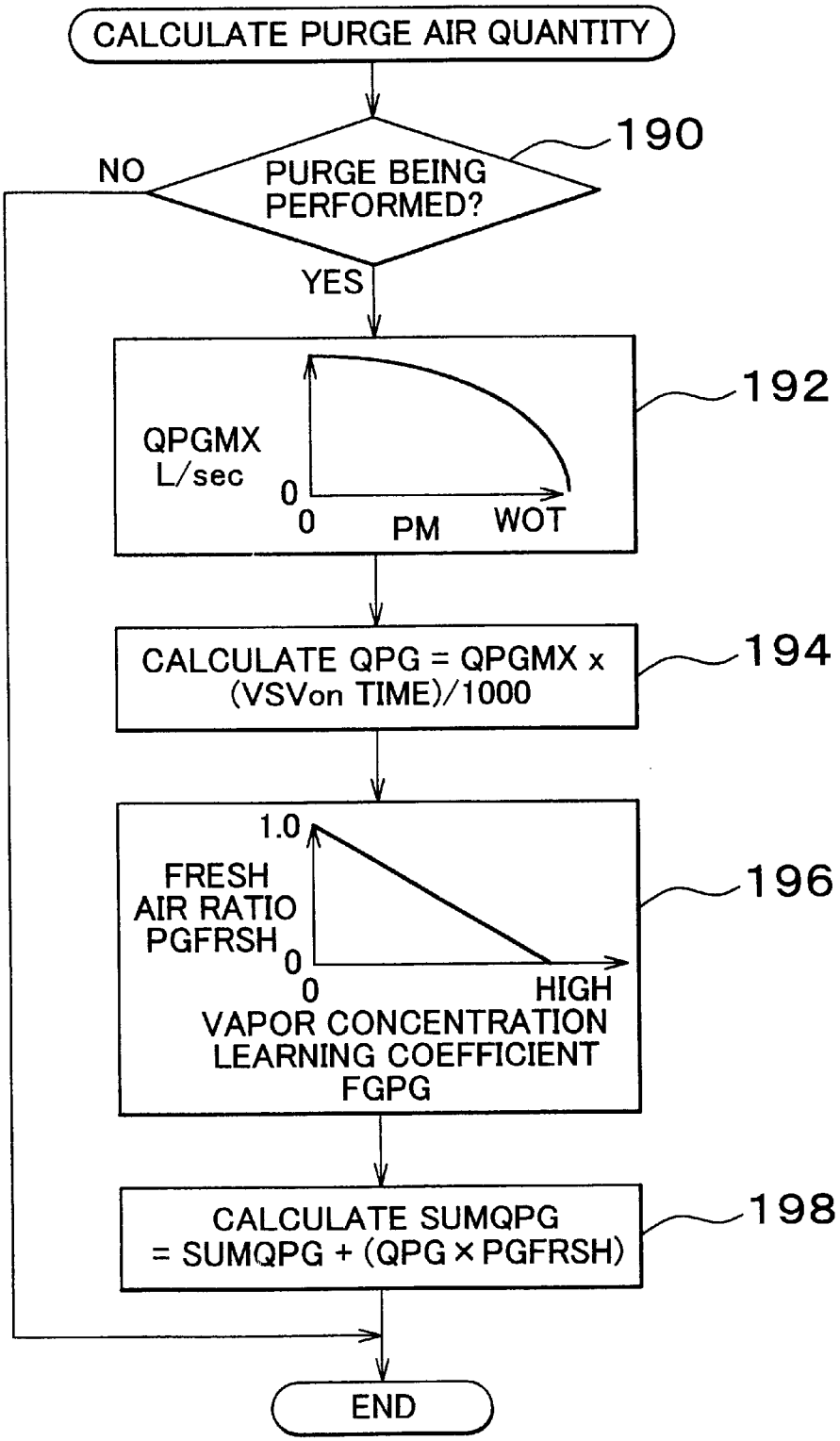
FIG. 5 is a flowchart showing a purge air quantity calculation routine executed according to the first embodiment of the invention.

Referring next to FIG. 5, the feature of the evaporated fuel processing apparatus according to the present embodiment of the invention will be described. More specifically, how the evaporated fuel processing apparatus calculates the purge air quantity without using a dedicated airflow meter, and how the apparatus further determines its total value (i.e., total purge air quantity) will be described.

FIG. 5 is a flowchart showing the flow of a purge air quantity calculation routine executed by the ECU 52 to realize the above-described functions of the evaporated fuel processing apparatus.

In this routine, it is first determined in step S190 whether the evaporated fuel processing apparatus is performing the purge control.

If it is determined in step S190 that the purge control is not being performed, the present routine is finished at once since the calculation of the purge air quantity is unnecessary. Conversely, if it is determined that the purge control is being performed, the full-valve-opening purge gas quantity QPGMX corresponding to the present intake pipe pressure PM is determined in step S192 in the same manner as in step S108.

Next, the purge gas quantity QPG is calculated according to the following expression in step S194:

$$QPG=QPGMX\times(VSV\text{-on time})/1000 \tag{16}$$

In the expression (16), "VSV-on time" in the right side represents an ON (open) time of the purge control valve 18 per duty cycle. The VSV-on time may be expressed as follows, using the duty ratio DPG (%) for driving the purge control valve 28 and the duty cycle Duty (msec):

$$VSV\text{-on time } (msec)=(DPG/100)\times\text{Duty} \quad (17)$$

In the expression (16), the unit for both QPG and QPGMX is "L", and the unit for VSV-on time is "msec". "1000" in the left side of the expression (16) is a conversion factor for coordinating the unit for QPG and QPMX with the unit for VSV-on time.

Next, the ratio of the purge air contained in the purge gas to the purge gas is determined as a fresh air ratio PGFRSH in step S196.

The fresh air ratio PGFRSH increases as the vapor quantity in the purge gas decreases, and decreases as the vapor quantity increases. That is, the fresh air ratio PGFRSH is a physical quantity that is correlated with the vapor concentration in the purge gas.

As described above, the vapor concentration learning coefficient FGPG, which is used in the air-fuel ratio feedback control, represents the rate of correction of the fuel injection duration per 1% of the purge rate. The correction rate becomes higher as the vapor concentration in the purge gas becomes higher, and becomes lower as the vapor concentration in the purge gas becomes lower. Thus, the correction rate, that is, the vapor concentration learning coefficient FGPG, has a correlation with the vapor concentration in the purge gas, and further with the fresh air ratio PGFRSH.

In the embodiment, the ECU 52 stores a map that represents a relationship between the vapor concentration learning coefficient FGPG and the fresh air ratio PGFRSH, as shown in the block of step S196 in FIG. 5. Referring to this map, the fresh air ratio PGFRSH corresponding to the vapor concentration learning coefficient FGPG determined in the routine shown in FIG. 3 is obtained in step S196. In this way, the fresh air ratio PGFRSH is accurately determined in a simple manner without using a dedicated airflow meter, or the like.

Next, a total purge air quantity SUMQPG is calculated according to the following expression in step S198:

$$SUMQPG=SUMQPG+(QPG\times PGFRSH) \quad (18)$$

In the expression (18), "QPG×PGFRSH" in the right side represents the purge air quantity (L) determined in this routine. "SUMQPG" in the left side represents the updated total purge air quantity, and "SUMQPG" in the right side represents the total purge air quantity before it is updated.

As described above, in the purge air quantity calculation routine shown in FIG. 5, the fresh air ratio PGFRSH is determined according to the vapor concentration learning coefficient FGPG, and the purge air quantity and total purge air quantity SUMQPG are calculated using the determined fresh air ratio PGFRSH. Accordingly, with the evaporated fuel processing apparatus of the present embodiment, it is possible to easily calculate the purge air quantity and the total purge air quantity with high accuracy, without using a dedicated airflow meter.

The purge air quantity determined as described above may be utilized in various ways. For example, it is possible to correct the fuel injection amount based on the purge air quantity. Thus, by using the purge air quantity, the ECU 52 can control the internal combustion engine 30 (e.g., air-fuel ratio control) with enhanced accuracy. Further, the total purge air quantity SUMQPG may be used as, for example, an alternative characteristic value representing the amount of fuel vapors that have been purged from the canister 22. By using the total purge air quantity, the ECU 52 can perform appropriate purge control depending upon an adsorption or storage state of the fuel vapors in the canister 22. Thus, the evaporated fuel processing apparatus according to this embodiment of the invention is able to accomplish more advanced control of internal combustion engine by utilizing the purge air quantity and the total purge air quantity.

Second Embodiment

Next, a second embodiment of the invention will be described with reference to FIG. 6. In the embodiment, the ECU 52 of the evaporated fuel processing apparatus shown in FIG. 1 executes a purge air quantity calculation routine shown in FIG. 6, instead of that shown in FIG. 5. In the routine shown in FIG. 6, the purge gas quantity QPG and the fresh air ratio are calculated as explained below in a different manner from that in the first embodiment.

Figure 6:
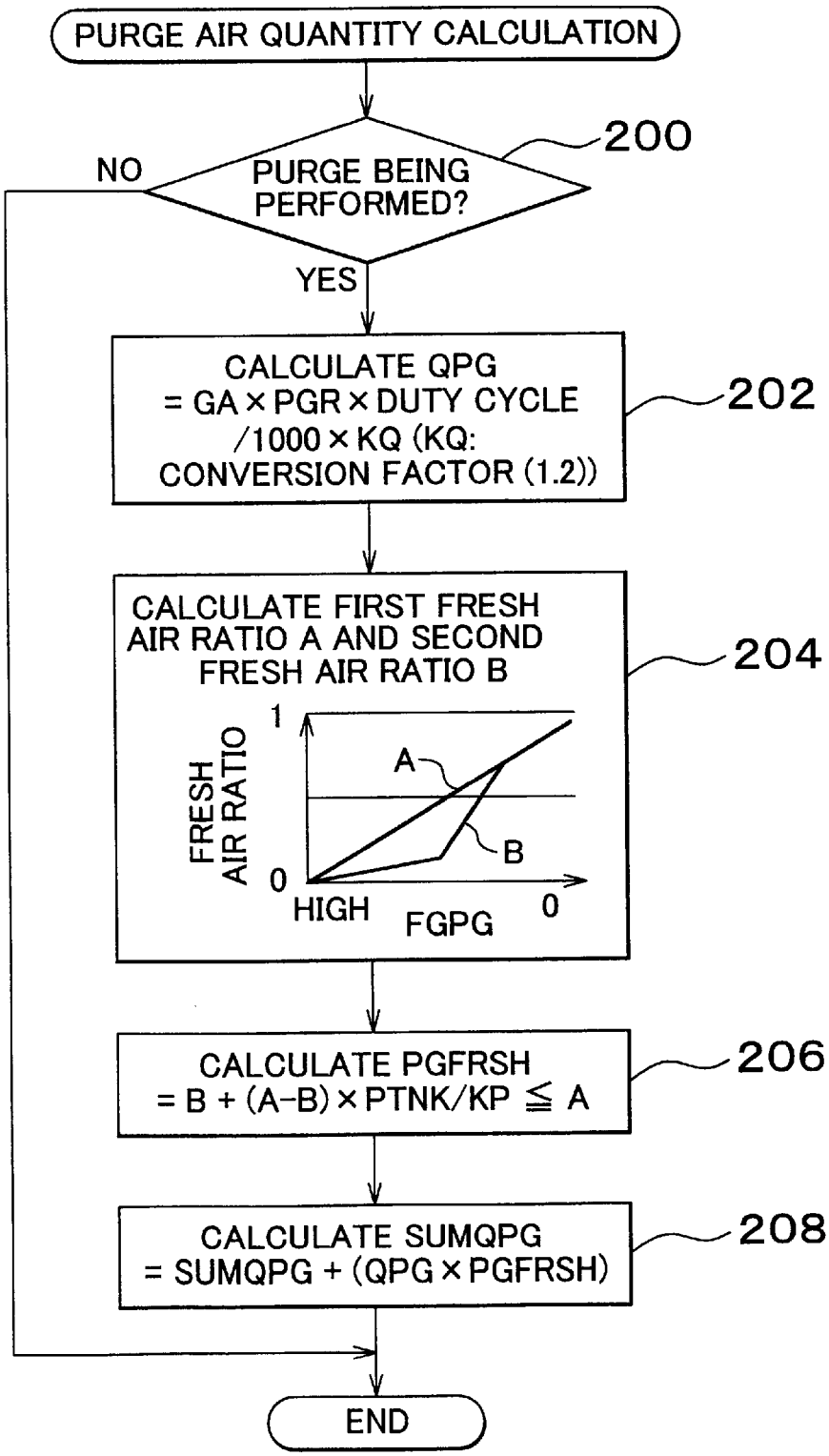
FIG. 6 is a flowchart showing a purge air quantity calculation routine executed according to a second embodiment of the invention.

FIG. 6 is a flowchart showing a purge air quantity calculation routine to be executed by the ECU 52 in the second embodiment. In this routine, it is first determined in step S200 whether the purge control is being performed in the evaporated fuel processing apparatus.

If it is determined that the purge control is not being performed, the present routine is finished at once. Conversely, if it is determined that the purge control is being performed, the purge gas quantity QPG is calculated according to the following expression in step S202:

$$QPG=GA\times PGR\times\text{Duty}/1000\times KQ \quad (19)$$

In the expression (19), the units for "QPG", "GA", and "Duty" are "L/sec", "g/sec", and "msec", respectively. "1000" and "KQ" in the right side are conversion factors for coordinating the units in the right side with those in the left side.

In the routine as shown in FIG. 6, a first fresh air ratio A and a second fresh air ratio B are calculated in step S204.

The ECU 52 stores maps that represent relationships of the first fresh air ratio A and the second fresh air ratio B with the vapor concentration learning coefficient FGPG, respectively, as shown in the block of step S204. The map of the first fresh air ratio A is experimentally determined for the case where a large quantity of fuel vapors are generated in the fuel tank 10 and are purged in a large amount through the canister 22. In this case, since the fuel contained in the purge gas is almost completely vaporized, the fresh air ratio A changes substantially in proportion to FGPG. On the other hand, the map of the second fresh air ratio B is experimentally determined for the case where most of the fuel contained in the purge gas consists of a fuel released and purged from the canister 22. In this case, the purge gas is likely to contain some quantity of fuel in a liquid state, which increases as the vapor concentration increases. Therefore, the second fresh air ratio B is likely to be at a lower value as compared to the first fresh air ratio A, in a region where FGPG shows a relatively high vapor concentration.

In step S204, with reference to these maps stored in the ECU 52, the first fresh air ratio A and the second fresh air ratio B are calculated which correspond to the FGPG calculated in the routine of FIG. 3 as described above.

Next, in step S206, the fresh air ratio PGFRSH is calculated by using the first fresh air ratio A and the second fresh air ratio B calculated as described above, in the following expression (20). In the following expression, "PTNK" is a tank pressure detected by the tank pressure sensor 12, and "KP" is a conversion factor:

$$PGFRSH=B+(A-B)PTNK/KP$$

$$\text{where } PGFRSH\leqq A \quad (20)$$

In the above expression (20), PGFRSH becomes closer to the second fresh air ratio B than to the first fresh air ratio A as the tank pressure PTNK decreases, and becomes closer to the first fresh air ratio A than to the second fresh air ratio B as the tank pressure PTNK increases. Namely, the fresh air ratio PGRSH becomes closer to the second fresh air ratio B as the quantity of fuel vapors generated in the fuel tank 10 decreases, and becomes closer to the first fresh air ratio A as the quantity of fuel vapors generated in the fuel tank 10 increases. Accordingly, in step S206, the fresh air ratio PGFRSH is appropriately determined according to the condition of vapor generation (e.g., quantity of fuel vapors generated) within the fuel tank 10.

Once the purge gas quantity QPG and the fresh air ratio PGFRSH are calculated in the above-described process, the total purge air quantity SUMQPG is then calculated in step S208 in the same manner as in step S198 of the first embodiment.

In the purge air quantity calculation routine as shown in FIG. 6, the fresh air ratio PGFRSH is calculated depending upon the condition of vapor generation in the fuel tank 10 so that the obtained PGFRESH more accurately represents the ratio of purge air contained in the purge gas. By using the thus obtained fresh air ratio PGFRSH, the ECU 52 is able to accurately calculate the purge air quantity and the total purge air quantity SUMQPG.

While the purge gas quantity QPG is determined by the above-indicated expression (19) in the second embodiment, the purge gas quantity QPG may be determined by the expression (16) in step S194 of FIG. 5 in the same manner as in the first embodiment.

Third Embodiment

Figure 7:
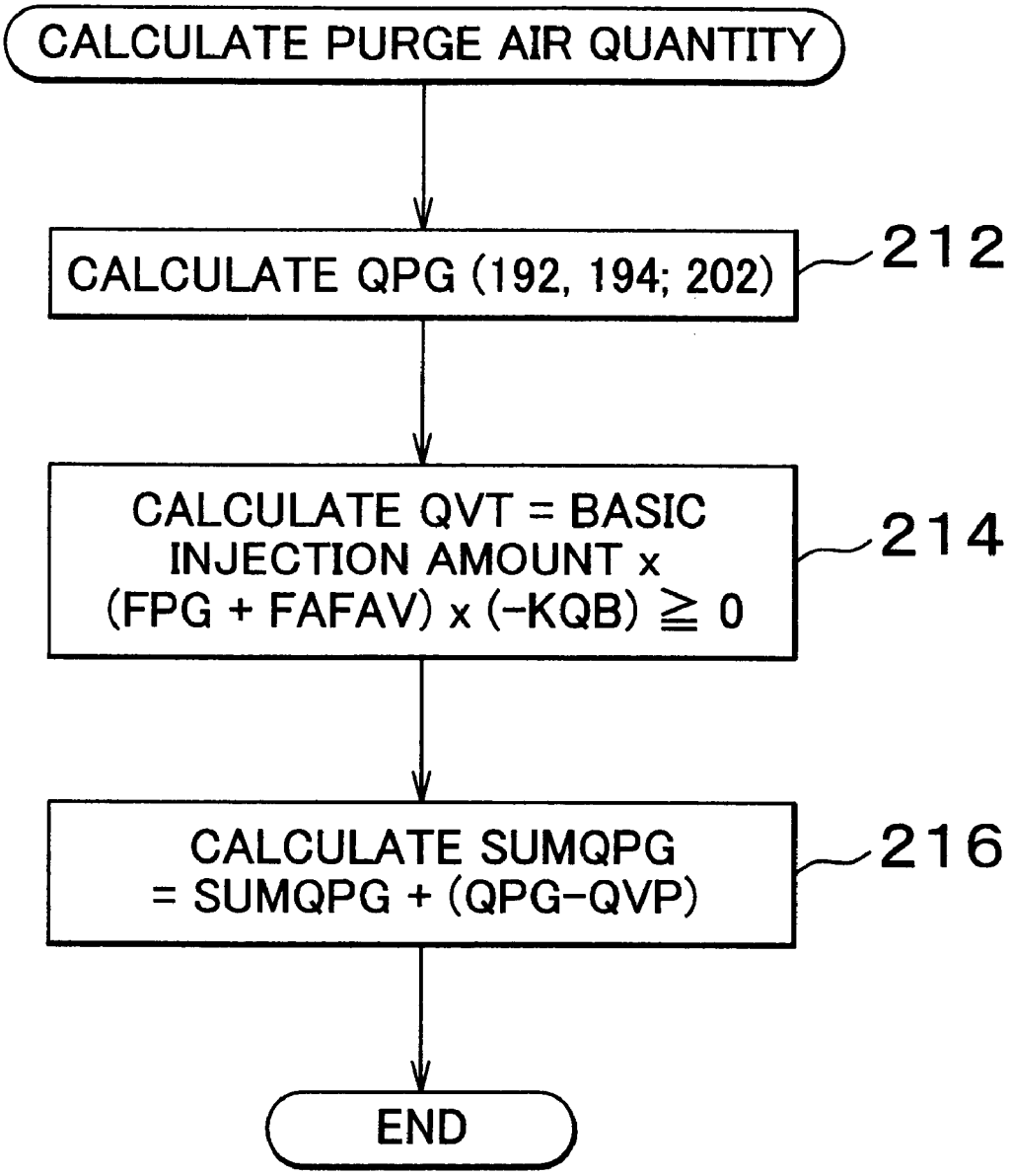
FIG. 7 is a flowchart showing a purge air quantity calculation routine executed according to a third embodiment of the invention.

Next, a third embodiment of the invention will be described with reference to FIG. 7. The ECU 52 of the evaporated fuel processing apparatus shown in FIG. 1 executes a purge air quantity calculation routine as shown in FIG. 7, instead of that as shown in FIG. 5. In the routine shown in FIG. 7, the purge gas quantity and the total purge air quantity SUMQPG are calculated in different manners from those in the first embodiment.

In the routine as shown in FIG. 7, the purge gas quantity QPG is first calculated in step S212 in the same manner as in steps S192 and S194 of the first embodiment or in step S202 of the second embodiment.

Once the purge gas quantity QPG is calculated, a vapor quantity QVP, which is a quantity of fuel vapors contained in the purge gas, is next calculated according to the following expression in step S214:

$$QVP = \text{basic fuel injection amount} \times (FPG + FAFAV) \times (-KQB) \geqq 0 \quad (21)$$

In the above expression (21), "basic fuel injection amount×(FPG+FAFAV)" in the right side is equivalent to the amount of correction made with respect to the fuel injection amount during purge of fuel vapors. More specifically, the value of "basic fuel injection amount×(FPG+FAFAV)" corresponds to the quantity of the fuel vapors that are being purged into the internal combustion engine. In the expression (21), the unit for "QVP" in the left side is "L/sec", and the unit for the quantity of the fuel vapors determined in the right side is "cc" like the basic fuel injection amount. Thus, "KQB" in the left side is a conversion factor for coordinating the unit in the right side with that in the left side:

$$KQB = QINJ\ (\text{injector capacity (cc/sec)}) \times \text{injection frequency}\ (NE/60 \times \text{Duty (sec)}) \times \text{specific gravity}\ (0.745) \times \text{volume factor per mol (22.4 L/weight of 1 mol)} \quad (22)$$

$$c.f.:\ 1 \text{ mol of butane weighs } 58 \text{ g}$$

In the above expression (21), a negative sign (−) is attached to KQB so that the vapor quantity QVP assumes a positive value when the purge correction coefficient FPG is a negative value. Also, the vapor quantity QVP is limited to be equal to or greater than 0 (QVP≧0) so as to prevent the purge air quantity from exceeding the purge gas quantity QPG on calculation.

In step S214, the vapor quantity QVP contained in the purge gas, that is, the amount of fuel vapors supplied to the internal combustion engine 30, is accurately calculated on the basis of the basic fuel injection amount, purge correction coefficient FPG, and the like.

Once the vapor quantity QVP is calculated as described above, the purge air quantity is then calculated by subtracting the calculated vapor quantity QVP from the purge gas quantity QPG. Then, the total purge air quantity SUMQPG is calculated by summating the purge air quantity according to the following expression (23):

$$SUMQPG = SUMQPG + (QPG - QVP) \quad (23)$$

As described above, in the purge air quantity calculation routine as shown in FIG. 7, the purge air quantity is calculated by subtracting the vapor quantity QVP from the purge gas quantity QPG, and the total purge air quantity SUMQPG is calculated by adding the currently obtained purge air quantity to the total purge air quantity SUMQPG obtained in the last cycle. With the evaporated fuel processing apparatus of the third embodiment, therefore, the purge air quantity and the total purge air quantity SUMQPG are calculated in a different manner from those of the first and second embodiments, without using a dedicated airflow meter.

Fourth Embodiment

Next, a fourth embodiment of the invention will be described with reference to FIG. 8.

Figure 8:
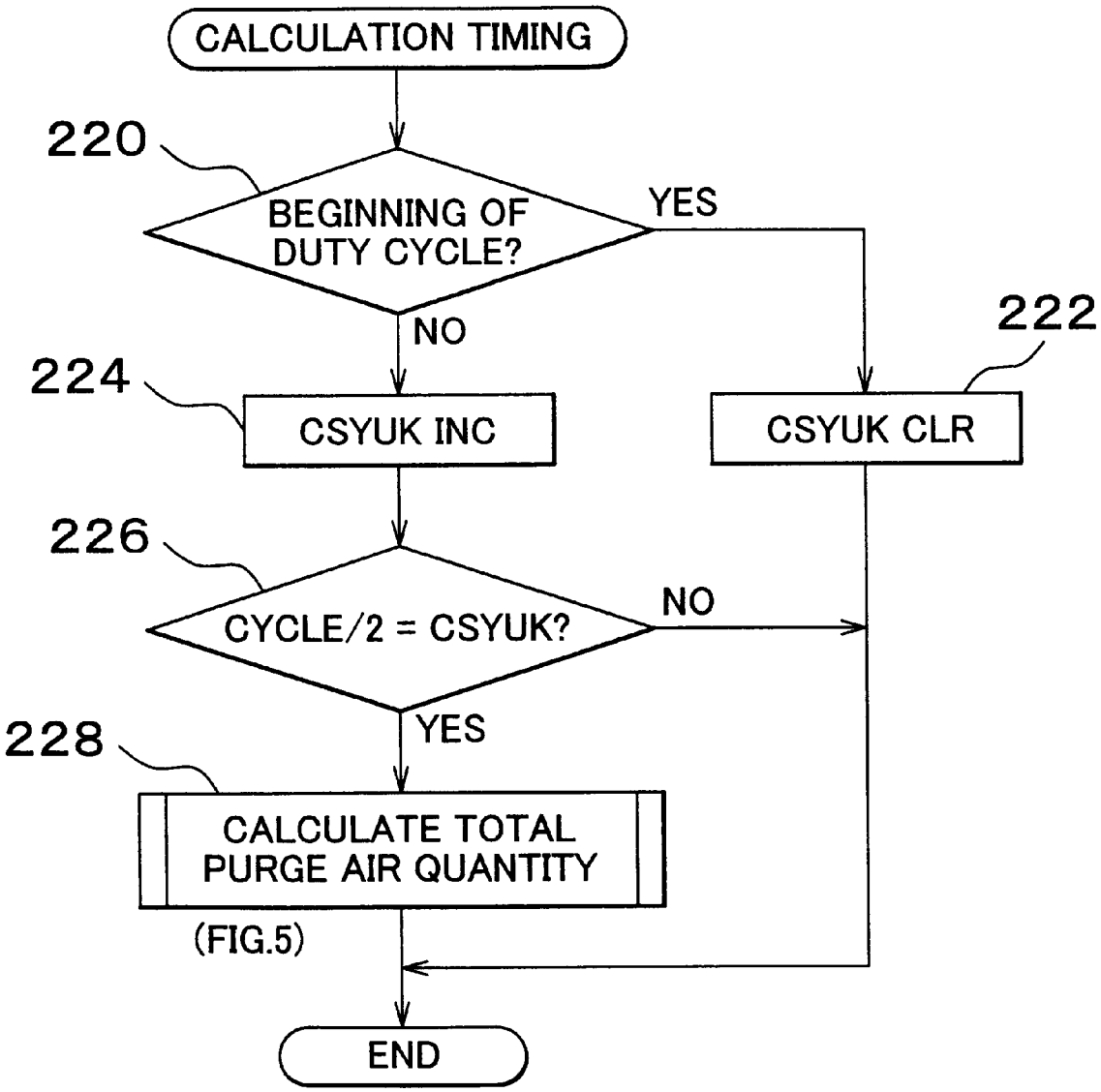
FIG. 8 is a flowchart showing a calculation timing routine executed according to a forth embodiment of the invention.

In the forth embodiment, the ECU 52 of the evaporated fuel processing apparatus according to the first embodiment executes a calculation timing routine shown in FIG. 8.

FIG. 8 is a flowchart showing the calculation timing routine executed for determining the timing with which the ECU 52 calculates the purge air quantity and the total purge air quantity according to the routine as shown in FIG. 5.

In the routine as shown in FIG. 8, it is first determined in step S220 whether the present time is at the beginning of a duty cycle used for driving the purge control valve 28.

If it is determined that the present time is at the beginning of the duty cycle, a count value of a cycle counter CSYUK is cleared in step S222 and the present routine is then finished.

Conversely, if it is determined that the present time is not at the beginning of the duty cycle, the count value of the cycle counter CSYUK is incremented in step S224.

In this case, it is next determined in step S226 whether the count value of the cycle counter CSYUK is equal to a value corresponding to a middle point of the duty cycle by determining whether "cycle/2=CSYUK" is true.

If it is determined in step S226 that "cycle/2=CSYUK" is not true, the present routine is finished at once. Conversely, if it is determined that "cycle/2=CSYUK" is true, then the purge air quantity and the total purge air quantity SUMQPG are calculated in step S228 according to the routine as shown in FIG. 5.

As described above, in the routine as shown in FIG. 8, the purge air quantity and the total purge air quantity are calculated when the purge control valve 28 is in a condition established at a middle point of the duty cycle. Basic data (such as PM and FGPG) used for calculating the purge air quantity vary to a certain extent in the course of one duty cycle. In the fourth embodiment, therefore, the purge air quantity is calculated at a middle point of the duty cycle so that an average purge air quantity is obtained. With the evaporated fuel processing apparatus of the fourth embodiment, therefore, the purge air quantity and the total purge air quantity SUMQPG are accurately calculated without being affected by variations in the basic data at the time of opening or closing of the purge control valve 28.

In the fourth embodiment as described above, the function of calculating the purge air quantity based on the state of the purge control valve 28 at a middle point of the duty cycle is incorporated to the evaporated fuel processing apparatus constructed according to the first embodiment. However, the same function may be incorporated to the evaporated fuel processing apparatus constructed according to the second or third embodiment.

Fifth Embodiment

Next, a fifth embodiment of the invention will be described with reference to FIG. 9.

Figure 9:
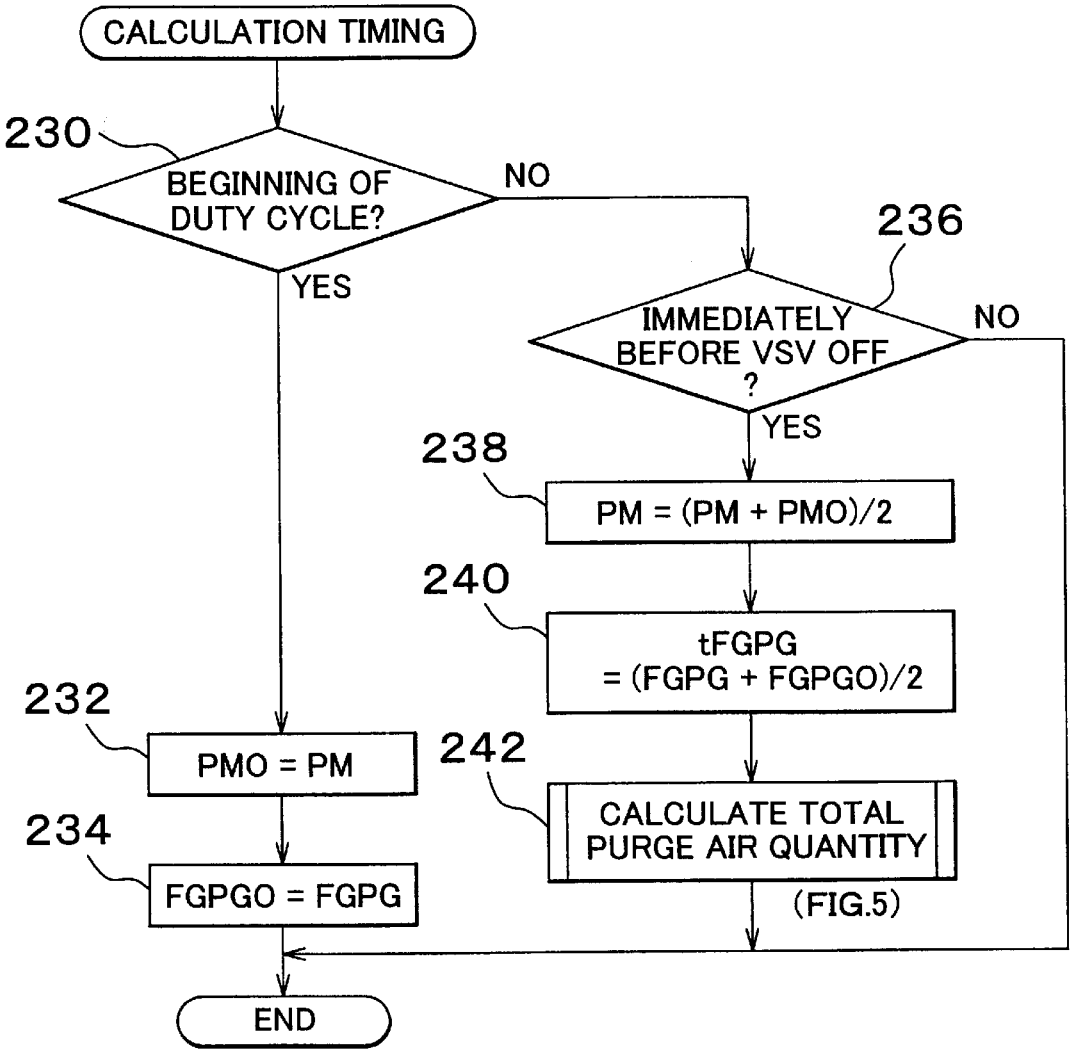
FIG. 9 is a flowchart showing a calculation timing routine executed according to a fifth embodiment of the invention.

In the fifth embodiment, the ECU 52 of the evaporated fuel processing apparatus according to the first embodiment executes a calculation timing routine as shown in FIG. 9.

FIG. 9 is a flowchart showing the calculation timing routine for determining the timing with which the ECU 52 calculates the purge air quantity and the total purge air quantity according to the routine as shown in FIG. 5.

In the routine as shown in FIG. 9, it is first determined in step S230 whether the present time is at the beginning of a duty cycle for driving the purge control valve 28, more specifically, whether switching of the purge control valve 28 from an OFF position (closed position) to an ON position (open position) has just occurred.

If it is determined in step S230 that the present time is at the beginning of the duty cycle, the intake pipe pressure PM at this point of time is recorded as a pressure record value PMO in step S232.

Then, the vapor concentration learning coefficient FGPG at this point of time is recorded as a vapor concentration learning coefficient record value FGPGO in step S234, and then the present routine is finished.

Conversely, if it is determined in step S230 that the present time is not at the beginning of the duty cycle, it is then determined in step S236 whether switching of the purge control valve 28 from the ON position (open position) to the OFF position (closed position) is about to take place.

If it is determined in step S236 that the present time is not immediately before the switching of the purge control valve 28 to the OFF position (closed position), the present routine is finished at once without executing any further process.

Conversely, if it is determined in step S236 that the present time is immediately before the switching of the purge control value 28 to the OFF position, an average value of the current intake pipe pressure PM and the above-described pressure record value PMO is calculated as (PM+PMO)/2, and the calculated average value is recorded as PM in step S238.

Next, an average value of the current vapor concentration learning coefficient FGPG and the above-described vapor concentration learning coefficient record value FGPGO is calculated as (FGPG+FGPGO)/2, and is recorded as FGPG in step S240.

In the routine of FIG. 9, step S240 is followed by step S242 in which the purge air quantity and the total purge air quantity SUMQPG are calculated according to the routine as shown in FIG. 5.

In step S242, the purge air quantity and total purge air quantity SUMQPG are calculated based on PM calculated in step S238 and FGPG calculated in step S240. Namely, in the routine as shown in FIG. 9, the purge air quantity and the total purge air quantity SUMQPG are calculated based on basic data at a point of time when the purge control valve 28 switches from the OFF position (closed position) to the ON position (open position), and also based on basic data at a point of time when the purge control valve 28 switches from the ON position to the OFF position.

In this routine, an average value of the purge air quantities at the beginning and end of a period during which the purge control valve is open is calculated as the purge air quantity, and the total purge air quantity SUMQPG is calculated by accumulating or summating the thus calculated purge air quantities. With the evaporated fuel processing apparatus of the fifth embodiment, therefore, the purge air quantity and the total purge air quantity SUMQPG are accurately calculated without being affected by variations in the basic data upon opening or closing of the purge control valve 28.

In the fifth embodiment, the function of calculating the average value of the purge air quantities at the beginning and end of the period of opening of the purge control valve 28 as the purge air quantity is incorporated to the evaporated fuel processing apparatus according to the first embodiment. However, the same function may be incorporated into the evaporated fuel processing apparatus according to the second or third embodiment.

Sixth Embodiment

Next, a sixth embodiment of the invention will be described with reference to FIG. 10 and FIGS. 11A and 11B.

Figure 10:
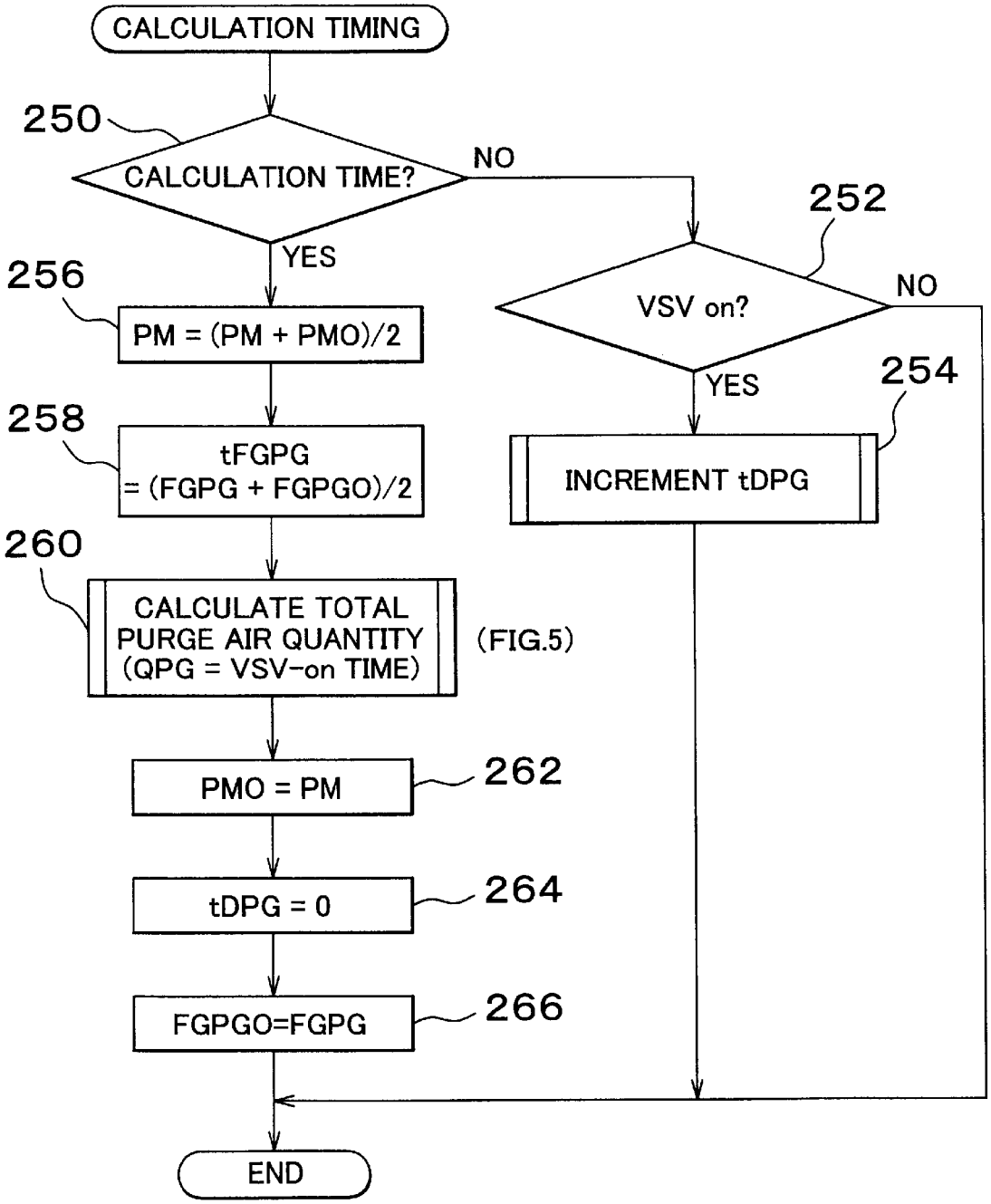
FIG. 10 is a flowchart showing a calculation timing routine executed according to a sixth embodiment of the invention.

In the sixth embodiment, the ECU 52 of the evaporated fuel processing apparatus according to the first embodiment executes a calculation timing routine shown in FIG. 10.

FIG. 10 is a flowchart showing a calculation timing routine for determining the timing with which the ECU 52 calculates the purge air quantity and the total purge air quantity according to the routine as shown in FIG. 5.

In the routine as shown in FIG. 10, it is first determined in step S250 whether the present time is a predetermined calculation time.

Figure 11:
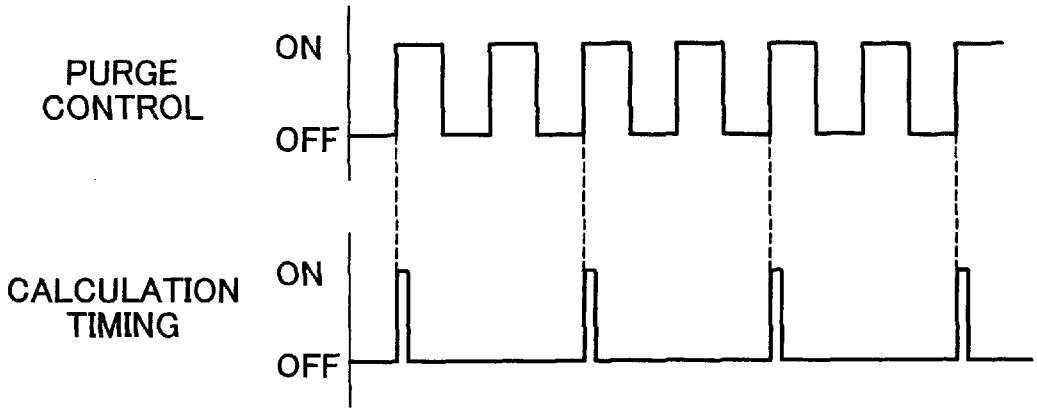
FIG. 11 is a timing chart showing one example of the calculation timing used in the sixth embodiment of the invention.

FIG. 11 is a timing chart used in this embodiment for explaining the calculation timing. In this embodiment, as shown in FIG. 11, the calculation timing is such that the purge air quantity and the total purge air quantity SUMQPG are calculated each time the duty cycle used for driving the purge control valve 28 is repeated a predetermined number of times. More specifically, the purge air quantity and the total purge air quantity SUMQPG are calculated every two duty cycles, such that the calculation is performed at the beginning of one of the two duty cycles. While the calculation is performed every two duty cycles in this embodiment, the number of duty cycles based on which the calculation timing is determined may be changed. Furthermore, the calculation need not be performed at the beginning of the duty cycle, but may occur in other timing.

In the routine as shown in FIG. 10, if it is determined in step S250 that the present time is not the predetermined calculation time, it is then determined in step S252 whether the purge control valve 28 is in the ON position (open position).

If it is determined in step S252 that the purge control valve 28 is not in the ON position, the present routine is immediately finished. Conversely, if it is determined that the purge control valve 28 is in the ON position, a total ON time tDPG is incremented in step S254 and then the present routine is finished.

As described later, the total ON time tDPG is a variable that is reset at each calculation time, namely, each time the purge air quantity and the total purge air quantity SUMQPG are calculated as described above. In step S254, therefore, a total time for which the purge control value 28 is in the ON position after the last calculation time is recorded as tDPG.

In the routine shown in FIG. 10, if it is determined in step S250 that the present time is the predetermined calculation time, an average value of the current intake pipe pressure PM and the pressure record value PMO recorded at the time of the last calculation is recorded as PM in step S256.

Then, an average value of the current vapor concentration learning coefficient FGPG and the vapor concentration learning coefficient record value FGPGO recorded at the time of the last calculation is recorded as FGPG in step S258.

When step S258 is completed, the purge air quantity and the total purge air quantity SUMQPG are then calculated in step S260 according to the routine as shown in FIG. 5.

In this calculation, the full-valve-opening purge gas quantity QPGMX is calculated in step S192 of the routine shown in FIG. 5, using PM calculated in step S256 in this routine. In step S194 of the routine of FIG. 5, the purge gas quantity QPG is calculated using the total ON time tDPG calculated in step S254 as "VSV-on time". Furthermore, in step S196 of the routine of FIG. 5, the fresh air ratio PGFRSH is calculated based on FGPG calculated in step S258 of this routine. Accordingly, in step S198 of the routine shown in FIG. 5, the purge air quantity is calculated based on the total VSV-on time in multiple cycles (two cycles in this case) and the total purge air quantity SUMQPG is calculated by accumulating or summating the thus calculated purge air quantities.

When the purge air quantity is calculated based on VSV-on time in one cycle, the purge air quantity suffers from an instantaneous error if, for example, the vapor concentration learning coefficient FGPG is updated. Conversely, when the purge air quantity is calculated based on VSV-on time in multiple cycles as in the embodiment, an influence of the instantaneous error on the purge air quantity can be sufficiently reduced. Thus, the method of calculating the purge air quantity based on the VSV-on time in multiple cycles according to this embodiment is effective to improve accuracy in the calculation of the purge air quantity. Accordingly, in step S260, the purge air quantity and the total purge air quantity SUMQPG are calculated with a high degree of accuracy.

As an interval between calculations of the purge air quantity increases, the purge air quantity calculated in step S260 is less likely to suffer from an instantaneous error as described above, but the calculated purge air quantity poorly follows transient changes in the actual purge air quantity. Thus, in the present embodiment, the calculation is preferably carried out every two or three duty cycles.

When step S260 is completed in the routine of FIG. 10, the intake pipe pressure PM calculated in step S256 of this routine is recorded as the pressure record value PMO in step S262.

Then, the total ON time tDPG is reset to 0 in step S264.

Next, the vapor concentration learning coefficient FGPG calculated in step S258 of this routine is recorded as the vapor concentration learning coefficient record value FGPGO in step S266 and thereafter the present routine is finished.

In the sixth embodiment of the invention, the function of calculating the purge air quantity based on the total VSV-on time in multiple duty cycles is incorporated to the evaporated fuel processing apparatus according to the first embodiment. However, this function may be incorporated to the evaporated fuel processing apparatus according to the second or third embodiment.

Seventh Embodiment

Next, a seventh embodiment of the invention will be described with reference to FIG. 12 and FIG. 13.

Figure 12:
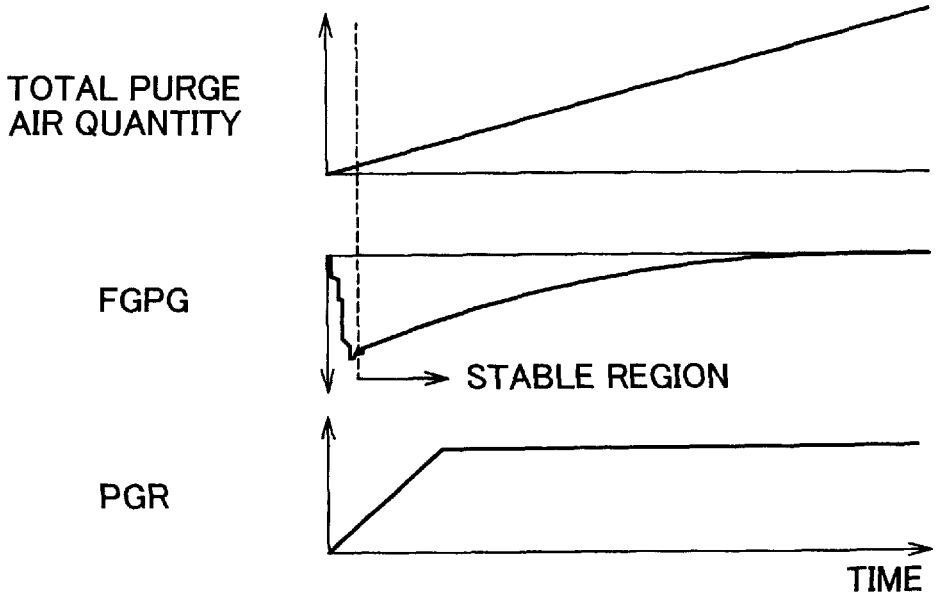
FIG. 12 is a timing chart for explaining an operation of an evaporated fuel processing apparatus according to a seventh embodiment of the invention.

FIG. 12 is a graph showing how the total purge air quantity increases after the purge control starts. FIG. 12B also shows how the vapor concentration learning coefficient FGPG is updated after the purge control starts, and how the purge rate PGR is increased after the purge control starts.

As described above with reference to FIG. 3, after the start of the purge control, the vapor concentration learning coefficient FGPG is updated so as to absorb deviation of the smoothed value FAFAV from the reference or normal value thereof. During a period immediately after the start of the purge control, the air-fuel mixture tends to be rich, and therefore the smoothed value FAFAV generally shifts to the rich side. At this time, the vapor concentration learning coefficient FGPG changes in a negative direction in accordance with the shift of the smoothed value FAFAV. During this period, FGPG is not reduced to a value corresponding to the actual vapor concentration, and continues to indicate a lower vapor concentration as compared with the actual vapor concentration, until the vapor concentration learning coefficient FGPG does not absorb a shift amount or change of the FAFAV.

When FGPG indicates a lower vapor concentration than actual as described above, the following situations may occur in the first and second embodiments.

(1) First Embodiment (Refer to FIG. 5)

Since the fresh air ratio PGFRSH is determined or calculated to be higher than an actual fresh air ratio (refer to step S196), the purge air quantity becomes excessively large, and consequently the total purge air quantity SUMQPG becomes excessively large (refer to step S198).

(2) Second Embodiment (Refer to FIG. 6)

As is the case with the first embodiment, the fresh air ratio PGFRSH is determined or calculated to be higher than an actual ratio (refer to steps S204 and S206), resulting in excessively large values of the purge air quantity and total purge air quantity SUMQPG (refer to step S208).

In the case of the third embodiment (refer to FIG. 7), the smoothed value FAFAV, as well as the purge correction coefficient FPG (=FGPG×PGR), is reflected in the calculation of the vapor quantity QVP. According to the third embodiment, therefore, the vapor quantity QVP does not become excessively large even in the above-described period in which FGPG has not sufficiently absorbed the shift amount or change of FAFAV. In this embodiment, however, after the purge control is started, the vapor quantity QVP is calculated to be higher than an actual value thereof until the time when an effect or influence of purge is sufficiently reflected by FAFAV. As a result, the purge air quantity and the total purge air quantity SUMQPG are calculated to be excessively large (refer to step S216) as in the case with the first and second embodiments.

As described above, with the evaporated fuel processing apparatuses according to the first through third embodiments, the purge air quantity and total purge air quantity SUMQPG may be calculated as being excessively large for a certain period immediately after the start of the purge control. However, the evaporated fuel processing apparatus according to the seventh embodiment is characterized in that the purge air quantity and the total purge air quantity SUMQPG are not calculated for an initial period after the start of the purge control until the vapor concentration learning coefficient FGPG becomes stable, more specifically, until FGPG enters a stable region as shown in FIG. 12, so as to prevent the purge air quantity and the total purge air quantity SUMQPG from being excessively large.

Figure 13:
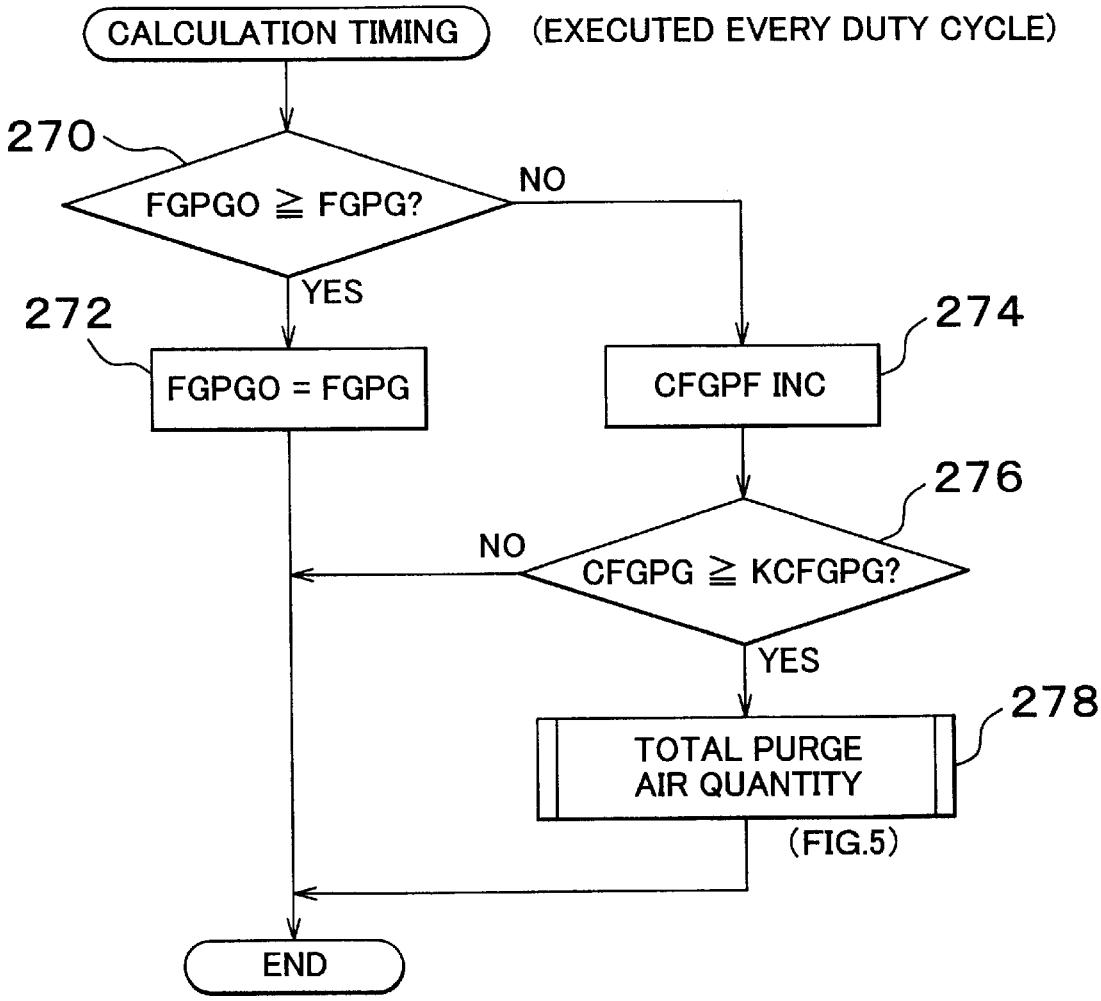
FIG. 13 is a flowchart showing a calculation timing routine executed according to the seventh embodiment of the invention.

FIG. 13 is a flowchart showing a calculation timing routine to be executed by the ECU 52 for realizing the above-described characteristic of the embodiment. In the embodiment, the ECU 52 of the evaporated fuel processing apparatus according to the first embodiment executes the calculation timing routine shown in FIG. 13. The routine of FIG. 13 is executed every duty cycle for driving the purge control valve 28.

In the routine shown in FIG. 13, it is first determined in step S270 whether the present vapor concentration learning coefficient FGPG is smaller than the vapor concentration learning coefficient record value FGPGO recorded in the previous routine.

If it is determined in step S270 that "FGPGO≧FGPG" is true, namely, if it is judged that FGPG remains unchanged or is decreasing, the vapor concentration learning coefficient FGPG is determined as decreasing along with a decrease in an actual vapor concentration. In this case, therefore, the present FGPG is recorded as FGPGO in step S272 and then the present routine is finished at once.

Conversely, if it is determined in step S270 that "FGPGO≧FGPG" is not true, it is judged that FGPG is increasing. In this case, a count value of a counter CFGPG is incremented in step S274.

Next, it is determined in step S276 whether the count value of the counter CFGPG is equal to or greater than a judgement value KCFGPG (e.g. 10).

In the embodiment as described above, when the condition of step S276 is satisfied, it is judged that the vapor concentration learning coefficient FGPG has reached a stable value or has entered a stable region. The condition of step S276 is satisfied when the routine of FIG. 13 is repeated KCFGPG times (e.g., 10 times) after FGPG starts increasing after decreasing. If it is determined in step S276 that "CFGPG≧KCFGPG" is not true, it is judged that FGPG has not yet reached a stable value or region, and therefore the present routine is immediately finished.

Conversely, if it is determined in step S276 that "CFGPG≧KCFGPG" is true, it is judged that FGPG has reached a stable value, and then the purge air quantity and the total purge air quantity SUMQPG are calculated in step S278 according to the routine shown in FIG. 5.

As described above, the routine shown in FIG. 13 is such that the purge air quantity and the total purge air quantity SUMQPG are not calculated until the vapor concentration learning coefficient FGPG has reached a stable value, more specifically, until the vapor concentration as represented by FGPG becomes equal to or greater than the actual concentration. Accordingly, the evaporated fuel processing apparatus according to the seventh embodiment surely prevents the total purge air quantity from being calculated to be excessively large after the start of the purge control.

In the seventh embodiment as described above, FGPG is determined as having reached a stable value when the routine shown in FIG. 13 is repeated a predetermined number of times after FGPG starts increasing after decreasing upon the start of the purge control. In other embodiments, this determination (that FGPG has reached a stable value or region) may be made, for example, at a point of time when FGPG starts increasing or when the routine is repeated a predetermined number of times after the start of the purge control.

In the seventh embodiment, the number of times the routine of FIG. 13 is repeated, namely, the number of times the duty cycle is repeated after start of the purge control, is used as a criterion for determining whether FGPG has reached a stable value. In another embodiment, this determination may be made based on the number of times FGPG is updated after the start of the purge control, namely, the number of times the air-fuel ratio correction coefficient FAF skips or changes by a large step (the number of times of switching or shifting of the air-fuel ratio between the lean side and the rich side).

In the seventh embodiment, the function of starting calculation of the total purge air quantity SUMQPG after FGPG becomes stable is incorporated to the evaporated fuel processing apparatus according to the first embodiment of the invention. In other embodiments, this function may be incorporated to the evaporated fuel processing apparatus according to the second or third embodiment. With the evaporated fuel processing apparatus according to the third embodiment, the above-described function may be realized by starting calculation of the total purge air quantity SUMQPG after FAFAV has reached a stable value, more specifically, after the effect of purging has been sufficiently reflected by the value of FAFAV.

Eighth Embodiment

Next, an eighth embodiment of the invention will be described with reference to FIG. 14. In the seventh embodiment as described above, the evaporated fuel processing device does not perform calculation of the total purge air quantity SUMQPG before FGPG reaches a stable value or range, and thus prevents the calculated total purge air quantity SUMQPG from being excessively large. However, the eighth embodiment is characterized in that a part of the purge air quantity obtained while the FGPG has not reached a stable value is added to the total purge air quantity obtained in the previous cycle, while preventing the resulting total purge air quantity from being excessively large, thus assuring improved accuracy in the calculation of the total purge air quantity SUMQPG as compared with that in the third embodiment.

Figure 14:
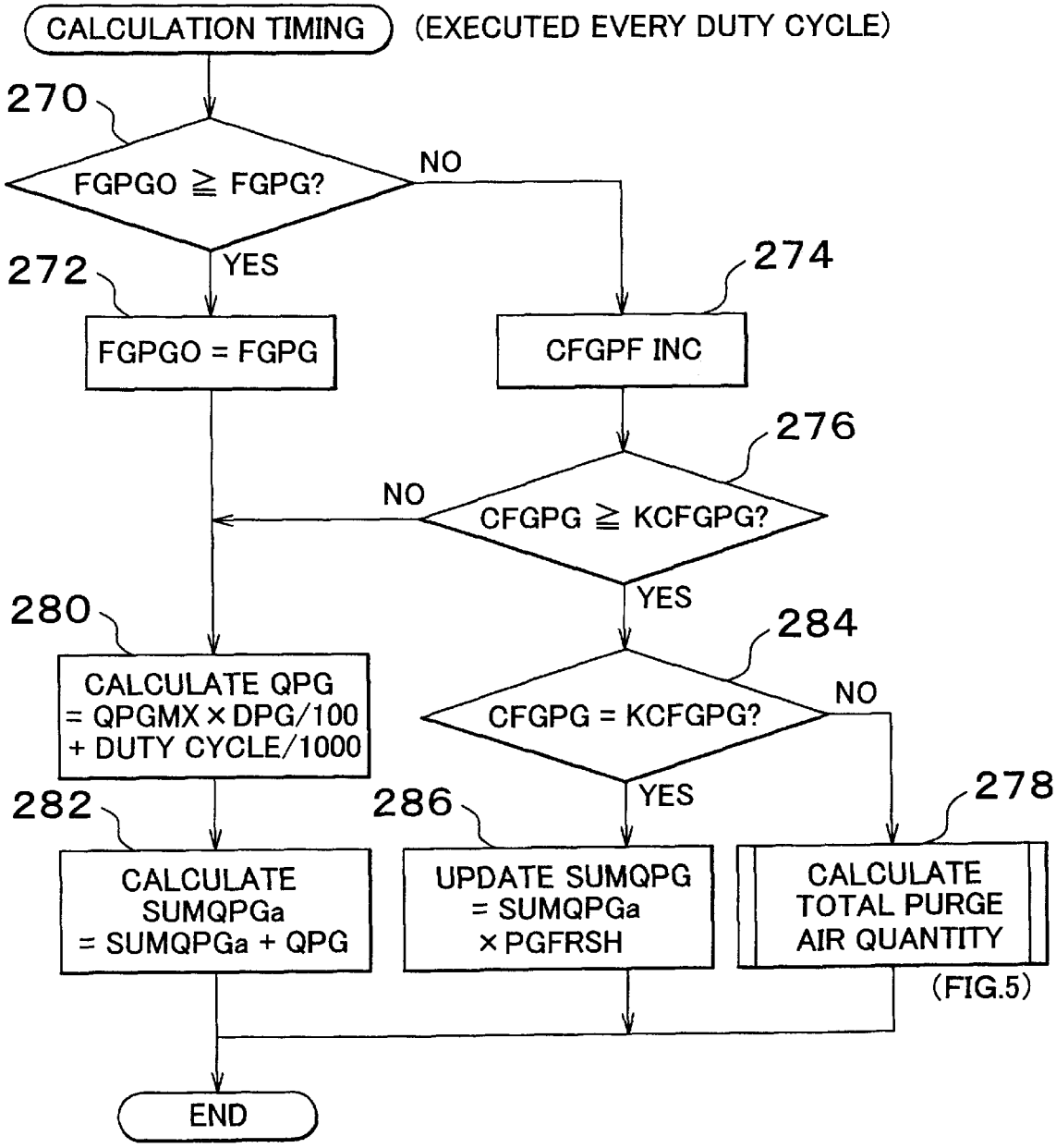
FIG. 14 is a flowchart showing a calculation timing routine executed according to an eighth embodiment of the invention.

FIG. 14 is a flowchart showing a calculation timing routine to be executed by the ECU 52 for realizing the above-described characteristic. In the eighth embodiment, the evaporated fuel processing apparatus of the seventh embodiment executes the routine as shown in FIG. 14, instead of the routine as shown in FIG. 13. Steps that are common to the routines of FIG. 13 and FIG. 14 are denoted by the same reference numerals, and no or only brief explanation of these steps is provided.

In the routine as shown in FIG. 14, when it is determined in step S270 that the value of FGPG remains unchanged or is decreasing (when the condition "FGPGO≧FGPG" is satisfied), the purge gas quantity QPG is calculated in step S280. In step S280, the purge gas quantity QPG is calculated in the same manner as in steps S192 and S194 of the first embodiment. In another embodiment, this calculation may be carried out in the same manner as in step S202 of the second embodiment.

Once the purge gas quantity QPG is calculated, a pre-stabilization total purge gas quantity SUMQPGa is calculated according to the following expression:

$$SUMQPGa=SUMQPGa+QPG \tag{24}$$

The pre-stabilization total purge gas quantity SUMQPGa is the sum of the purge gas quantities QPG that passes through the purge control valve 28 before FGPG becomes stable after the start of the purge control.

In the routine shown in FIG. 14, when it is determined in step S272 that "FGPGO≧FGPG" is not true (i.e., the FGPG is increasing) and it is determined in step S276 that "CFGPG≧KCFGPG" is true, which means that the FGPG has reached a stable value, it is then determined in step S284 whether "CFGPG=KCFGPG" is true.

In this routine, "CFGPG=KCFGPG" is true only when the condition "CFGPG≧KCFGPG" is satisfied for the first time in step S276, that is, when it is first determined that FGPG has reached a stable value. If step S284 determines that "CFGPG=KCFGPG" is true, the pre-stabilization total purge gas quantity SUMQPGa is then converted to the total purge air quantity SUMQPG according to the following expression:

$$SUMQPG=SUMQPGa\times PGFRSH \quad (25)$$

In the expression (25), "PGFRSH" in the right side is the fresh air ratio obtained based on the current condition(s) in the same manner as in the first or second embodiment (refer to step S196 of FIG. 5 or steps S204 and S206 of FIG. 6). Here, the fresh air ratio PGFRSH is calculated using FGPG that has reached a stable value. According to the expression (25), therefore, the total purge air quantity SUMQPG before FGPG becomes stable is accurately calculated.

In subsequent cycles of the routine as shown in FIG. 14, step S284 is followed by step S278 in which the total purge air quantity SUMQPG is calculated by adding the purge air quantity calculated in each cycle of the routine to the total purge air quantity SUMQPG calculated in step S286. As described above, in the eighth embodiment, the total purge air quantity SUMQPG is able to reflect the purge air quantities calculated before FGPG becomes stable, thus assuring improved accuracy in the calculation of the total purge air quantity SUMQPG.

Ninth Embodiment

Figure 15:
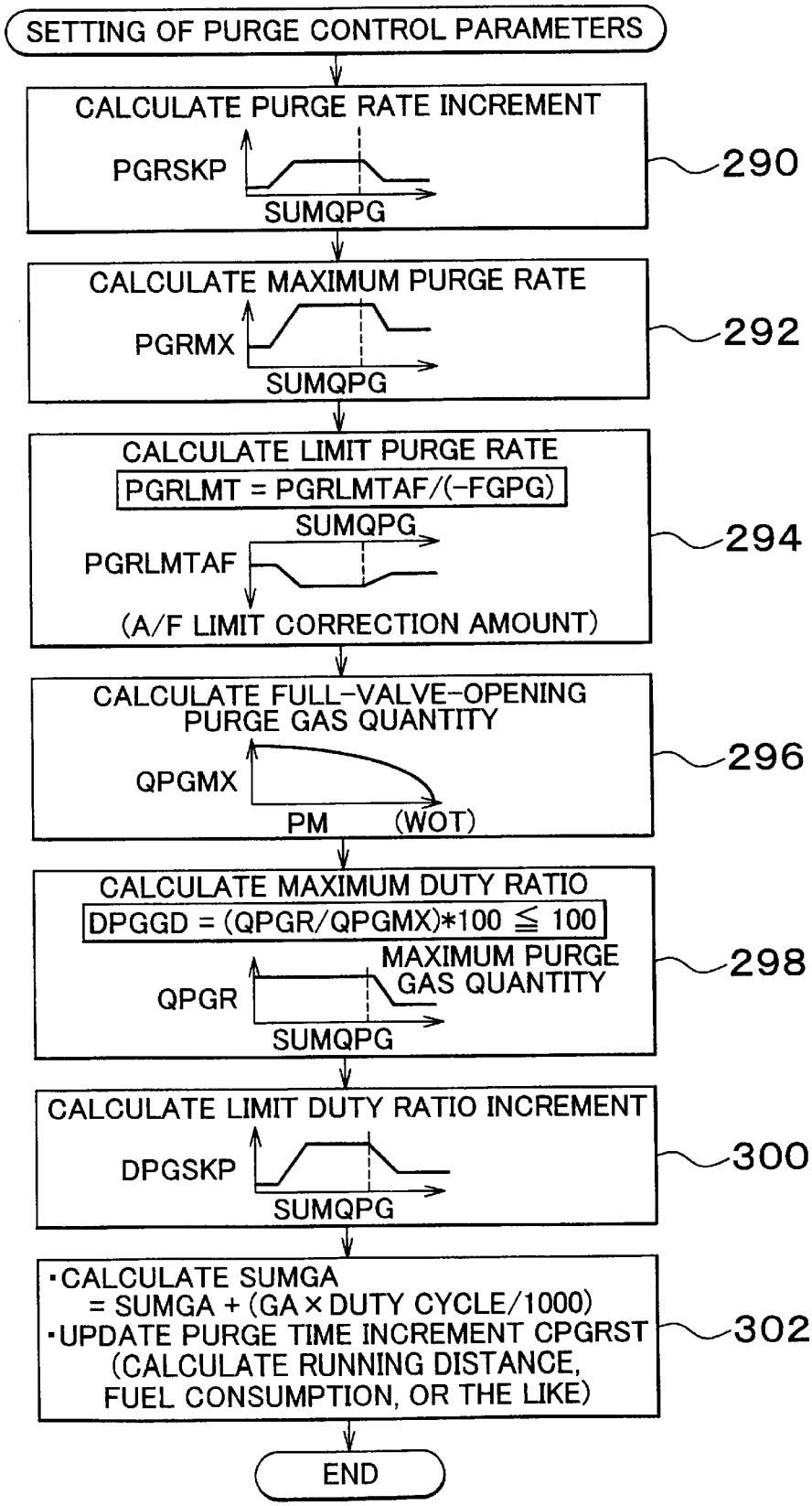
FIG. 15 is a flowchart showing a control parameter setting routine executed according to a ninth embodiment of the invention.

Next, a ninth embodiment of the invention will be described with reference to FIG. 15. FIG. 15 is a flowchart showing a control parameter setting routine to be executed by the ECU 52 in the embodiment. As described in the first embodiment, the purge control is performed using several parameters including: (a) purge rate increment PGRSKP, (b) maximum purge rate PGRMX, (c) limit purge rate PGRLMT, (d) maximum duty ratio DPGGD, and (e) limit duty ratio increment DPGSKP.

The routine as shown in FIG. 15 is executed for setting these parameters based on the total purge air quantity SUMQPG. In this embodiment, the ECU 52 of the evaporated fuel processing apparatus according to any one of the first through seventh embodiments executes the routine shown in FIG. 15. This routine is executed every duty cycle for driving the purge control valve 28.

In the routine of FIG. 15, the purge rate increment PGRSKP is first calculated based on the total purge air quantity SUMQPG in step S290.

As described above, the purge rate increment PGRSKP is an increment or an amount of increase in the present routine from the purge rate PGR determined in the previous routine. The ECU 52 stores a map shown in the block of step S290, which determines a relationship between the total purge air quantity SUMQPG and the purge rate increment PGRSKP. With reference to this map, the purge rate increment PGRSKP is calculated based on the total purge air quantity SUMQPG in step S290.

Since the vapor concentration may not be determined with sufficiently high accuracy when the total purge air quantity SUMQPG is in a small region, it is desirable to set the purge rate increment PGRSKIP to a relatively small value in order to avoid large deviation of the air-fuel ratio from its target value. Conversely, in a region where the total purge air quantity SUMQPG has increased to a certain level, the vapor concentration is calculated with sufficient accuracy. In this case, it is desirable to set PGRSKP to a relatively large value in order to ensure a sufficient purge amount. Further, in a region where the total purge air quantity SUMQPG is sufficiently large, which indicates that a sufficient amount of fuel has been purged from the canister 22, it is not necessary to further purge a large amount of the fuel. Therefore, PGRSKP is preferably set to a small value.

As shown in FIG. 15, the map of the purge rate increment PGRSKP is plotted such that PGRSKP takes a relatively small value in a region where the total purge air quantity SUMQPG is relatively small and in a region where SUMQPG is relatively large, and such that PGRSKIP takes a relatively large value in an intermediate region of the total purge air quantity SUMQPG. With this map, therefore, the above-described requirements associated with the PGRSKIP can be satisfied. Accordingly, the evaporated fuel processing apparatus of this embodiment makes it possible to set the purge rate increment PGRSKIP to an appropriate value in accordance with changes in the total purge air quantity SUMQPG.

In the routine shown in FIG. 15, the maximum purge rate PGRMX is calculated based on the total purge air quantity SUMQPG in step S292.

As described above, the maximum purge rate PGRMX is a predetermined upper limit value or guard value of the purge rate set for preventing excessive deviation of the air-fuel ratio from its target value. The ECU 52 stores a map as shown in the block of step S292, which determines a relationship between the total purge air quantity SUMQPG and the maximum purge rate PGRMX. According to this map, the maximum purge rate PGRMX is calculated based on the total purge air quantity SUMQPG in step S292.

For the same reason as described above with respect to the setting of PGRSKP, the maximum purge rate PGRMX is preferably set to a relatively small value in a region where the total purge air quantity SUMQPG is still relatively small and in a region where SUMQPG has increased to a sufficiently large value. Also, the maximum purge rate PGRMX is preferably set to a relatively large value in an intermediate region of the total purge air quantity SUMQPG. With this map, therefore, the requirements associated with the PGRMX can be satisfied. Accordingly, the evaporated fuel processing apparatus of this embodiment makes it possible to set the maximum purge rate PGRMX to an appropriate value in accordance with changes in the total purge air quantity SUMQPG.

In the routine shown in FIG. 15, the limit purge rate PGRLMT is calculated based on the total purge air quantity SUMQPG in step S292.

The limit purge rate PGRLMT is an upper limit value of the purge rate, which is determined based on the basic fuel injection amount according to the following expression:

$$PGRLMIT=PGRLMTAF/(-FGPG) \quad (26)$$

In the expression (26), "PGRLMTAF" in the right side represents a permissible limit ratio of fuel vapors to the basic fuel injection amount. For example, when PGRLMTAF is 40%, the maximum quantity of the fuel vapors that can be purged to the engine is equal to 40% of the basic fuel injection amount. FGPG is a rate of correction per 1% of the purge rate PGR, and a purge rate corresponding to the above-described permissible maximum quantity of the fuel vapors is calculated as the limit purge rate PGRLMT according to the expression (26). For example, the maximum purge rate PGRMX is 2% when FGPG is 20%.

The ECU 52 stores a map shown in the block of step S294, which determines a relationship between the total purge air quantity SUMQPG and the limit value PGRLMTAF. In step S294, the limit value PGRLMTAF is first calculated based on the total purge air quantity SUMQPG according to the above-described map, and the limit purge rate PGRLMT is then calculated using the calculated value of PGRLMTAF and FGPG.

For the same reason as described above with respect to the setting of the purge rate increment PGRSKP, PGRLMT is preferably set to a relatively small value in a region where the total purge air quantity SUMQPG is relatively small and in a region where SUMQPG has increased to a sufficiently large value, and is preferably set to a relatively large value in an intermediate region of the total purge air quantity SUMQPG. With this map, therefore, the requirements associated with the PGRLMT can be satisfied. Accordingly, the evaporated fuel processing apparatus of this embodiment makes it possible to set the limit purge rate PGRLMT to an appropriate value in accordance with changes in the total purge air quantity SUMQPG.

In the routine as shown in FIG. 15, the full-valve-opening purge gas quantity QPGMX is calculated based on the intake pipe pressure PM in step S296.

Next, the maximum duty ratio DPGGD is calculated based on the total purge air quantity SUMQPG in step S298.

The maximum duty ratio DPGGD is an upper limit value of the duty ratio to be determined in relation with the maximum purge gas quantity QPGR, which is a permissible maximum quantity of the purge gas. DPGGD is calculated according to the following expression:

$$DPGGD=(QPGR/QPGMX)\times 100$$

$$\text{where } DPGGD \leqq 100 \tag{27}$$

The ECU 52 stores a map as shown in the block of step S298, which determines a relationship between the total purge air quantity SUMQPG and the maximum purge gas quantity QPGR. The maximum purge gas quantity QPGR is calculated based on the total purge air quantity SUMQPG according to the map in the block of step S298 and DPGGD is then calculated using the thus calculated value of QPGR and QPGMX in step S298.

Preferably, the maximum purge gas quantity QPGR is kept at a relatively large value until the total purge air quantity SUMQPG has increased to a sufficiently large value so as to enable quick purge of the fuel stored in the canister 22. Furthermore, the maximum purge gas quantity QPGR is set to a relatively small value when the total purge air quantity SUMQPG has increased to a sufficiently large value so as to prevent excessive deviation of the air-fuel ratio from its target value due to unnecessary purge of fuel vapors. With this map, therefore, the requirements associated with the maximum purge gas quantity SUMQPG can be satisfied. Accordingly, the evaporated fuel processing apparatus of this embodiment makes it possible to set the maximum duty ratio DPGGD to an appropriate value in accordance with changes in the total purge air quantity SUMQPG.

In the routine as shown in FIG. 15, the limit duty ratio increment DPGSKP is calculated based on the total purge air quantity SUMQPG in step S300.

As described above, the limit duty ratio increment DPGSKP is an upper limit value of an increment or an amount of increase of the duty ratio DPG for preventing excessive deviation of the air-fuel ratio from its target value due to a rapid increase in the value of DPG. The ECU 52 stores a map as shown in the block of step S300, which determines a relationship between the total purge air quantity SUMQPG and the limit duty ratio increment DPGSKP. According to this map, the limit duty ratio increment DPGSKP is calculated based on the total purge air quantity SUMQPG in step S300.

For the same reason as described above with respect to the setting of the purge rate increment PGRSKP, the limit duty ratio increment DPGSKP is preferably set to a relatively small value in a region where the total purge air quantity SUMQPG is relatively small and in a region where the SUMQPG has increased to a sufficiently large value, and is preferably set to a relatively large value in an intermediate region of the total purge air quantity SUMQPG. With this map, therefore, the requirements associated with the limit duty ratio increment DPGSKP can be satisfied. Accordingly, the evaporated fuel processing apparatus of this embodiment makes it possible to set the limit duty ratio increment DPGSKP to an appropriate value in accordance with changes in the total purge air quantity SUMQPG.

In step S302 of the routine as shown in FIG. 15, the history of current vehicle conditions is recorded. More specifically, a total intake air quantity SUMGA, which is the sum of the intake air quantities GA, is calculated, and a total or accumulated purge time CPGRST is incremented. Furthermore, the vehicle running distance and the fuel consumption amount are updated.

In step S302, the total intake air quantity SUMGA is calculated according to the following expression:

$$SUMGA=SUMGA+(GA\times \text{cycle of execution of this routine}/1000) \tag{28}$$

The control parameters set in the routine as shown in FIG. 15 are used in the purge control routine as shown in FIG. 2. Accordingly, the evaporated fuel processing apparatus according to the ninth embodiment exhibits high purging performance by efficiently purging the fuel stored in the canister 22 while preventing excessive deviation of the air-fuel ratio from its target value.

Tenth Embodiment

Next, a tenth embodiment of the invention will be described with reference to FIG. 16. In this embodiment, the ECU 52 of the evaporated fuel processing apparatus according to the ninth embodiment further executes a routine as shown in FIG. 16 after executing the routine as shown in FIG. 15.

Figure 16:
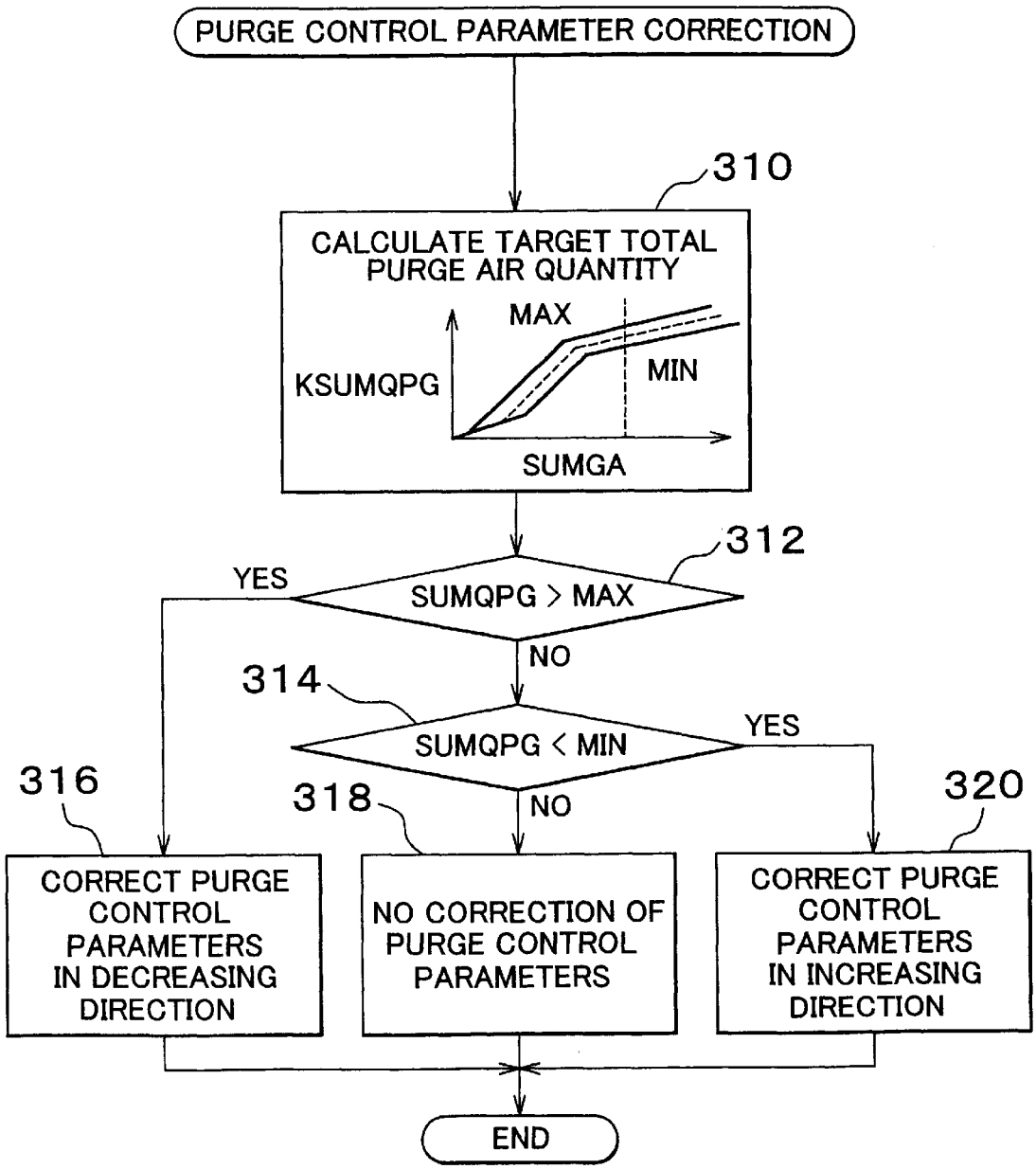
FIG. 16 is a flowchart showing a control parameter correction routine executed according to a tenth embodiment of the invention.

FIG. 16 is a flowchart showing a control parameter correction routine to be executed by the ECU 52 in the tenth embodiment. This routine is executed following the routine as shown in FIG. 15, for correcting the control parameters set in the routine as shown in FIG. 15.

In the routine as shown in FIG. 16, a maximum value MAX and a minimum value MIN of a target total purge air quantity KSUMQPG is first calculated based on the total intake air quantity SUMGA in step S310.

With the evaporated fuel processing apparatus according to the tenth embodiment, the target total purge air quantity KSUMQPG, which is a target value of the total purge air quantity SUMQPG, is calculated such that KSUMQPG corresponds to the total intake air quantity SUMGA. The ECU 52 stores a map as shown in the block of step S310 in FIG. 16, which map represents relationships of the maximum value MAX and the minimum value MIN of the target total purge air quantity KSUMQPG with the total intake air quantity SUMGA respectively. According to this map, the maximum value MAX and the minimum value MIN are calculated based on the total intake air quantity SUMGA in step S310.

Next, it is determined in step S312 whether the current total purge air quantity SUMQPG is greater than the maximum value MAX.

If it is determined that SUMQPG is equal to or smaller than MAX, it is further determined in step S314 whether SUMQPG is smaller than the minimum value MIN.

When it is determined in step S312 that "SUMQPG>MAX" in step S312, which means that the current SUMQPG is excessively large as compared with the target quantity, the above-described control parameters are corrected in a decreasing direction in step S316 so that the purge air quantity is reduced.

When it is determined in step S312 and step S314 that "MAX≧SUMQPG≧MIN" is true, which means that the current SUMQPG is in an appropriate range with respect to the target quantity, the control parameters are not corrected but maintained in step S318.

Conversely, when step S314 determines that "SUMQPG<min" is true, which means that the current SUMQPG is smaller than the target quantity, the control parameters are corrected in an increasing direction in step S320 so that the purge air quantity is increased.

As described above, in the control parameter correction routine as shown in FIG. 16, the control parameters are corrected depending upon a deviation of the total purge air quantity SUMQPG from its target value KSUMQPG so that SUMQPG is made close to the target total purge air quantity KSUMQPG. Thus, the evaporated fuel processing apparatus of this embodiment is able to exhibit desired purge performance with improved reliability, while reducing deviation of the air-fuel ratio from its target value with higher accuracy, as compared with that of the ninth embodiment.

While the target total purge air quantity KSUMQPG is determined based on the total intake air quantity SUMGA in the tenth embodiment, KSUMQPG may be determined based on another parameter or parameters representing the vehicle condition history. For example, KSUMQPG may be determined based on the total or accumulated purge time CPGRST, the vehicle running distance, the fuel consumption amount, or the like (refer to step S302 in FIG. 15).

Moreover, while only one value of KSUMQPG is determined in the tenth embodiment, a plurality of values of KSUMQPG may be determined in another embodiment of the invention. For example, a first value of KSUMQPG may be determined mainly for the purpose of preventing fuel vapors generated during refueling from being released to the atmosphere, and a second value of KSUMQPG may be determined mainly for the purpose of preventing fuel vapors generated within the fuel tank 10 from being released to the atmosphere.

Furthermore, while the control parameters set in the routine of FIG. 15 are corrected in the routine of FIG. 16 in the tenth embodiment, the invention is not limited to this manner of determining the control parameters. Namely, the control parameter setting routine as shown in the FIG. 15 may be omitted, and the control parameters may be calculated in one of the above steps S316, S318, and S320 of FIG. 16, in the manner (i.e., to be relatively small values, normal values or relatively large values) as required in each of these steps, so that SUMQPG is made close to its target value KSUMQPG.

Eleventh Embodiment

Next, an eleventh embodiment of the invention will be described with reference to FIG. 17. In this embodiment, the ECU 52 of the evaporated fuel processing apparatus according to the ninth embodiment executes a routine as shown in FIG. 17 following the routine as shown in FIG. 15.

Figure 17:
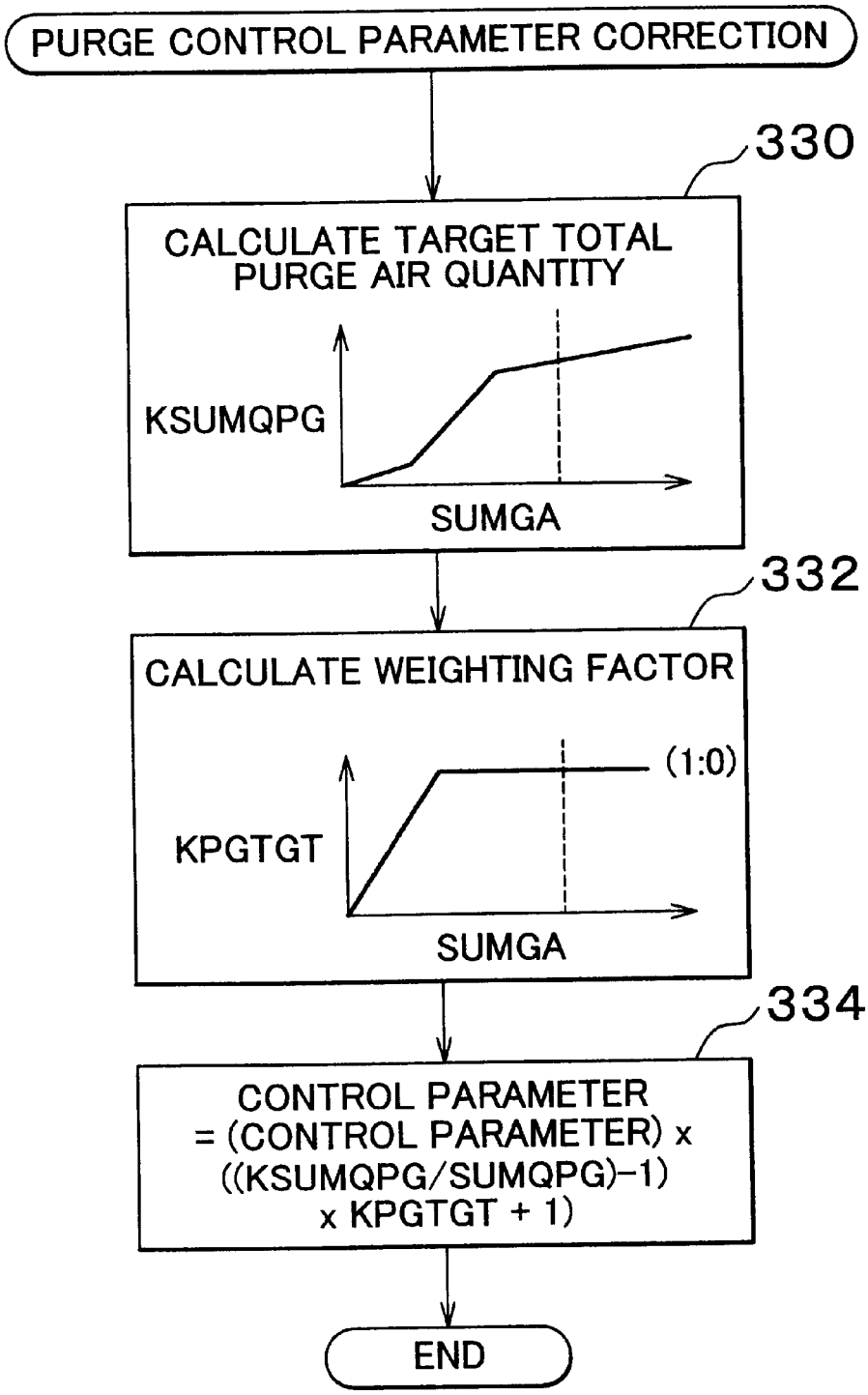
FIG. 17 is a flowchart showing a control parameter correction routine executed according to an eleventh embodiment of the invention.

FIG. 17 is a flowchart showing a control parameter correction routine to be executed by the ECU 52 in the embodiment, for correcting the control parameters set in the routine as shown in FIG. 15.

In the routine as shown in FIG. 17, the target total purge air quantity KSUMQPG is first calculated based on the total intake air quantity SUMGA in step S330.

The ECU 52 stores a map shown in the block of step S330 in FIG. 17, which represents a relationship between the total intake air quantity SUMGA and the target total purge air quantity KSUMQPG. According to this map, the target total purge air quantity KSUMQPG is calculated based on the total intake air quantity SUMGA in step S330.

Next, a weighting factor KPGTGT is calculated in step S332. The weighting factor KPGTGT is defined as a factor for determining the sensitivity of control parameter correction to be performed in a subsequent step of the routine. The ECU 52 stores a map as shown in the block of step S332 in FIG. 17, which map represents a relationship between the total intake air quantity SUMGA and the weighting factor KPGTGT. According to this map, the weighting factor KPGTGT corresponding to the total intake air quantity SUMGA is determined with reference to the map in step S332.

Once the weighting factor KPGTGT is calculated, the control parameters determined in the routine as shown in FIG. 15 are corrected in step S332 according to the following expression:

$$\text{control parameter (corrected value)} = \text{control parameter value (before correction)} \times [\{(KSUMQPG/SUMQPG) - 1\} \times KPGTGT + 1] \quad (29)$$

In the expression (29), "{(KSUMQPG/SUMQPG)−1}" in the right side is a correction term for eliminating a difference between the total purge air quantity SUMQPG and the target total purge air quantity KSUMQPG. According to the expression (29), therefore, the control parameters are appropriately increased or decreased so as to bring SUMQPG close to KSUMQPG.

As shown in the map in step S332 of FIG. 17, the weighting factor KPGTGT, which is multiplied by the above-described correction term in the expression (29), increases in proportion to the total intake air quantity SUMGA in a region where SUMGA is still small, and is maintained at its maximum value 1.0 in a region where SUMGA is greater than a predetermined value. According to the expression (29), therefore, the control parameters are corrected such that the total purge air quantity SUMQPG is more accurately controlled to the target purge air quantity KSUMQPG when the total intake air quantity SUMGA is sufficiently large, and excessive correction of the control parameters is prevented when SUMGA is in a relatively small region.

As described above, according to the control parameter correction routine as shown in FIG. 17, the control parameters are corrected so as to achieve the target total purge air quantity KSUMQPG, while preventing excessive correction of the control parameters. Thus, the evaporated fuel processing apparatus according to the eleventh embodiment is able to exhibit desired purge performance with improved reliability, while reducing deviation of the air-fuel ratio from its target value (i.e., achieving the target air-fuel ratio with higher accuracy), as compared with the apparatus of the ninth embodiment.

While the target total purge air quantity KSUMQPG is determined based on the total intake air quantity SUMGA in the eleventh embodiment, KSUMQPG may be determined based on another parameter or parameters representing the vehicle condition history, which may be selected from, for example, the total or accumulated purge time CPGRST, vehicle running distance, fuel consumption amount, and the like (refer to step S302 in FIG. 15).

Further, while only one value of KSUMQPG is determined in this embodiment, a plurality of values of KSUMQPG may be determined which include a value determined for the purpose of preventing fuel vapors generated during refueling from being released to the atmosphere, and a value determined for the purpose of preventing fuel vapors generated within the fuel tank from being released to the atmosphere.

Twelfth Embodiment

Next, a twelfth embodiment will be described with reference to FIG. 18. In this embodiment, the ECU 52 of the evaporated fuel processing apparatus according to the eleventh embodiment executes a routine as shown in FIG. 18 in step S330 of the routine shown in FIG. 17.

Figure 18:
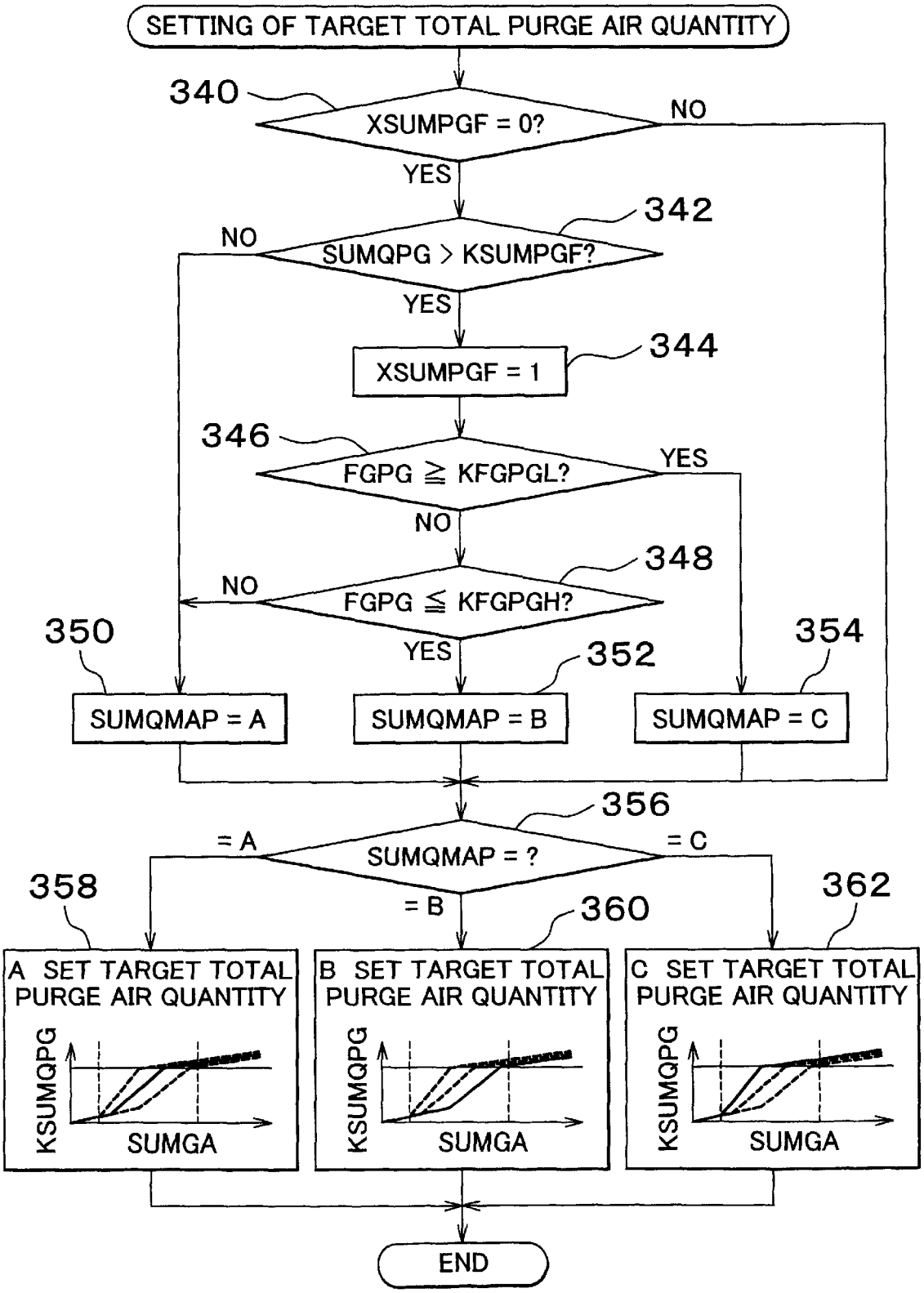
FIG. 18 is a flowchart showing a target total purge air quantity setting routine executed according to a twelfth embodiment of the invention.

FIG. 18 is a flowchart showing a routine to be executed by the ECU 52 in the initial stage of purge control for detecting the quantity of fuel vapors stored in the canister 22, and determining the target total purge air quantity KSUMQPG based on the detected quantity of the stored fuel vapors.

In this routine, it is first determined in step S340 whether a total purge air quantity flag XSUMQPG is "0". As described later, the flag XSUMQPG is set to "1" when the total purge air quantity SUMQPG exceeds a predetermined value KSUMPGF. Immediately after the purge control is started, therefore, the flag XSUMQPG is "0".

If it is determined in step S340 that "XSUMQPG=0" is true, it is next determined in step S342 whether the total purge air quantity SUMQPG has become greater than the predetermined value KSUMPGF.

The predetermined value KSUMPFG represents a total purge air quantity required for the vapor concentration learning coefficient FGPG to reach a value corresponding to the vapor concentration in the purge gas after the purge control is started. When an affirmative decision (YES) is obtained in step S342, it is judged that the current FGPG accurately or almost correctly reflects the actual vapor concentration.

If it is determined in step S342 that SUMQPG has not exceeded KSUMPGF, step S350 is executed as described later. Conversely, if it is determined that SUMQPG exceeds KSUMPGF, the total purge air quantity flag XSUMQPG is set to "1" in step S344, and it is determined in step S346 whether the current vapor concentration learning coefficient FGPG is equal to or greater than a low-concentration-side judgment value KFGPGL (e.g. −0.05).

If it is determined in step S346 that "FGPG≧KFGPGL" is not true, namely, if it is determined that FGPG is lower than KFGPGL, it is then determined whether FGPG is equal to or smaller than a high-concentration-side judgment value KFGPGH (e.g. −0.10).

If it is determined in steps S346 and S348 that FGPG is smaller than the low-concentration-side judgment value KFGPGL but greater than the high-concentration-side judgment value KFGPGH, it is judged that the vapor concentration in the purge gas is in a normal range, which means that fuel vapors are stored in the canister 22 in a normal manner. In this case, a map parameter SUMQMAP is set to A in step S350.

As shown in FIG. 18, step S350 is also executed when it is determined in step S342 that SUMQPG has not exceeded KSUMPGF.

If step S348 determines that FGPG is equal to or smaller than the high-concentration-side judgment value KFGPGH, it is judged that the vapor concentration in the purge gas is higher than normal, namely, the quantity of fuel vapors stored in the canister 22 is greater than normal. In this case, the map parameter SUMQMAP is set to B in step S352.

On the other hand, if step S346 determines that FGPG is equal to or greater than the low-concentration-side judgment value KFGPGL, it is judged that the vapor concentration in the purge gas is lower than normal, namely, the quantity of fuel vapors stored in the canister 22 is smaller than normal. In this case, the map parameter SUMQMAP is set to C in step S354.

When any one of steps S350, S352 and S354 is executed, step S356 is executed to determine whether SUMQMAP is set to A, B, or C.

If it is determined in step S356 that SUMQMAP is A (which is a map for normal vapor concentration), the target purge air quantity KSUMQPG which corresponds to the current total intake air quantity SUMGA is determined with reference to map A as shown in the block of step S358.

As shown in FIG. 18, the map A represents a standard relationship between the target total purge air quantity KSUMQPG and the total intake air quantity SUMGA, according to which KSUMQPG is set to a normal value based on SUMGA when the quantity of the fuel vapors stored in the canister 22 is normal.

If it is determined in step S356 that SUMQMAP is B (which is a map for high vapor concentration), the target purge air quantity KSUMQPG which corresponds to the current total intake air quantity SUMGA is determined with reference to the map B as shown in the block of step S360.

As shown in FIG. 18, the map B represents another relationship between the target total purge air quantity KSUMQPG and the total intake air quantity SUMGA, according to which KSUMQPG is set to a smaller value than the above-described normal value set in the map A. Thus, when the quantity of the fuel vapors stored in the canister 22 is large, the target purge air quantity KSUMQPG is set to a smaller value than the normal value.

When a large quantity of fuel vapors is stored in the canister 22, the quantity of fuel to be purged with the same purge air quantity is larger than that in the case where a standard or normal quantity of fuel vapors is stored in the canister 22. In such a case, if the target total purge air quantity KSUMQPG is set to a smaller value than normal, excessive purging of fuel vapors can be prevented or suppressed. With the evaporated fuel processing apparatus according to this embodiment, therefore, it is possible to efficiently purge the fuel in the canister 22 without causing excessive deviation of the air-fuel ratio from its target value even when a large quantity of fuel vapors is stored in the canister 22.

If it is determined in step S356 that SUMQMAP is C (which is a map for low vapor concentration), the target purge air quantity KSUMQPG is determined in step S362 with reference to the map C as shown in the block of step S362.

As shown in FIG. 18, the map C represents another relationship between the target total purge air quantity KSUMQPG and the total intake air quantity SUMGA, according to which KSUMQPG is set to a larger value than the above-described normal value set in the map A. Thus, when the quantity of the fuel vapors stored in the canister 22 is small, the target purge air quantity KSUMQPG is set to a larger value than the normal value.

When a small quantity of fuel vapors is stored in the canister 22, the quantity of fuel to be purged with the same purge air quantity is smaller than that in the case where a standard or normal quantity of fuel vapors is stored in the canister 22. In such a case, excessive deviation of the air-fuel ratio from its target value does not occur even if KSUMQPG is set to a greater value than normal. With the evaporated fuel processing apparatus according to the embodiment, therefore, it is possible to quickly purge the fuel without causing excessive deviation of the air-fuel ratio from its target value when a small quantity of fuel vapors is stored in the canister 22.

As describe above, according to the routine as shown in FIG. 18, the target total purge air quantity KSUMQPG is set to an appropriate value in step S358, S360, or S362, according to a map selected depending upon the fuel storage state in the canister 22. Since a negative decision (NO) is obtained in step S340, namely, "XSUMPGF=0" is not satisfied, in the next and subsequent cycles of this routine, only step S356 and the following steps are executed. In the next and subsequent cycles, therefore, the target total purge air quantity KSUMQPG is calculated according to the initially selected map A, B or C. Thus, with the evaporated fuel processing apparatus according to the twelfth embodiment, an appropriate map for determining the target total purge air quantity KSUMQPG is selected based on the fuel storage state of the canister 22 at the time of start of the purge control, and the target total purge air quantity KSUMQPG is determined according to the selected map, so as to achieve appropriate purge control depending upon the state of the canister 22.

In the twelfth embodiment as described above, the function of selecting a map for determining the target total purge air quantity KSUMQPG based on the fuel storage state of the canister 22 is incorporated in the evaporated fuel processing apparatus according to the eleventh embodiment. However, the invention is not limited to this combination of the embodiments, but the same function may be incorporated in the evaporated fuel processing apparatus according to another embodiment.

Thirteenth Embodiment

Next, a thirteenth embodiment of the invention will be described with reference to FIG. 19. This embodiment is realized by causing the ECU 52 of the evaporated fuel processing apparatus according to any one of the first through twelfth embodiments to execute a routine as shown in FIG. 19.

The total purge air quantity SUMQPG determined in the first through twelfth embodiments can be utilized as an indicator that represents the amount of fuel which has been purged from the canister 22, namely, as an indicator representing cleanness of the canister 22. In the meantime, fuel vapors generated in the fuel tank 10 are newly trapped by the canister 22 while purge control is interrupted or stopped. Accordingly, in order to utilize the total purge air quantity SUMQPG as an indicator representing the cleanness of the canister 22, it is necessary to take account of an influence of the fuel vapors newly trapped by the canister 22.

Figure 19:
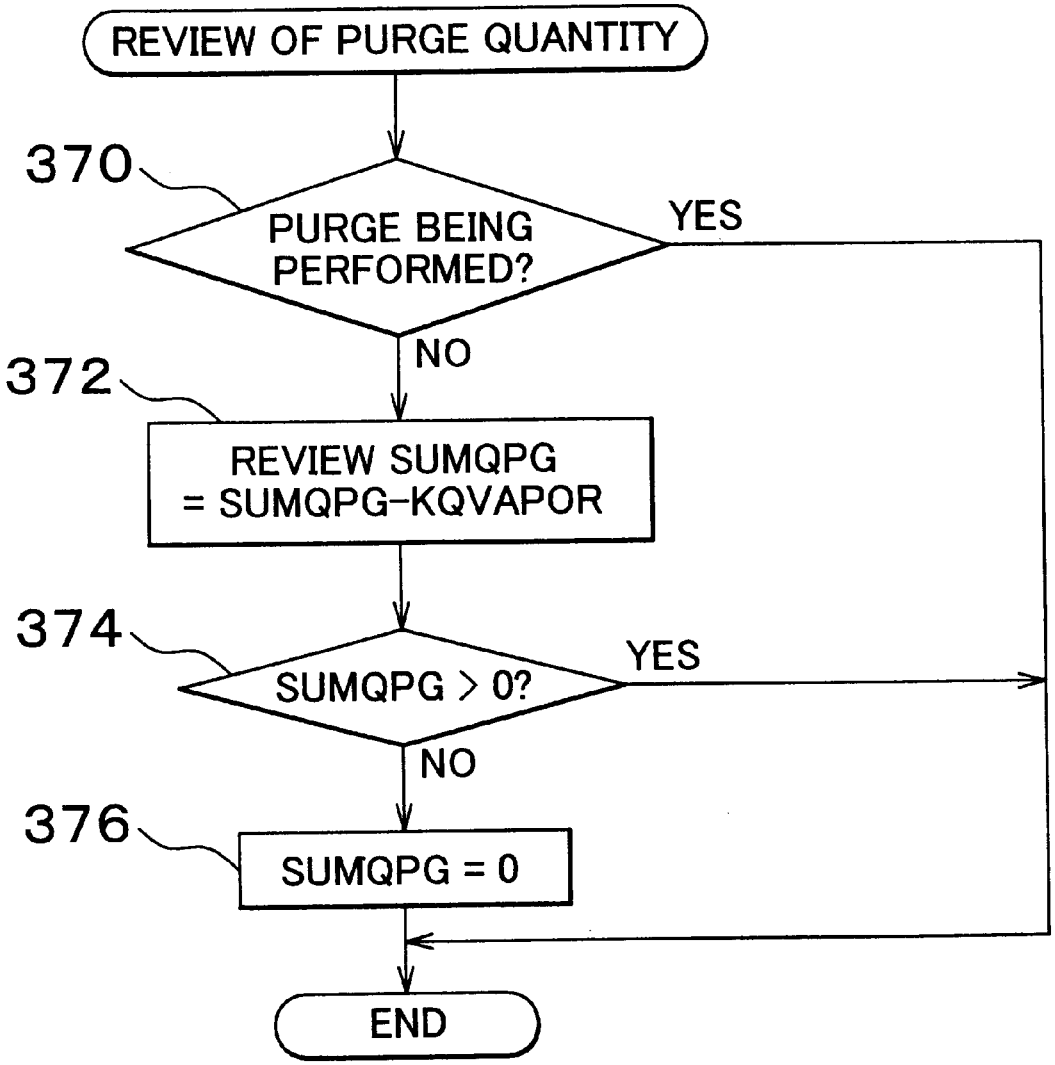
FIG. 19 is a flowchart showing a purge air quantity reviewing routine executed according to a thirteenth embodiment of the invention.

FIG. 19 is a flowchart showing a purge quantity reviewing routine to be executed by the ECU 52 so that the total purge air quantity SUMQPG reflects an influence of the fuel vapors newly trapped and stored in the canister 22.

In this routine, it is first determined in step S370 whether purge control is being preformed. Since fuel vapors are not newly trapped by the canister 22 during purge control, the present routine is finished without carrying out any further process if it is determined in step S370 that the purge control is being performed. Conversely, if it is determined that the purge control is not being performed, the total purge air quantity SUMQPG is modified or updated in step S372 according to the following expression:

$$SUMQPG(\text{modified})=SUMQPG(\text{current value})-KQVAPOR \quad (30)$$

When this calculation is finished, it is then determined in step S374 whether the modified value of the total purge air quantity SUMQPG is positive. If the modified value of SUMQPG is negative, SUMQPG is set to 0, which is a limit or guard value thereof, in step S376.

In the expression (30), "KQVAPOR" in the right side is a modification value (which will be referred to as "generated fuel vapor quantity") for modifying or updating SUMQPG, and KQVAPOR corresponds to an fuel adsorption quantity per unit time (cycle of repetition of this routine). According to the expression (30), the total purge air quantity SUMQPG is reduced by a quantity of fuel newly trapped by the canister 22 each time the routine is executed. According to the routine as shown in FIG. 19, therefore, it is possible to obtain the total purge air quantity SUMQPG that accurately reflects the fuel storage state of the canister 22.

As described above, according to the routine as shown in FIG. 19, the total purge air quantity SUMQPG is reduced by a quantity of fuel which is newly trapped by the canister 22 while the purge control is not performed. With the evaporated fuel apparatus according to the thirteenth embodiment, therefore, the total purge air quantity SUMQPG that accurately reflects the fuel storage state of the canister 22 can be obtained.

Fourteenth Embodiment

Next, a fourteenth embodiment of the invention will be described with reference to FIG. 20 and FIG. 21. In this embodiment, the ECU 52 of the evaporated fuel processing apparatus according to the eleventh or twelfth embodiment executes a routine as shown in FIG. 20 and further executes steps as shown in FIG. 21 to calculate the target total purge air quantity KSUMQPG.

Figure 20:
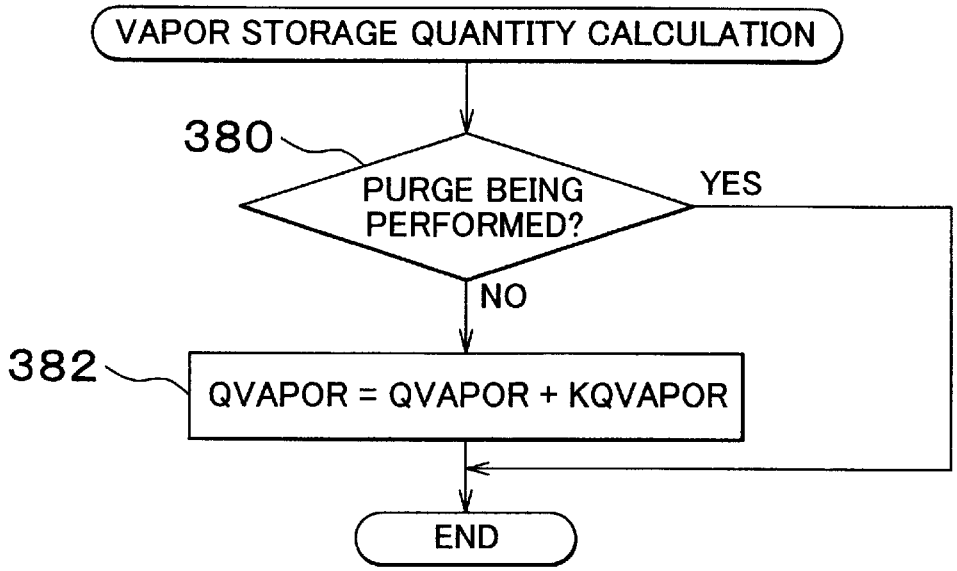
FIG. 20 is a flowchart showing a vapor storage quantity calculation routine executed according to a fourteenth embodiment of the invention.
Figure 21:
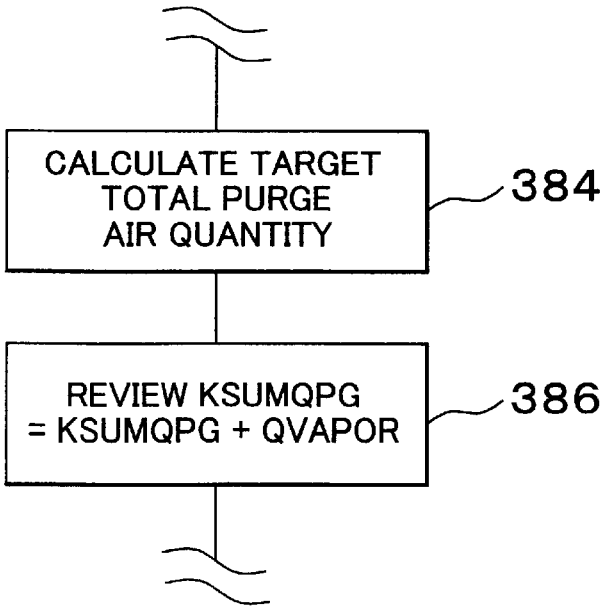
FIG. 21 is a flowchart showing a part of a routine for calculating a target total purge air quantity according to the fourteenth embodiment of the invention.

FIG. 20 is a flowchart of a fuel vapor storage quantity calculation routine to be executed by the ECU 52 for calculating a fuel vapor storage quantity QVAPOR that is a quantity of fuel vapor trapped by the canister 22 while the purge control is not performed. This routine is repeatedly executed at certain intervals.

In the routine as shown in FIG. 20, it is first determined in step S380 whether the purge control is being performed.

If it is determined in step S380 that the purge control is being performed, the present routine is immediately finished. Conversely, if it is determined that the purge control is not being performed, the fuel vapor storage quantity QVAPOR is calculated in step S382 according to the following expression (31), and then the present routine is finished:

$$QVAPOR(\text{updated value})=QVAPOR(\text{before updating})+KQVAPOR \quad (31)$$

"KQVAPOR" in the expression (31) represents the vapor quantity generated per unit time (i.e., cycle of repetition of this routine). In this routine, a total quantity of fuel adsorbed while the purge control is not performed is calculated as QVAPOR by adding KQVAPOR to the previous QVAPOR each time the routine is executed.

In the present embodiment, the ECU 52 first calculates the target total purge air quantity KSUMQPG in the same manner as in the eleventh or twelfth embodiment (refer to step S330 of FIG. 17 or S358, step S360, and step S362 of FIG. 18) in step S384.

Then, the calculated KSUMQPG is modified or updated in step S386 according to the following expression:

$$KSUMQPG(\text{modified value})=KSUMQPG(\text{present value})+QVAPOR \quad [32)$$

The target total purge air quantity KSUMQPG is a target value of the total purge air quantity SUMQPG set for purifying the canister 22. Therefore, in the case where the fuel is newly trapped by the canister 22, it is desirable to increase the target total purge air quantity KSUMQPG by an amount corresponding to the newly trapped fuel vapors. By adding the quantity of fuel vapors trapped by the canister 22 to the target total purge air quantity KSUMQPG calculated without taking new fuel adsorption into consideration according to the expression (32), the target total purge air quantity (modified) KSUMQPG which satisfies the above demand can be obtained. Accordingly, with the evaporated fuel processing apparatus of the fourteenth embodiment, the purge control is performed while accurately reflecting the fuel adsorption state of the canister 22.

While the function of modifying the target total purge air quantity KSUMQPG based on the amount of the newly adsorbed fuel is incorporated into the evaporated fuel processing apparatus of the eleventh or twelfth embodiment, the invention is not limited to these combination of the embodiments. For example, the above function may be incorporated into the apparatus of the tenth embodiment, such that the maximum value MAX and the minimum value MIN of the target total purge air quantity KSUMQPG are modified based on the amount of the newly adsorbed fuel.

Fifteenth Embodiment

Next, a fifteenth embodiment of the invention will be described with reference to FIG. 22 and FIG. 23. In this embodiment, the ECU 52 of the evaporated fuel processing apparatus according to the thirteenth embodiment executes a routine as shown in FIG. 22 instead of the routine as shown in FIG. 19, or the ECU 52 of the evaporated fuel processing apparatus according to the fourteenth embodiment executes a routine as shown in FIG. 23 instead of the routine as shown in FIG. 20.

In the thirteenth and fourteenth embodiments described above, the total purge air quantity SUMQPG or the target total purge air quantity KSUMQPG are reviewed and modified as needed based on the amount of fuel newly trapped by the canister 22 while purge control is not performed. The quantity of the fuel vapors trapped by the canister 22 while the purge control is not performed changes depending upon the quantity of fuel vapors generated within the fuel tank 10 In this embodiment, therefore, the generated fuel vapor quantity KQVAPOR used for modifying SUMQPG and KSUMQPG is set on the basis of the tank internal pressure PTNK.

Figure 22:
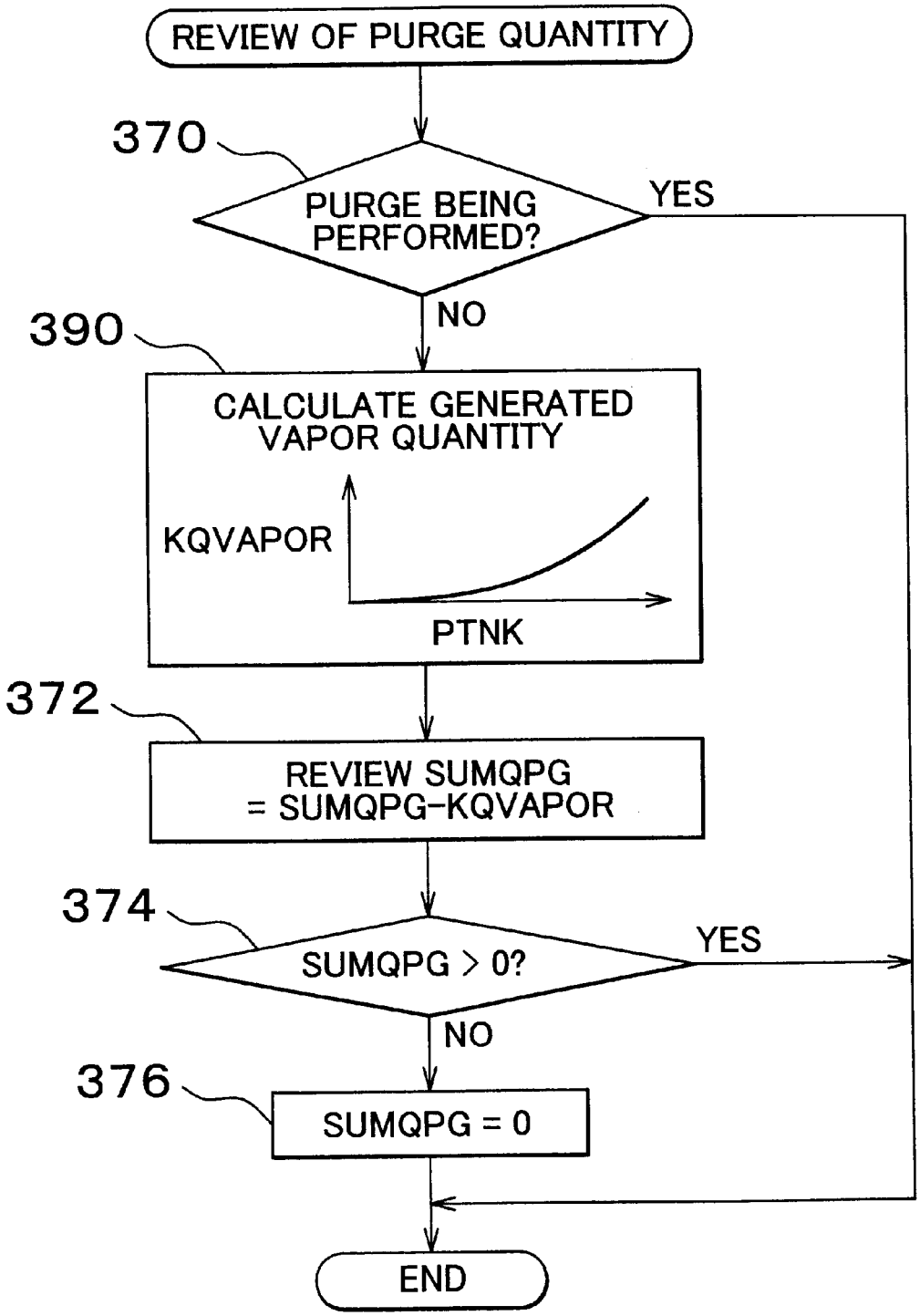
FIG. 22 is a flowchart showing a purge air quantity reviewing routine executed according to a fifteenth embodiment of the invention.
Figure 23:
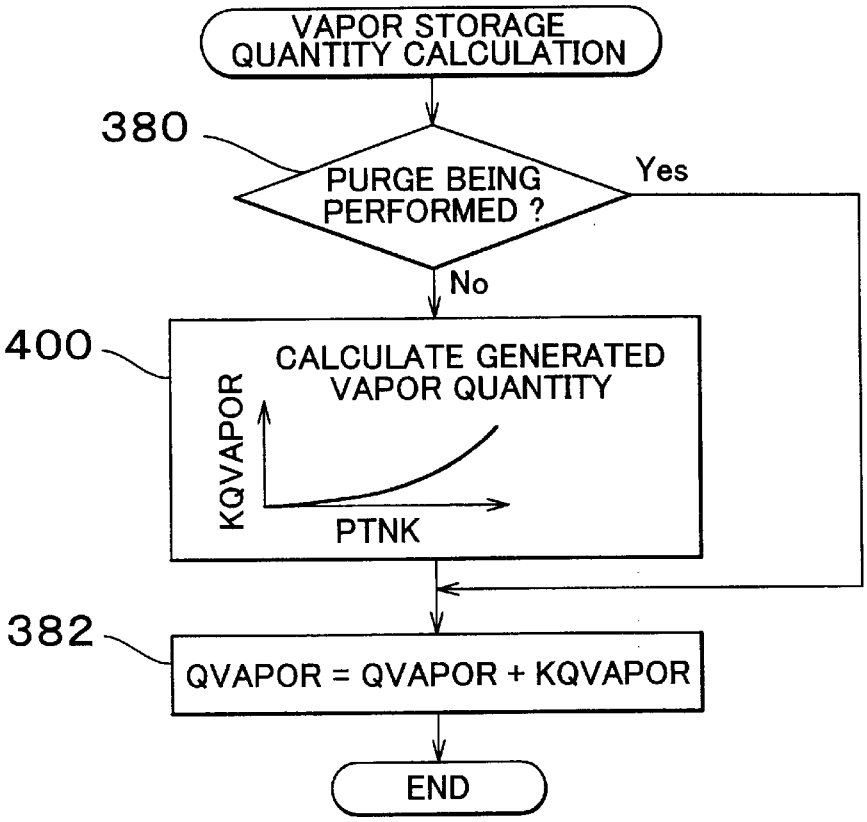
FIG. 23 is a flowchart showing a vapor storage quantity calculation routine executed according to the fifteenth embodiment of the invention.

FIG. 22 is a flowchart of a purge quantity reviewing routine to be executed to carry out the above-described process in the evaporated fuel processing apparatus of the thirteenth embodiment. In the routine as shown in FIG. 22, the generated fuel vapor quantity KQVAPOR is calculated based on the tank internal pressure PTNK in step S390, which precedes step S372 in which the total purge air quantity SUMQPG is reviewed and modified as needed.

The routine as shown in FIG. 22 is identical with that as shown in FIG. 19 except that step S390 is newly added. For the sake of brevity, those steps that are common to both of the routines shown in FIG. 19 and FIG. 22 will not be explained herein.

The ECU 52 stores a map as shown in the block of step S390, which map represents a relationship between the tank internal pressure PTNK and the generated fuel vapor quantity KQVAPOR. According to this map, the generated fuel vapor quantity KQVAPOR is determined in step S390. According to the routine as shown in FIG. 22, the total purge air quantity SUMQPG can be reviewed and modified as needed with high accuracy, based on the quantity of fuel vapors generated in the fuel tank 10.

FIG. 23 is a flowchart of a vapor adsorption quantity calculation routine to be executed to carry out the above-described process in the evaporated fuel processing apparatus of the fourteenth embodiment. In this routine, the generated vapor quantity KQVAPOR is determined based on the tank internal pressure PTNK in step S400, which precedes step S382 in which the vapor adsorption quantity QVAPOR is reviewed and modified as needed.

The routine as shown in FIG. 23 is identical with that as shown in FIG. 20 except step that S400 is newly added. For the sake of brevity, those steps that are common to both of the routines shown in FIG. 20 and FIG. 23 will not be explained herein.

The ECU 52 stores a map as shown in the block of step S400, which represents a relationship between the tank internal pressure PTNK and the generated fuel vapor quantity KQVAPOR. With reference to this map, the generated fuel vapor quantity KQVAPOR is determined in step S400. According to the routine as shown in FIG. 23, the vapor adsorption quantity QVAPOR can be calculated with high accuracy based on the quantity of fuel vapors that are actually generated in the fuel tank 10.

As described above, according to the routine as shown in FIG. 22, the total purge air quantity SUMQPG can be reviewed and modified with higher accuracy as compared with the case of the thirteenth embodiment. Furthermore, according to the routine as shown in FIG. 23, the vapor adsorption quantity QVAPOR can be reviewed and modified with higher accuracy as compared with the case of the fourteenth embodiment. Thus, the evaporated fuel processing apparatus according to the fifteenth embodiment exhibits higher control accuracy compared to the thirteenth or fourteenth embodiment.

Sixteenth Embodiment

Next a sixteenth embodiment of the invention will be described with reference to FIG. 24 and FIG. 25. In this embodiment, the ECU 52 of the evaporated fuel processing apparatus as shown in FIG. 1 further executes a routine as shown in FIG. 25.

In the first through fifteenth embodiments, when the purge control starts, the total purge air quantity SUMQPG starts being calculated from 0 as an initial value. In the ninth, tenth and eleventh embodiments, the control parameters are set based on the calculated total purge air quantity SUMQPG (refer to FIG. 15, FIG. 16, and FIG. 17). As described above, the control parameters may include the purge rate increment PGRSKP, maximum purge rate PGRMX, limit purge rate PGRLMT, maximum duty ratio DPGGD, and limit duty ratio increment DPGSKP, and so forth.

In these embodiments, assuming that the quantity of fuel vapors stored in the canister 22 decreases as the total purge air quantity SUMQPG increases, the above-indicated control parameters are set so that the purge rate is controlled to an appropriate value according to the vapor storage state of the canister 22. The rules of setting the control parameters are determined so as to be able to deal with the case where the canister 22 is filled with fuel vapors. In fact, the rules of setting are determined on the assumption that the canister 22 stores fuel vapors almost up to its full capacity at the time of a start of purge control.

However, the purge control does not always start in a condition that the canister 22 is filled with fuel vapors. In the ninth through eleventh embodiments, therefore, problems as follows may occur: purge is unnecessarily or excessively restricted, or the purge rate is set to an unnecessarily high value.

In the first through fifteenth embodiments, the above-described problems are caused by the fact that the calculated value of the total purge air quantity SUMQPG does not correspond to the adsorption or storage state of fuel vapors in the canister 22. Namely, the above problems occur in these embodiments due to the fact that increases and decreases in the total purge air quantity SUMQPG correspond to increases and decreases in the fuel vapor storage quantity in the canister 22 (namely, the total purge air quantity SUMQPG changes in relation to the fuel vapor storage quantity in the canister 22), but absolute quantities of these parameters do not correspond to each other.

In the sixteenth embodiment, therefore, the ECU 52 calculates the total purge air quantity SUMQPG such that an absolute quantity of SUMQPG corresponds to the absolute quantity of fuel vapors stored in the canister 22. Hereinafter, the thus calculated total purge air quantity SUMQPG will be referred to as "total purge air quantity SUMQPG as represented by an absolute quantity" or "absolute quantity of total purge air quantity SUMQPG".

In the sixteenth embodiment, the ECU 52 calculates the vapor concentration learning coefficient FGPG by using the result of the air-fuel feedback control. The FGPG decreases (which means that the vapor concentration increases) as the quantity of fuel vapors trapped in the canister 22 increases. Since the quantity of fuel vapors trapped in the canister 22 decreases as the total purge air quantity SUMQPG increases, the FGPG indicative of vapor concentration changes from a large value (low concentration) to a small value (high concentration) with an increase in the total purge air quantity SUMQPG.

Figure 24:
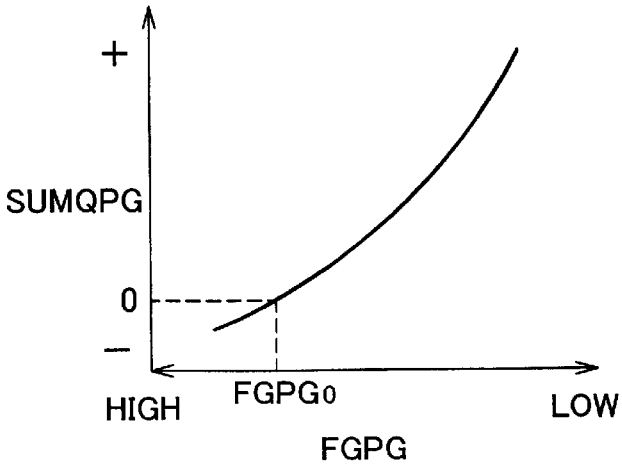
FIG. 24 is a graph showing linking data representing the relationship between the total purge air quantity SUMQPG and the vapor concentration learning coefficient FGPG, which data is used in a sixteenth embodiment of the invention.
Figure 25:
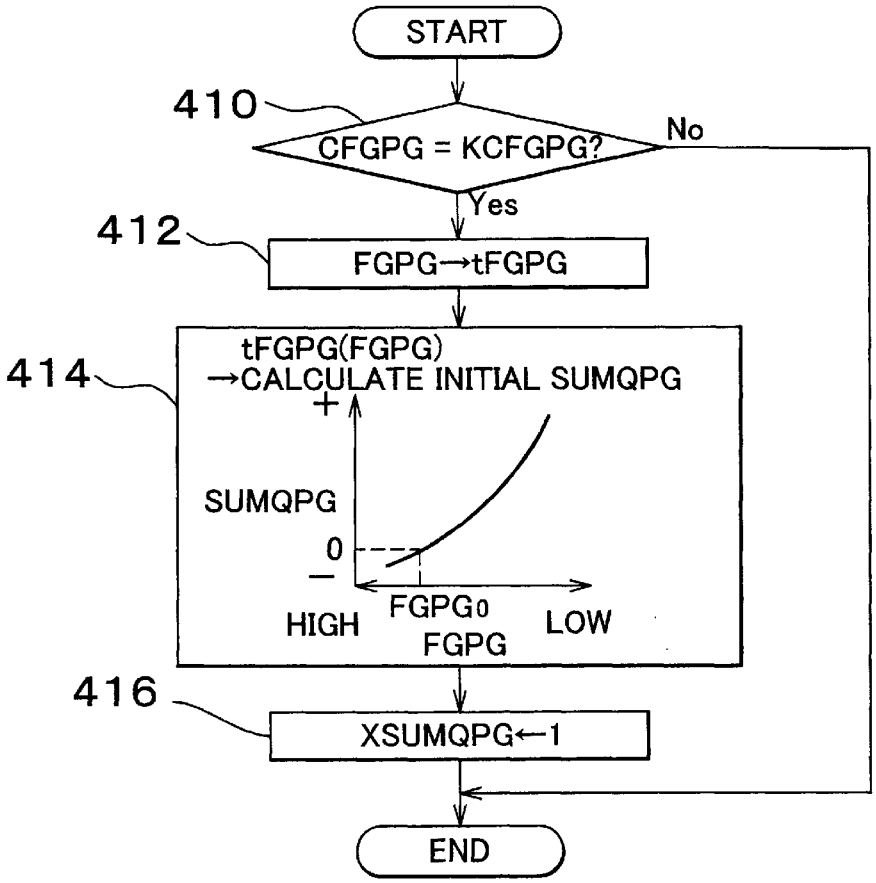
FIG. 25 is a flowchart showing a control routine executed according to the sixth embodiment of the invention.

The graph of FIG. 24 represents the above-described relative relationship between the vapor concentration learning coefficient FGPG and the total purge air quantity SUMQPG. This relationship may be determined in advance through experiments, simulation, or the like. If a reference value of the vapor concentration learning coefficient FGPG is set as FGPGO, and the total purge air quantity SUMQPG corresponding to the reference value FGPGO is set as 0, as shown in the graph of FIG. 24, the absolute values of the vapor concentration learning coefficient FGPG and the total purge air quantity SUMQPG can be associated with each other. Hereinafter, data that link the absolute quantities of these two parameters with each other will be called "linking data".

One of known methods for quantitatively determining the characteristics of a canister (e.g., canister 22) utilizes a so-called "breakthrough point" as a reference. The "breakthrough point" is defined as a point at which the weight of fuel vapors that pass through the ambient air inlet 24 of the canister 22 reaches 2 g when fuel vapors are kept supplied to the canister 22. In the sixteenth embodiment, the ECU 52 stores linking data with which the vapor concentration learning coefficient corresponding to the state (breakthrough state) of the canister 22 at the breakthrough point is set as the above-indicated reference value FGPG0.

When a vapor concentration learning coefficient FGPG is detected at a certain point of time, the linking data as described above makes it possible to determine a total purge air quantity required to change the canister 22 from the breakthrough state to the state at that point of time. Namely, upon detection of a vapor concentration learning coefficient FGPG at a certain point of time, the linking data makes it possible to obtain a total purge air quantity SUMQPG represented as an absolute quantity, which represents the state of the canister 22 at that point of time.

In FIG. 24, the vertical axis representing the total purge air quantity SUMQPG includes a negative region in which SUMQPG assumes a negative value. According to the linking data as shown in FIG. 24, the reference value FGPG0 established when the canister 22 is in the breakthrough state is associated with the total purge air quantity SUMQPG=0. However, a vapor concentration learning coefficient FGPG representing a lower concentration than the reference value FGPG0 may be detected in the case where the vapor adsorption or storage state of the canister 22 has not reached the breakthrough state. In this case, the vapor concentration learning coefficient FGPG needs to be associated with a negative value of SUMQPG that is smaller than 0. Thus, the negative region of the total purge air quantity SUMQPG as shown in FIG. 24 is provided for meeting such a requirement.

FIG. 25 is a flowchart showing a control routine to be executed by the ECU 52 for realizing the above-described functional features of this embodiment.

In this routine, it is first determined in step S410 whether the count value of the counter CFGPG has reached a judgement value KCFGPG.

As described above, the counter CFGPG counts the number of times the vapor concentration learning coefficient FGPG is updated after the start of purge control. The judgement value KCFGPG is set to a value (e.g. 10) for determining whether FGPG has reached a stable value or has entered a stable region (refer to FIG. 11).

While the determination as to whether FGPG has reached a stable value is made on the basis of the number of times of updating of FGPG after the start of the purge control in this embodiment, the same determination may be made in another manner. For example, it may be determined that FGPG has reached a stable value or region at a point of time when updating of the FGPG is performed a predetermined number of times after the FGPG that was decreasing starts increasing, as in the case of the seventh or eighth embodiment.

If it is determined in step S410 that the count value of the counter CFGPG has not yet reached the judgement value KCFGPG, it is judged that the vapor concentration learning coefficient FGPG at this point of time does not precisely represent the vapor adsorption or storage state of the canister 22. In this case, the present routine is finished at once. Conversely, if it is determined in step S410 that "CFGPG=KCFGPG" is true, the vapor concentration learning coefficient FGPG obtained at this point of time is then stored as a temporary value tFGPG of the vapor concentration learning coefficient in step S412.

Once the temporary value tFGPG is stored, step S414 is executed to calculate an initial value of the total purge air quantity SUMQPG as represented by an absolute quantity. As described above, the ECU 52 stores linking data that associate the vapor concentration learning coefficient FGPG with the total purge air quantity SUMQPG in terms of absolute quantities. In the above step S414, the total purge air quantity SUMQPG corresponding to tFGPG stored in step S412 is calculated, and the calculated value SUMQPG is set as an initial value of SUMQPG.

In the next step S416 of the routine of FIG. 25, a flag XSUMQPG is set to "1" to indicate that the initial value needed for representing the total purge air quantity SUMQPG as an absolute quantity has been calculated.

In the present embodiment. the ECU 52 calculates the total purge air quantity SUMQPG, using the value obtained in step S414 as the initial value, in the same manner as in the first through fifteenth embodiments. Thus, the total purge air quantity SUMQPG is calculated in this embodiment such that its absolute quantity always corresponds to the vapor adsorption or storage state of the canister 22. With the evaporated fuel processing apparatus according to this embodiment, therefore, the total purge air quantity SUMQPG as represented by an absolute quantity is utilized so as to achieve purge control that is highly accurately in accord with the actual vapor adsorption or storage state of the canister 22.

Seventeenth Embodiment

Next, a seventeenth embodiment of the invention will be described with reference to FIG. 26 through FIG. 28. In this embodiment, the ECU 52 of the evaporated fuel processing apparatus according to the sixteenth embodiment further executes a routine as shown in FIG. 27.

In the present embodiment, the ECU 52 updates the vapor concentration learning coefficient FGPG by executing the routine as shown in FIG. 3 while fuel vapors are being purged. As described above with reference to FIG. 3, when the air-fuel ratio correction coefficient FAF is continuously skipped (i.e., largely increased or reduced) three times or more in the same learning region, the vapor concentration learning coefficient FGPG is updated each time the FAF is skipped. Namely, with the evaporated fuel processing apparatus of this embodiment, updating of the vapor concentration learning coefficient FGPG is performed as long as the operating state of the internal combustion engine 30 is held stable enough to keep the intake air quantity GA within the same learning region while the FAF is skipped three times. In the case where the operating state of the internal combustion engine 30 changes frequently, therefore, the apparatus of this embodiment may suffer from a situation that the vapor concentration learning coefficient FGPG is not updated for a long period of time.

As in the case of the sixteenth embodiment, the ECU 52 of the evaporated fuel processing apparatus according to the seventeenth embodiment stores linking data that associates the vapor concentration learning coefficient FGPG with the total purge air quantity SUMQPG in terms of absolute quantities.

Figure 26:
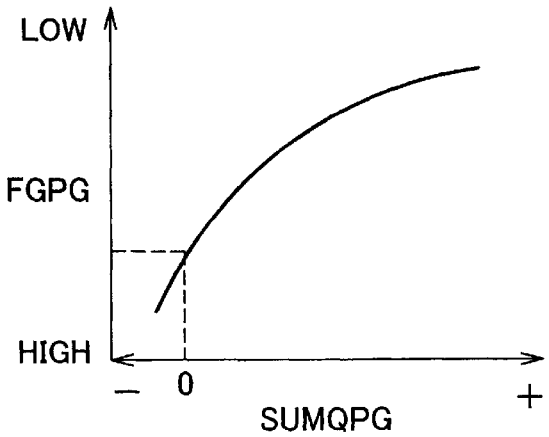
FIG. 26 is a graph showing linking data used in a seventeenth embodiment of the invention.
Figure 27:
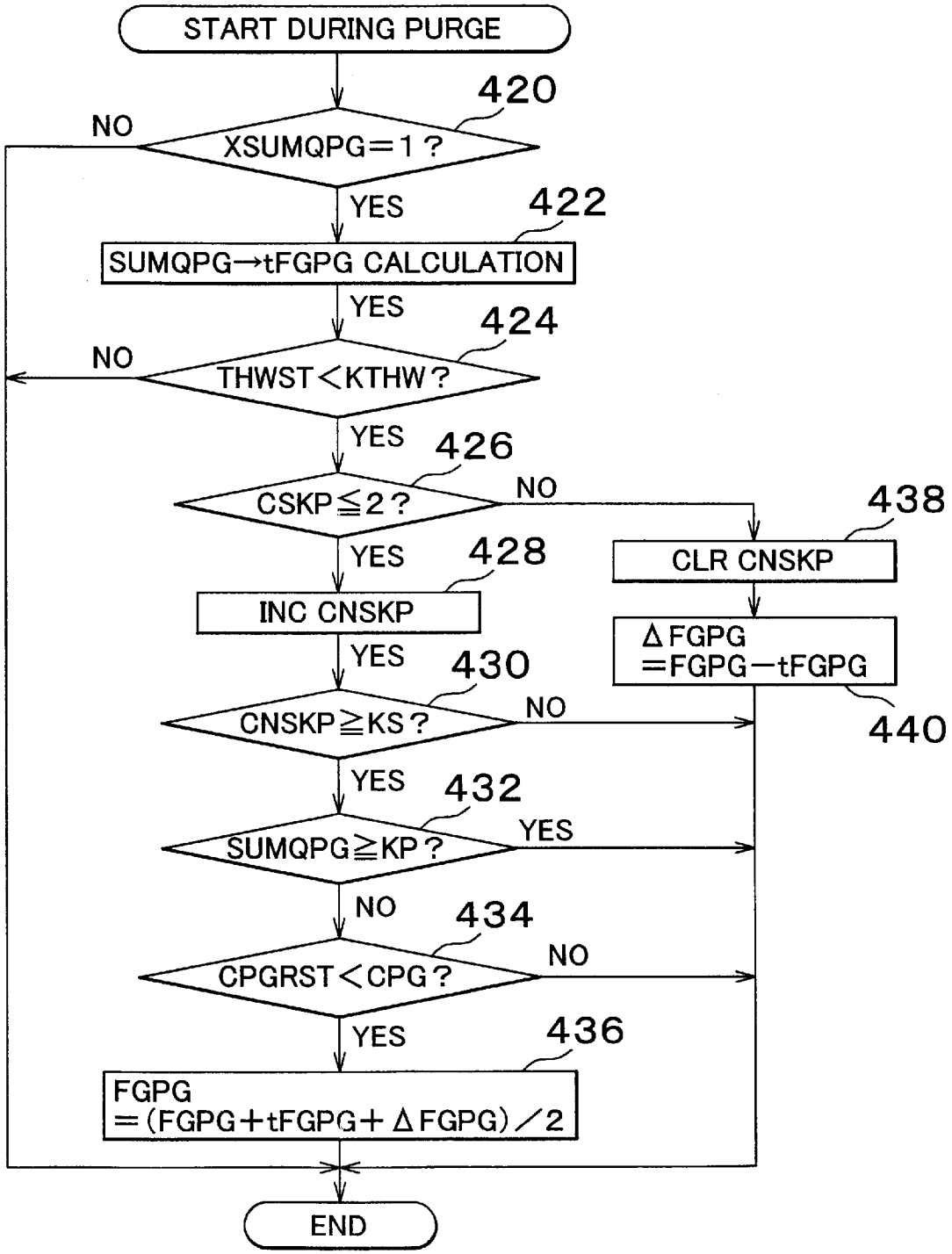
FIG. 27 is a flowchart showing a control routine executed according to the seventeenth embodiment of the invention.

In the graph of FIG. 26, the horizontal axis represents the total purge air quantity SUMQPG and the vertical axis represents the vapor concentration learning coefficient FGPG. In the sixteenth embodiment as described above, the absolute quantity of SUMQPG is calculated based on FGPG which has reached a stable value, with reference to the linking data. Once the absolute quantity of SUMQPG is calculated in this manner, it is possible to determine FGPG from SUMQPG in a reverse manner, referring to the linking data. In the seventeenth embodiment, therefore, if the vapor concentration learning coefficient FGPG is not updated for a long period of time according to the routine of FIG. 3, the temporary value of the vapor concentration learning coefficient tFGPG is estimated based on the calculated absolute quantity of SUMQPG, and the vapor concentration learning coefficient FGPG is modified or updated based on the estimated tFGPG.

FIG. 27 is a flowchart showing a routine to be executed by the ECU 52 for realizing the above-described functional features of this embodiment.

In the routine as shown in FIG. 27, it is first determined in step S420 whether the flag XSUMQPG is "1" so as to determine whether the initial value used for representing the total purge air quantity SUMQPG in terms of an absolute quantity has been calculated.

If it is determined in step S420 that "XSUMQPG=1" is not true, it is judged that the absolute quantity of SUMQPG has not been calculated. In this case, the present routine is finished at once. Conversely, if step S420 determines that "XSUMQPG=1" is true, the temporary value of the vapor concentration learning coefficient tFGPG corresponding to the absolute quantity of SUMQPG is next calculated in step S422, according to the linking data as shown in FIG. 26.

Then, it is determined in step S424 of FIG. 27 whether the temperature THWST at the time of a start of the engine is lower then a judgement value KTHW.

The engine start temperature THWST represents a coolant temperature THW as measured at the time of a start of the internal combustion engine 30. When the engine start temperature THWST is high, a large amount of fuel vapors may be generated in the fuel tank. As a result, the content of the linking data as described above may deviate from or disagree with the actual relationship established between the total purge air quantity SUMQPG and the vapor concentration learning coefficient FGPG. If there is a possibility of such deviation, updating of FGPG should not be carried out based on the linking data. For this reason, if the condition of step S424 is not satisfied, namely, if the engine start temperature THWST is equal to or higher than the judgement value KTHW, the present routine is finished without implementing any further process.

Conversely, if it is determined in step S424 that the engine start temperature THWST is lower than the judgement value KTHW, it is judged that fuel vapors are generated in the fuel tank 10 in a stable manner or condition, and therefore the actual relationship between FGPG and SUMQPG accurately coincides with the linking data. In this case, it is next determined in step S426 whether the count value of the skip counter CSKP is equal to or less than 2.

As described above with respect to the first embodiment, the skip counter CSKP counts the number of times the air-fuel ratio correction coefficient FAF is skipped (i.e., largely increased or decreased) when the air-fuel ratio shifts from the lean side to the rich side or vice versa while the intake air quantity GA remains in the same learning area. In the apparatus of this embodiment, when the count value of CSKP is equal to or larger than 3, the vapor concentration learning coefficient FGPG is updated each time the count value CSKP is incremented. Therefore, if the condition of step S426 (CSKP≦2) is satisfied in step S426, it is judged that the vapor concentration learning coefficient FGPG is not updated in the same timing as the current cycle of this routine. In this case, according to the routine as shown in FIG. 27, an invalid skip counter CNSKP is incremented in step S428, and it is thereafter determined in step S430 whether a count value of the counter CNSKP is equal to or greater than a judgement value KS.

The invalid skip counter CNSKP counts the number of times the air-fuel ratio correction coefficient FAF is successively skipped without causing updating of the vapor concentration learning coefficient FGPG. In this embodiment, therefore, when it is determined in step S430 that "CNSKP≧KS" is not true, it is judged that the time that has elapsed after the last updating of FGPG in a normal manner (i.e., the manner as indicated in FIG. 3) is not so long as to cause a large change to the value FGPG. In this case, the present routine is finished without executing any further process.

Conversely, when it is determined in step S430 that "CNSKP≧KS" is true, it is judged that a sufficiently long time has elapsed after FGPG was updated in the normal manner. In this case, it is determined in step S432 whether the absolute total purge air quantity SUMQPG is equal to or larger than a judgement value KP.

In an early stage of purge control where the canister 22 still stores a large amount of fuel vapors, the vapor concentration learning coefficient FGPG largely changes. However, the vapor concentration learning coefficient FGPG does not undergo rapid, great changes as the purge control proceeds and the quantity of fuel vapors stored in the canister 22 decreases. Therefore, when it is determined in step S432 that the total purge air quantity SUMQPG is equal to or greater than the judgement value KP, it is judged that FGPG does not undergo great changes even if FGPG has not been updated for a certain period of time. In this case, therefore, the present routine is finished without executing any further process as shown in FIG. 27.

Conversely, if it is determined that "SUMQPG≧KP" is not true, namely, if the total purge air quantity SUMQPG is smaller than the judgement value KP, it is judged that the vapor concentration learning coefficient FGPG may undergo a considerable change as SUMQPG increases. In this case, it is then determined in step S434 whether a count value of a total purge time counter CPGRST is less than a judgement value CPG.

The total purge time counter CPGRSRT counts time elapsed since the start of the purge control. As described above, FGPG largely changes in the early stage of the purge control, but does not show sudden, great changes as time elapses. Thus, if it is determined in step S434 that "CPGRST<CPG" is not true, namely, if the total purge time is equal to or greater than the judgement value CPG, it is judged that FGPG does not undergo great changes even if it is not updated for a certain period of time. In this case, therefore, the present routine is finished without executing any further process.

Conversely, when it is determined in step S434 that "CPGRST<CPG" is true, it is judged that the vapor concentration learning coefficient FGPG may undergo a considerable change as the total purge air quantity SUMQPG increases. In this case, the vapor concentration learning coefficient FGPG is calculated according to the following expression in step S436:

$$FGPG=(FGPG+tFGPG+\Delta FGPG)/2 \quad (33)$$

In the expression (33), "FGPG" in the right side is the vapor concentration learning coefficient FGPG that was most recently calculated in the normal manner (as shown in FIG. 3). "tFGPG" as the second term of the right side is the temporary value tFGPG of the vapor concentration learning coefficient obtained in step S422. Lastly, ΔFGPG as the third term of the right side is a deviation used for removing accumulated errors in the tFGPG. The deviation ΔFGPG will later be described in detail.

In the expression (33), the latest vapor concentration learning coefficient FGPG calculated in the normal manner is corrected using the temporary value of the vapor concentration learning coefficient tFGPG estimated based on SUMQPG and the deviation ΔFGPG. In this manner, it is possible to correct or update FGPG, which has not been updated for a long period of time and is thus deviated from an actual state, to a value that matches the actual state with improved accuracy.

In the routine as shown in FIG. 27, if it is determined in step S426 that "CSKP≦2" is not true, namely, if it is determined that FGPG is updated in the same timing as the current cycle of this routine, the invalid skip counter CNSKP is cleared in step S438.

In the next step S440, the deviation ΔFGPG is calculated by subtracting tFGPG calculated in step S422 from FGPG updated in the same timing as the current cycle of the routine according to the following expression (34):

$$\Delta FGPG=FGPG-tFGPG \quad (34)$$

As described above, the deviation ΔFGPG calculated in step S440 is used for calculating a corrected value of FGPG in the process of step S436. After execution of step S440, the present routine is finished without further executing a process for correcting or updating FGPG, assuming that the FGPG updated in the same timing as this cycle is an appropriate value.

Figure 28:
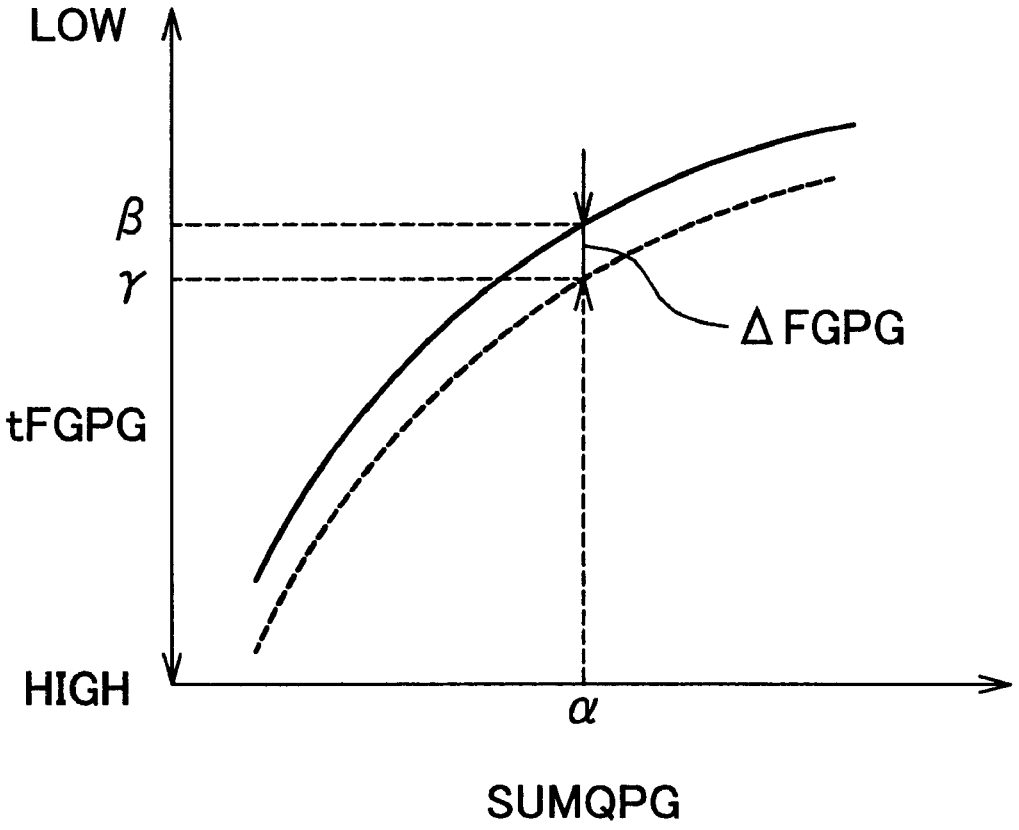
FIG. 28 is a graph useful for explaining a deviation ΔFGPG used in the seventeenth embodiment of the invention.

FIG. 28 is a graph for explaining the physical meaning of the deviation ΔFGPG calculated in step S440 In FIG. 28, the solid curved line represents the above-described linking data stored in the ECU 52, and the dashed curved line represents the actual relationship established between the absolute quantity of SUMQPG and FGPG in the apparatus of the present embodiment.

The linking data is determined on the assumption that the canister 22 shows an ideal vapor release characteristic. With the actual system, however, the vapor release characteristic of the canister 22 may vary due to differences among individual canisters or an increase or a decrease in the temperature, and the relationship between SUMQPG and FGPG may deviate from the relationship as specified by the linking data, due to the variations in the vapor release characteristic.

When a deviation exists between the actual relationship and the linking data as shown in FIG. 28, the value of tFGPG corresponding to the total purge air quantity SUMQPG=α as calculated in step S422 is equal to β. In this case, however, the proper value for correcting FGPG in the process of step S436 is not β but γ that actually corresponds to α, as shown in FIG. 28. Namely, the proper value of tFGPG for correcting FGPG is obtained by subtracting (β−γ) from β, that is, by adding (γ−β) to β.

The value of FGPG obtained immediately after updating according to the manner as shown in FIG. 3 accurately corresponds to the value of SUMQPG at the time of updating, and is therefore equivalent to the above-indicated value γ. Accordingly, the deviation ΔFGPG calculated according to the above expression (34) corresponds to (γ−β), which in turn corresponds to errors accumulated in the temporary value of the vapor concentration learning coefficient tFGPG. Thus, in step S436, the vapor concentration learning coefficient FGPG can be appropriately corrected by calculating an average value of FGPG (the first term of the right side) that has not been updated for a long period of time and tFGPG from which the deviation is removed (the second and third terms of the right side).

Eighteenth Embodiment

Figure 29:
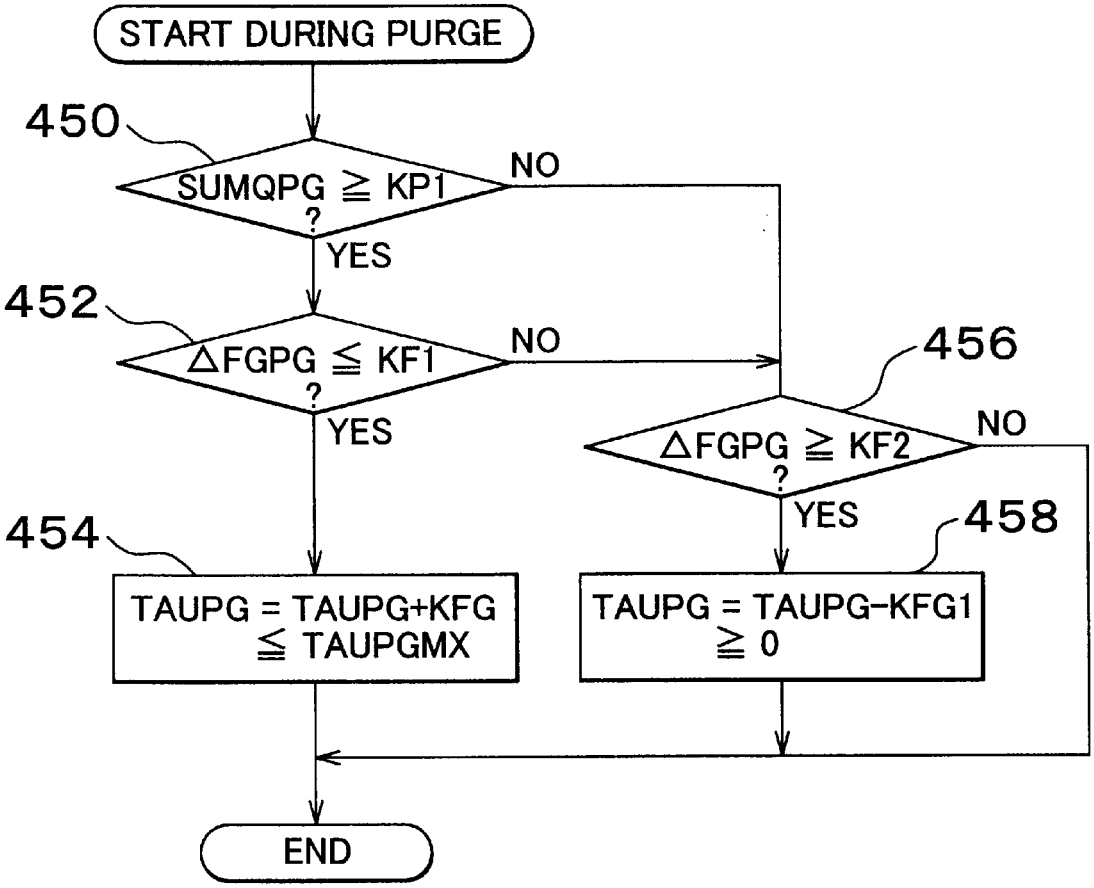
FIG. 29 is a flowchart showing a control routine executed according to an eighteenth embodiment of the invention.
Figure 30:
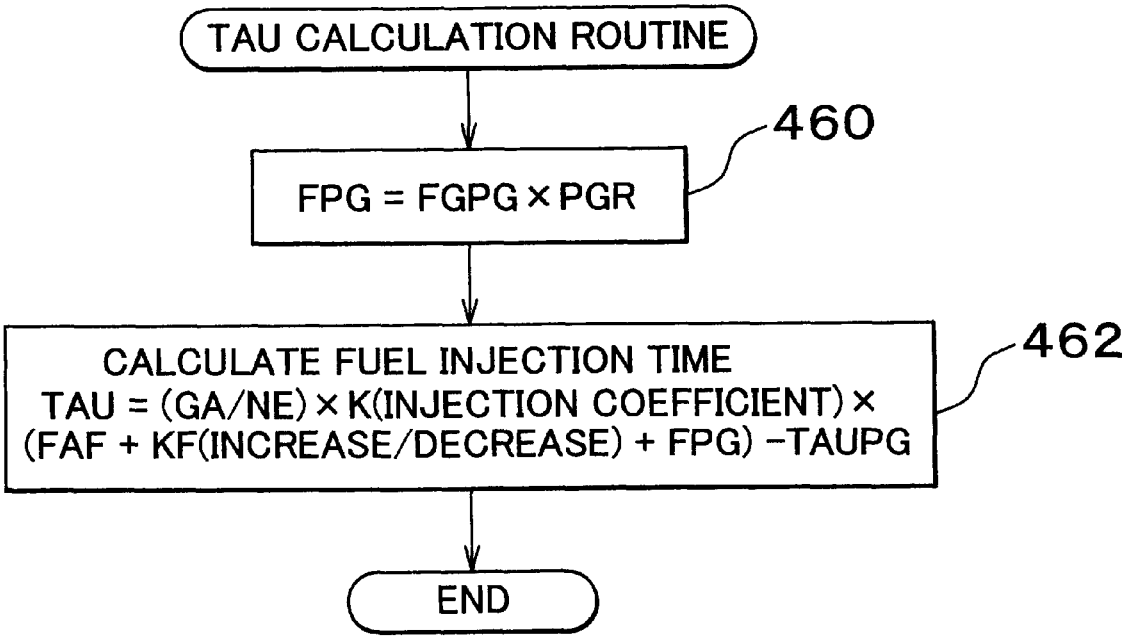
FIG. 30 is a flowchart showing a TAU calculation routine executed according to the eighteenth embodiment of the invention.

Next, an eighteenth embodiment of the invention will be described with reference to FIG. 29 and FIG. 30. In this embodiment, the ECU 52 of the evaporated fuel processing apparatus according to the seventeenth embodiment further executes a routine as shown in FIG. 29 and a routine as shown in FIG. 30 instead of the above-described routine (TAU calculation routine) as shown in FIG. 4.

As described above, each of the evaporated fuel processing apparatuses according to the first through seventeenth embodiments controls the duty cycle of the purge control valve 28 so as to achieve a desired purge rate PGR, and corrects the fuel injection duration TAU in a decreasing direction, using the purge correction coefficient FPG obtained by multiplying the vapor concentration learning coefficient FGPG with the page rate PGR. According to these controls, the air-fuel ratio can be controlled with high accuracy, regardless of changes in the intake air quantity GA, under a circumference where the vapor concentration does not rapidly change, namely, under a circumstance where the vapor concentration learning coefficient FGPG is not required to rapidly change.

When a large amount of fuel vapors are trapped in the canister 22, purge gas having a high vapor concentration passes through the vapor passage 26, irrespective of the quantity of fuel vapors generated in the fuel tank 10. In this case, therefore, the vapor concentration in the purge gas generally corresponds to the fuel vapor storage state of the canister 22.

Even when a small amount of fuel vapors are trapped in the canister 22, the vapor concentration in the purge gas is not influenced by fuel vapors generated in the fuel tank 10 as long as the quantity of the generated fuel vapors is small. In this case, too, the vapor concentration in the purge gas generally corresponds to the fuel vapor storage state of the canister 22.

However, when a small amount of fuel vapors are trapped in the canister 22 while a large amount of fuel vapors are being generated within the fuel tank 10, the vapor concentration in the purge gas changes depending on the quantity of the purge gas and does not uniquely correspond to the fuel vapor storage state of the canister 22. An example of this case will be hereinafter described.

For example, the quantity of purge gas passing through the vapor passage 26 at a certain point of time is equal to 2q0. At this moment, q0 of air is introduced into the canister 22 through the ambient air inlet 24, and q0 of fuel vapors flow into the canister 22 through the vapor passage 18. In this case, q0 of the introduced air is mixed with the fuel vapors in the canister 22 to create purge gas. The resulting purge gas has a relatively low fuel vapor concentration, which corresponds to or represents the fuel vapor storage state of the canister 22. On the other hand, purge gas produced from the fuel vapors fed from the vapor passage 18 through the canister 22 has a relatively high fuel vapor concentration. In this case, the low-vapor-concentration purge gas is mixed with the high-vapor-concentration purge gas at the ratio of 1:1 to provide a finial vapor concentration.

If the quantity of the overall purge gas increases from 2q0 to 4q0 in the above-described circumstances, the quantity of fuel vapors flowing into the canister 22 through the vapor passage 18 does not significantly change since the quantity of evaporated fuel generated in the fuel tank 10 does not significantly change. In such a case, the quantity of the air introduced through the ambient air inlet 24 is increased from q0 to 3q0 to make up for the increase in the quantity of the overall purge gas. In this case, therefore, the low-vapor-concentration purge gas is mixed with the high-vapor-concentration purge gas at the ratio of 3:1 to provide a finial vapor concentration.

As shown in the above example, when the quantity of fuel vapors trapped in the canister 22 is small while a large quantity of fuel vapors are being generated in the fuel tank 10, the vapor concentration in the purge gas greatly changes in accordance with changes in the quantity of the overall purge gas. In the evaporated fuel processing apparatuses according to the first through seventeenth embodiments as described above, therefore, the vapor concentration in the purge gas may change by a large degree if the quantity of the purge gas changes with a change in the intake air quantity GA. With the vapor concentration thus changed in the first through seventeenth embodiments, the air-fuel ratio is likely to largely fluctuate until the above change in the vapor concentration is reflected by the purge correction coefficient FPG.

For preventing or reducing such fluctuations in the air-fuel ratio, it is desirable to separately deal with an influence of fuel vapors generated in the fuel tank 10 (which will be referred to as "tank-originated vapors") and an influence of fuel vapors released from the canister 22 into the purge gas (which will be referred to as "canister-originated vapors") on the above-described final vapor concentration. It is also desirable to make separate corrections to the fuel injection duration TAU so as to remove those influences, respectively. In the eighteenth embodiment, therefore, a correction coefficient TAUPG for removing the influence of the tank-originated vapors is calculated in addition to the correction coefficients (FGPG, FPG) for removing the influence of the canister-originated vapors, and the fuel injection duration TAU is corrected using the correction coefficient TAUPG.

FIG. 29 is a flowchart showing a routine to be executed by the ECU 52 for calculating the correction coefficient TAUPG used for removing the influence of the tank-originated fuel vapors.

In the routine as shown in FIG. 29, it is first determined in step S450 whether the total purge air quantity SUMQPG as represented as an absolute quantity is equal to or greater than a judgement value KP1.

As described above, the influence of the tank-originated fuel vapors cannot be ignored when the quantity of fuel vapors trapped in the canister 22 is small. When it is determined in step S450 that "SUMQPG≧KF1" is true, the quantity of the fuel vapors trapped in the canister 22 is judged as being small and it is thus highly necessary to make a correction for removing the influence of the tank-originated fuel vapors. In this case, it is then determined in step S452 whether the deviation ΔFGPG is equal to or smaller than a first judgement value KF1.

As described above with respect to the sixteenth embodiment, the deviation ΔFGPG is obtained by subtracting tFGPG estimated based on SUMQPG, from FGPG updated in a normal manner as shown in FIG. 3, namely, is represented as (FGPG−tFGPG) (refer to step S440 of FIG. 27). In the case where the tank-originated fuel vapors are contained in the purge gas, FGPG is updated to a smaller value so as to remove the influence of the tank-originated vapors. On the other hand, tFGPG is calculated such that its absolute quantity matches the vapor storage state of the canister 22, namely, tFGPG is not influenced by changes in the quantity of the tank-originated vapors contained in the purge gas. Accordingly, ΔFGPG represents a physical quantity that is reduced to a further small value (negative value) as the influence of the tank-originated fuel vapors increases.

The first judgement value KF1 used in step S452 is a negative value set for determining whether the influence of the tank-originated fuel vapors is too large to be ignored. Hence, if it is determined in step S452 that "ΔFGPG≦KF1" is true, it is judged that a considerably large quantity of the tank-originated fuel vapors are being generated. In this case, the correction coefficient TAUPG is calculated according to the following expression in step S454 as shown in FIG. 29:

$$TAUPG=TAUPG+KFG\leqq TAUPGMX \tag{35}$$

In the expression (35), "TAUPG" in the left side is an updated value, and "TAUPG" in the right side is a value before being updated. "KFG" in the right side is a step value to be added to "TAUPG" prior to updating. "TUAPGMX" in the right side is a limit or guard value for defining the maximum value of "TAUPG".

As described above, according to the above-described process, when the tank-originated fuel vapors have a considerable influence on FGPG, the correction coefficient TAUPG is updated to a larger value as far as it does not exceed the limit value TAUPGMX, so as to remove the influence of the tank-originated fuel vapors.

In the routine as shown in FIG. 29, when it is determined in step S450 that "SUMQPG≧KP1" is not true, namely, the total purge air quantity SUMQPG is small than the first judgement value KP1, it is judged that the quantity of the fuel vapors trapped in the canister 22 is not so small. In this case, it is not necessary to increase the correction coefficient TAUPG for removing the influence of the tank-generated fuel vapors. Likewise, if it is determined in step S452 that "ΔFGPG≦KF1" is not true, it is judged as unnecessary to increase TAUPG. In both cases described above, it is then determined in step S456 whether ΔFGPG is equal to or greater than a second judgement value KF2.

The second judgement value KF2 is a positive value set for determining whether the correction coefficient TAUPG is an excessively large value. The relationship of "ΔFGPG≧KF2" is only established when FGPG updated based on the air-fuel ratio is greater than tFGPG which represents the fuel vapor storage state in the canister 22, that is, when the value of the correction coefficient TAUPG is excessively large with respect to the quantity of fuel vapors actually generated in the fuel tank.

If it is determined in step S456 that "ΔFGPG≧KF2" is not true, the present routine is finished without implementing any further process. Conversely, if it is determined in step S456 that "ΔFGPG≧KF2" is true, the correction coefficient TAUPG is reduced according to the following expression in step S458:

$$TAUPG=TAUPG-KFG1\geqq 0 \quad (36)$$

In the expression (36), "TAUPG" in the left side is an updated value, while "TAUPG" in the right side is a value before being updated. "KFG1" in the right side is a step value to be subtracted from "TAUPG" in the right side for updating the "TAUPG". "0" is a limit or guard value for defining the minimum value of TAUPG.

As described above, according to the above-described process, when the correction coefficient TAUPG is excessively large with respect to the quantity of the tank-originated fuel vapors, TAUPG is reduced to an appropriate value as far as it does not become smaller than 0. In the routine as shown in FIG. 29, therefore, the correction coefficient TAUPG can be appropriately increased or reduced depending upon the magnitude of the influence of the tank-originated fuel vapors.

FIG. 30 is a flowchart showing a routine to be executed by the ECU 52 for calculating the fuel injection duration TAU.

In this routine of FIG. 30, the purge correction coefficient FPG is first calculated in step S460 in the same manner as in step S180 of FIG. 4 according to the above-indicated described expression (14).

Next, the fuel injection duration TAU is calculated according to the following expression in step S462:

$$TAU=(GA/NE)\times K\times(FAF+KF+FPG)-TAUPG \quad (37)$$

The expression (37) is identical with the expression (15) used in the first embodiment, except that a subtraction term "−TAUPG" is added to the right side.

In the expression (37), the fuel injection duration TAU is appropriately reduced based on the correction coefficient TAUPG, and, by doing so, the influence of the tank-originated fuel vapors is removed from TAU independently of the influence of the canister-originated fuel vapors. With the evaporated fuel processing apparatus according to this embodiment, therefore, even when the vapor concentration in the purge gas rapidly changes due to the influence of the tank-originated fuel vapors, the air-fuel ratio can be controlled with high accuracy, in accordance with the change in the vapor concentration.

Nineteenth embodiment

Next, a nineteenth embodiment of the invention will be described with reference to FIG. 31. In this embodiment, the ECU 52 of the evaporated fuel processing apparatus according to the eighteenth embodiment executes a routine as shown in FIG. 31, instead of the routine as shown in FIG. 29.

Figure 31:
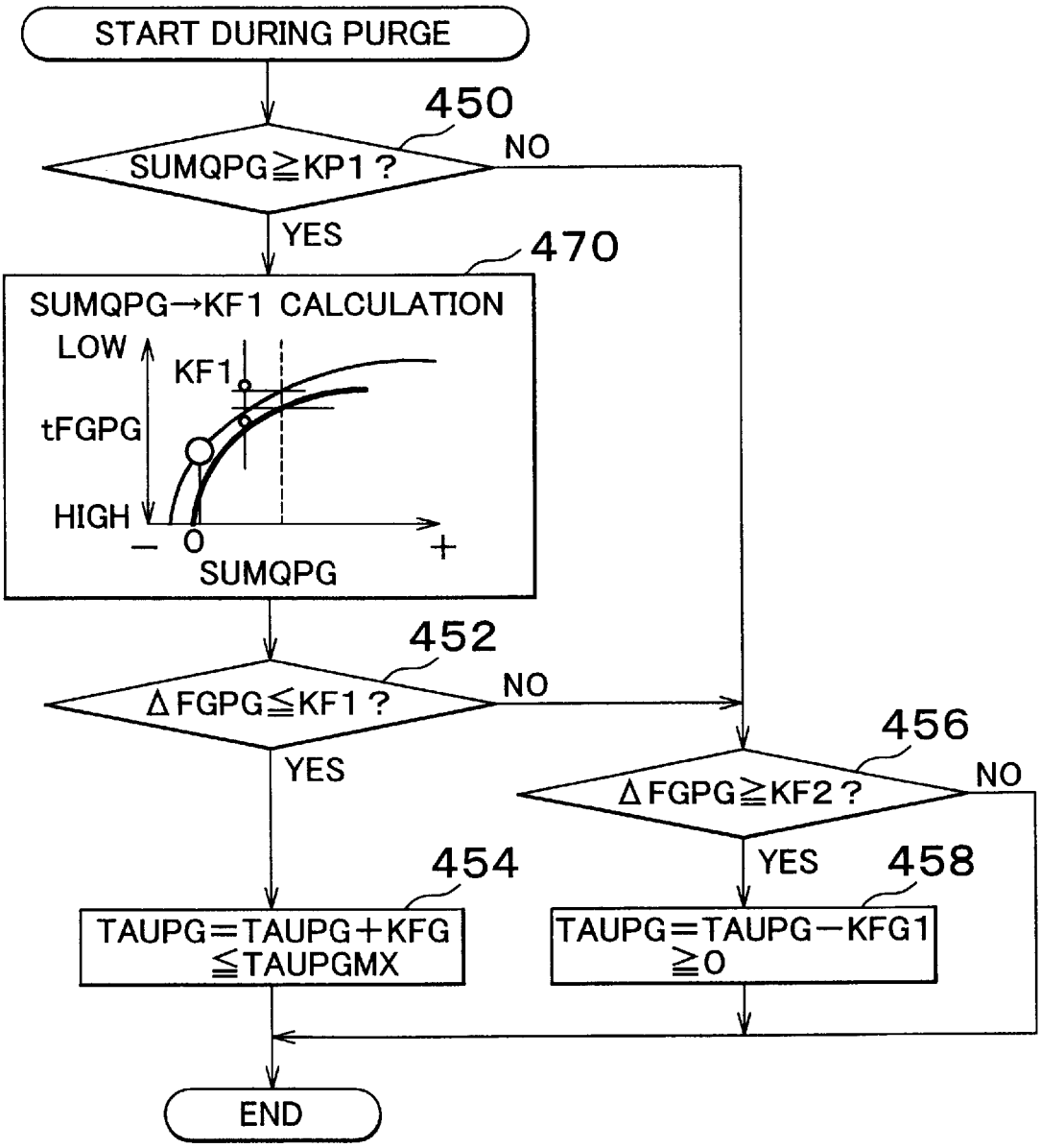
FIG. 31 is a flowchart showing a control routine executed according to a nineteenth embodiment of the invention.

The routine as shown in FIG. 31 is identical with the routine shown in FIG. 29 except that step S470 is added between step S450 and step S452. Steps that are common to the routine of FIG. 31 and the routine of FIG. 29 will be referred to by the same reference numerals, and will not be described in detail.

In the routine as shown in FIG. 31, if it is determined in step S450 that "SUMQPG≧KP1" is true, the first judgement value KF1 is then calculated based on the total purge air quantity SUMQPG in step S470.

As described above with respect to the eighteenth embodiment, the first judgement value KF1 is defined as a value to be compared with the deviation ΔFGPG for determining whether the influence of the tank-originated fuel vapors is too large to be ignored. When the total purge air quantity SUMQPG is in a relatively small region, FGPG is likely to rapidly change, and therefore the absolute value of ΔFGPG (negative value) tends to be large even in the absence of the influence of the tank-originated fuel vapors. Conversely, when SUMQPG is relatively large, the absolute value of ΔFGPG (negative value) does not become so large as long as the influence of the tank-originated fuel vapors does not exist. It is thus desirable to set the first judgement value KF1 to an appropriate value corresponding to SUMQPG, in order to determine the presence or absence of the influence of the tank-originated fuel vapors based on ΔFGPG.

Referring again to FIG. 31, the ECU 52 stores linking data (thin line) that represents the basic relationship between SUMQPG and FGPG, and boundary data (bold line) used for determining the existence of the influence of the tank-originated fuel vapors. With reference to these two types of data, the judgement value KF1 corresponding to the SUMQPG is calculated in step S470.

Subsequently, step S452 and S454 are executed in the same manner as in the eighteenth embodiment as described above. Consequently, the evaporated fuel processing apparatus according to the nineteenth embodiment is able to control the fuel injection duration TAU with high accuracy, by removing the influence of the tank-originated fuel vapors and the influence of the canister-originated fuel vapors, separately, from the TAU, regardless of the total purge air quantity SUMQPG, i.e., over the entire region of the SUMQPG. Thus, the evaporated fuel processing apparatus according to the nineteenth embodiment is able to control the air-fuel ratio with further improved accuracy, as compared with the apparatus of the eighteenth embodiment.

What is claimed is:

1. An evaporated fuel processing apparatus for an internal combustion engine, comprising:

a canister that traps fuel vapors generated in a fuel tank;

a purge control valve disposed between the canister and an intake passage of the internal combustion engine; and a controller that:

determines a quantity of purge gas that passes through the purge control valve;

determines a fuel injection amount correction coefficient for eliminating a deviation of an actual air-fuel ratio from a target air-fuel ratio due to the purge gas;

determines a fresh air ratio that represents a ratio of purge air contained in the purge gas to the purge gas, based on the fuel injection amount correction coefficient;

determines a quantity of the purge air based on the quantity of the purge gas and the fresh air ratio; and controls the internal combustion engine based on the quantity of the purge air.

2. The evaporated fuel processing apparatus according to claim 1, further comprising a tank pressure sensor that detects an internal pressure of the fuel tank, wherein the controller determines the fresh air ratio based on the fuel injection amount correction coefficient and the internal pressure of the fuel tank.

3. The evaporated fuel processing apparatus according to claim 1, wherein:

the controller comprises a duty driving unit that drives the purge control valve at a desired duty cycle; and the controller determines the quantity of the purge air based on basic data acquired at an intermediate point of the duty cycle.

4. The evaporated fuel processing apparatus according to claim 1, wherein:

the controller comprises a duty driving unit that drives the purge control valve at a desired duty cycle; and the controller determines the quantity of the purge air, based on an average value of basic data acquired at a time when the purge control valve switches from an ON position to an OFF position, and basic data acquired at a time when the purge control valve switches from the OFF position to the ON position.

5. The evaporated fuel processing apparatus according to claim 1, wherein:

the controller comprises a duty driving unit that drives the purge control valve at a desired duty cycle; and the controller acquires basic data for determining the quantity of the purge air at calculation points of time that are reached every two or more duty cycles, and determines the quantity of the purge air, based on an average value of the basic data acquired at two adjacent ones of the calculation points.

6. The evaporated fuel processing apparatus according to claim 1, wherein:

the controller further determines a total purge air quantity by summing up quantities of the purge air that arise at predetermined and subsequent points of time after a start of the internal combustion engine; and the controller controls the internal combustion engine based on the total purge air quantity.

7. The evaporated fuel processing apparatus according to claim 1, wherein:

the controller comprises a duty driving unit that drives the purge control valve at a desired duty cycle; and the controller determines the quantity of the purge air based on basic data acquired at an intermediate point of the duty cycle.

8. The evaporated fuel processing apparatus according to claim 1, wherein:

the controller comprises a duty driving unit that drives the purge control valve at a desired duty cycle; and the controller determines the quantity of the purge air, based on an average value of basic data acquired at a time when the purge control valve switches from an ON position to an OFF position, and basic data acquired at a time when the purge control valve switches from the OFF position to the ON position.

9. The evaporated fuel processing apparatus according to claim 1, wherein:

the controller comprises a duty driving unit that drives the purge control valve at a desired duty cycle; and the controller acquires basic data for determining the quantity of the purge air at calculation points of time that are reached every two or more duty cycles, and determines the quantity of the purge air, based on an average value of the basic data acquired at two adjacent ones of the calculation points.

10. The evaporated fuel processing apparatus according to claim 6, wherein the controller:

updates the fuel injection amount correction coefficient so as to reduce a deviation of an actual air-fuel ratio from a target air-fuel ratio after the purge gas starts being purged;

determines whether the fuel injection amount correction coefficient is updated to be equal to a stable value that permits stable air-fuel ratio control; and determines the total purge air quantity by summing up the quantities of the purge air that arise upon or after a point of time at which the fuel injection amount correction coefficient is updated to be equal to the stable value.

11. The evaporated fuel processing apparatus according to claim 10, wherein the controller:

determines a pre-stabilization total purge gas quantity by summing up quantities of the purge gas that arise until the fuel injection amount correction coefficient is updated to be equal to the stable value;

determines a stabilization-point fresh air ratio that is a ratio of the purge air to the purge gas at a point of time when the fuel injection amount correction coefficient is updated to the stable value, based on the fuel injection amount correction coefficient;

estimates a total quantity of the purge air that arises until the fuel injection amount correction coefficient is updated to the stable value, by multiplying the pre-stabilization total purge gas quantity by the stabilization-point fresh air ratio; and determines the total purge air quantity by adding the estimated total quantity of the purge air before stabilization of the fuel injection amount correction coefficient, to the quantities of the purge air that arise upon or after a point of time at which the fuel injection amount correction coefficient is updated to the stable value.

12. The evaporated fuel processing apparatus according to claim 11, wherein the controller determines whether the fuel injection amount correction coefficient is updated to the stable value, based on a number of times or a period of time of updating of the fuel injection amount correction coefficient.

13. The evaporated fuel processing apparatus according to claim 11, wherein the controller determines whether the fuel injection amount correction coefficient is updated to the stable value, based on a manner of changing of the fuel injection amount correction coefficient.

14. The evaporated fuel processing apparatus according to claim 10, wherein the controller determines whether the fuel injection amount correction coefficient is updated to the stable value, based on a number of times or a period of time of updating of the fuel injection amount correction coefficient.

15. The evaporated fuel processing apparatus according to claim 10, wherein the controller determines whether the fuel injection amount correction coefficient is updated to the stable value, based on a manner of changing of the fuel injection amount correction coefficient.

16. The evaporated fuel processing apparatus according to claim 6, wherein the controller sets at least one control parameter of the purge control valve based on the total purge air quantity.

17. The evaporated fuel processing apparatus according to claim 16, wherein the controller:

determines a target total purge air quantity that is a target value of the total purge air quantity, based on a history of a vehicle condition;

compares the total purge air quantity with the target total purge air quantity; and sets the at least one control parameter based on a result of the comparison between the total purge air quantity and the target total purge air quantity, so that the total purge air quantity approaches the target total purge air quantity.

18. The evaporated fuel processing apparatus according to claim 17, wherein the controller:

determines a weighting factor that depends on a history of a vehicle condition; and sets the at least one control parameter such that the total purge air quantity becomes more close to the total purge air quantity as the weighting factor increases.

19. The evaporated fuel processing apparatus according to claim 18, wherein the controller determines a total intake air quantity by summing up quantities of intake air that arise after a start of the internal combustion engine, and wherein the history of the vehicle condition comprises the total intake air quantity.

20. The evaporated fuel processing apparatus according to claim 17, wherein the controller determines a total intake air quantity by summing up quantities of intake air that arise after a start of the internal combustion engine, and wherein the history of the vehicle condition comprises the total intake air quantity.

21. The evaporated fuel processing apparatus according to claim 17, wherein the controller:

detects a vapor concentration in the purge gas at an appropriate point of time after the purge gas starts flowing into the intake passage; and corrects the target total purge air quantity based on the vapor concentration in the purge air.

22. The evaporated fuel processing apparatus according to claim 21, wherein the vapor concentration provides the fuel injection amount correction coefficient.

23. The evaporated fuel processing apparatus according to claim 17, wherein the controller corrects the target total purge air quantity to be increased, based on an estimated quantity of fuel vapors generated in the fuel tank while purge control is stopped.

24. The evaporated fuel processing apparatus according to claim 23, wherein the controller determines the quantity of fuel vapors generated in the fuel tank during stop of purge control, based on an internal pressure of the fuel tank.

25. The evaporated fuel processing apparatus according to claim 6, wherein the controller corrects the total purge air quantity to be reduced, based on an estimated quantity of fuel vapors generated in the fuel tank while purge control is stopped.

26. The evaporated fuel processing apparatus according to claim 25, wherein the controller determines the quantity of fuel vapors generated in the fuel tank during stop of purge control, based on an internal pressure of the fuel tank.

27. The evaporated fuel processing apparatus according to claim 6, wherein the controller:

detects a vapor concentration in the purge gas at the predetermined point of time at which the total purge air quantity starts being calculated;

calculates an initial value of the total purge air quantity, which is a total quantity of purge air that is required to pass through the canister so as to bring the canister that is in a first condition for producing purge gas having a reference vapor concentration, into a second condition for producing purge gas having the vapor concentration detected at the predetermined point of time; and determines the total purge air quantity as represented by an absolute quantity, by adding the quantities of the purge air that arise at the predetermined and subsequent points of time, to the initial value of the total purge air quantity.

28. The evaporated fuel processing apparatus according to claim 27, wherein the controller:

stores linking data that associates the vapor concentration with the absolute total purge air quantity, with the total purge air quantity corresponding to the reference vapor concentration being set to zero; and specifies an absolute quantity of the total purge air quantity corresponding to the vapor concentration detected at the predetermined point of time, based on the linking data, and sets the initial value of the total purge air quantity to the specified value.

29. The evaporated fuel processing apparatus according to claim 28, wherein the fuel injection amount correction coefficient comprises a vapor concentration learning coefficient corresponding to the vapor concentration in the purge gas, and wherein the controller:

updates the vapor concentration learning coefficient so as to reduce the deviation of the actual air-fuel ratio from the target air-fuel ratio after the purge gas starts being purged;

determines whether the vapor concentration learning coefficient is updated to be equal to a stable value that permits stable air-fuel ratio control; and detects the vapor concentration in the purge gas at the predetermined point of time, based on the vapor concentration learning coefficient that has been updated to the stable value.

30. The evaporated fuel processing apparatus according to claim 27, wherein the fuel injection amount correction coefficient comprises a vapor concentration learning coefficient corresponding to the vapor concentration in the purge gas, and wherein the controller:

updates the vapor concentration learning coefficient so as to reduce the deviation of the actual air-fuel ratio from the target air-fuel ratio after the purge gas starts being purged;

determines whether the vapor concentration learning coefficient is updated to be equal to a stable value that permits stable air-fuel ratio control; and detects the vapor concentration in the purge gas at the predetermined point of time, based on the vapor concentration learning coefficient that has been updated to the stable value.

31. The evaporated fuel processing apparatus according to claim 27, wherein the controller estimates a vapor concentration in the purge gas, based on the total purge air quantity represented by the absolute quantity.

32. The evaporated fuel processing apparatus according to claim 31, wherein the controller:

stores linking data that associates the vapor concentration with the absolute total purge air quantity, with the total purge air quantity corresponding to the reference vapor concentration being set to zero; and specifies the vapor concentration corresponding to the total purge air quantity represented by the absolute quantity.

33. The evaporated fuel processing apparatus according to claim 32, wherein the fuel injection amount correction coefficient comprises a vapor concentration learning coefficient corresponding to the vapor concentration in the purge gas, and wherein the controller:

updates the vapor concentration learning coefficient so as to reduce the deviation of the actual air-fuel ratio from the target air-fuel ratio after the purge gas starts being purged;

permits updating of the vapor concentration learning coefficient only when the internal combustion engine is in a predetermined stable operating state; and modifies the vapor concentration learning coefficient based on the estimated vapor concentration when updating of the vapor concentration learning coefficient is not performed for a predetermined continuous period of time.

34. The evaporated fuel processing apparatus according to claim 33, wherein the controller:

detects a difference between the vapor concentration learning coefficient updated so as to reduce the deviation of the actual air-fuel ratio from the target air-fuel ratio, and the estimated vapor concentration learning coefficient corresponding to the total purge air quantity measured at a point of time when the updating is performed;

corrects the estimated vapor concentration so as to eliminate the difference; and modifies the vapor concentration learning coefficient based on the corrected vapor concentration.

35. The evaporated fuel processing apparatus according to claim 31, wherein the fuel injection amount correction coefficient comprises a vapor concentration learning coefficient corresponding to the vapor concentration in the purge gas, and wherein the controller:

updates the vapor concentration learning coefficient so as to reduce the deviation of the actual air-fuel ratio from the target air-fuel ratio after the purge gas starts being purged;

permits updating of the vapor concentration learning coefficient only when the internal combustion engine is in a predetermined stable operating state;

modifies the vapor concentration learning coefficient based on the estimated vapor concentration when updating of the vapor concentration learning coefficient is not performed for a predetermined continuous period of time.

36. The evaporated fuel processing apparatus according to claim 35, wherein the controller:

detects a difference between the vapor concentration learning coefficient updated so as to reduce the deviation of the actual air-fuel ratio from the target air-fuel ratio, and the estimated vapor concentration learning coefficient corresponding to the total purge air quantity measured at a point of time when the updating is performed;

corrects the estimated vapor concentration so as to eliminate the difference; and modifies the vapor concentration learning coefficient based on the corrected vapor concentration.

37. The evaporated fuel processing apparatus according to claim 31, wherein the fuel injection amount correction coefficient comprises a vapor concentration learning coefficient corresponding to the vapor concentration in the purge gas, and wherein the controller:

updates the vapor concentration learning coefficient so as to reduce the deviation of the actual air-fuel ratio from the target air-fuel ratio after the purge gas starts being purged;

detects a difference between the updated vapor concentration learning coefficient and the estimated vapor concentration learning coefficient corresponding to the total purge air quantity measured at a point of time when the updating is performed;

calculates a reducing correction amount that is applied to the fuel injection amount, depending upon a degree of the difference; and increases the reducing correction amount when the vapor concentration learning coefficient represents a higher vapor concentration than the estimated vapor concentration, and reduces the reducing correction amount when the vapor concentration learning coefficient represents a lower vapor concentration than the estimated vapor concentration.

38. The evaporated fuel processing apparatus according to claim 37, wherein the controller allows the reducing correction amount to increase only when the total purge air quantity as represented by the absolute quantity is equal to or greater than a predetermined value.

39. The evaporated fuel processing apparatus according to claim 38, wherein the controller:

determines whether the vapor concentration learning coefficient represents a higher vapor concentration than the estimated vapor concentration, by comparing the degree of the difference with a predetermined judgement value; and sets the predetermined judgement value based on the total purge air quantity represented as the absolute quantity.

40. The evaporated fuel processing apparatus according to claim 37, wherein the controller:

determines whether the vapor concentration learning coefficient represents a higher vapor concentration than the estimated vapor concentration, by comparing the degree of the difference with a predetermined judgement value; and sets the predetermined judgement value based on the total purge air quantity represented as the absolute quantity.

41. An evaporated fuel processing apparatus, comprising:

a canister that traps fuel vapors generated in a fuel tank;

a purge control valve disposed between the canister and an intake passage of the internal combustion engine; and a controller that:

determines a quantity of purge gas that passes through the purge control valve;

determines a fuel injection amount correction coefficient for eliminating a deviation of an actual air-fuel ratio from a target air-fuel ratio due to the purge gas;

determines a quantity of fuel vapors supplied to the internal combustion engine through the purge control valve, based on a basic fuel injection amount and the fuel injection amount correction coefficient;

determines a quantity of purge air that passes through the purge control valve, by subtracting the quantity of the fuel vapors from the quantity of the purge gas; and controls the internal combustion engine based on the quantity of the purge air.

42. The evaporated fuel processing apparatus according to claim 41, wherein:

the controller further determines a total purge air quantity by summing up quantities of the purge air that arise at predetermined and subsequent points of time after a start of the internal combustion engine; and the controller controls the internal combustion engine based on the total purge air quantity.

43. The evaporated fuel processing apparatus according to claim 41, wherein:

the controller comprises a duty driving unit that drives the purge control valve at a desired duty cycle; and the controller determines the quantity of the purge air based on basic data acquired at an intermediate point of the duty cycle.

44. The evaporated fuel processing apparatus according to claim 41, wherein:

the controller comprises a duty driving unit that drives the purge control valve at a desired duty cycle; and the controller determines the quantity of the purge air, based on an average value of basic data acquired at a time when the purge control valve switches from an ON position to an OFF position, and basic data acquired at a time when the purge control valve switches from the OFF position to the ON position.

45. The evaporated fuel processing apparatus according to claim 41, wherein:

the controller comprises a duty driving unit that drives the purge control valve at a desired duty cycle; and the controller acquires basic data for determining the quantity of the purge air at calculation points of time that are reached every two or more duty cycles, and determines the quantity of the purge air, based on an average value of the basic data acquired at two adjacent ones of the calculation points.

* * * * *